US007621519B2

(12) United States Patent
Sagawa et al.

(10) Patent No.: US 7,621,519 B2
(45) Date of Patent: Nov. 24, 2009

(54) SHEET CONVEYING APPARATUS, IMAGE READING APPARATUS, AND IMAGE FORMING APPARATUS

(75) Inventors: Yasuhiro Sagawa, Kanagawa (JP); Kenji Ueda, Kanagawa (JP); Masayuki Ueda, Tokyo (JP); Tamiya Akimoto, Saitama (JP); Naoyuki Okamoto, Tokyo (JP); Hiroyuki Watase, Kanagawa (JP); Yoshikuni Ishikawa, Tokyo (JP); Hiroshi Kajiyama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 305 days.

(21) Appl. No.: 11/517,377

(22) Filed: Sep. 8, 2006

(65) Prior Publication Data

US 2007/0057444 A1 Mar. 15, 2007

(30) Foreign Application Priority Data

| | | |
|---|---|---|
| Sep. 13, 2005 | (JP) | 2005-265256 |
| Mar. 10, 2006 | (JP) | 2006-065518 |
| Jul. 11, 2006 | (JP) | 2006-190331 |
| Aug. 7, 2006 | (JP) | 2006-214779 |

(51) Int. Cl.
*B65H 5/22* (2006.01)

(52) U.S. Cl. ..... 271/4.01; 271/10.01; 271/9.11

(58) Field of Classification Search ..... 271/4.01, 271/10.01, 9.11
See application file for complete search history.

(56) References Cited

U.S. PATENT DOCUMENTS

| | | | | |
|---|---|---|---|---|
| 4,891,678 | A | 1/1990 | Ishizu et al. | |
| 5,765,825 | A | 6/1998 | Watase | |
| 6,273,414 | B1 * | 8/2001 | Matsuo | 271/9.11 |
| 6,341,774 | B1 | 1/2002 | Ueda | |
| 6,533,263 | B2 * | 3/2003 | Tamura | 271/10.01 |
| 6,690,901 | B2 | 2/2004 | Katsuyama et al. | |
| 6,757,515 | B2 | 6/2004 | Ueda | |
| 6,955,349 | B2 | 10/2005 | Watase | |
| 7,068,969 | B2 | 6/2006 | Ueda | |
| 7,334,786 | B2 * | 2/2008 | Shinga | 271/9.11 |
| 2004/0265031 | A1 | 12/2004 | Ueda | |
| 2005/0073088 | A1 | 4/2005 | Watase | |
| 2005/0151313 | A1 * | 7/2005 | Shimazaki | 271/10.01 |

FOREIGN PATENT DOCUMENTS

| | | |
|---|---|---|
| JP | 2-248962 | 10/1990 |
| JP | 3-31741 | 3/1991 |

(Continued)

OTHER PUBLICATIONS

U.S. Appl. No. 08/840,937, filed Apr. 18, 1997, Ueda.

*Primary Examiner*—David H Bollinger
(74) *Attorney, Agent, or Firm*—Oblon, Spivak, McClelland, Maier & Neustadt, L.L.P.

(57) ABSTRACT

A first conveying unit conveys a sheet. A second conveying unit conveys the sheet conveyed by the first conveying unit in a direction different from a sheet conveying direction of the first conveying unit, and is disposed on a downstream side in the sheet conveying direction of the first conveying unit. A guiding unit reduces a sheet conveying load. The guiding unit is disposed in an outer area of a sheet conveying path formed between the first conveying unit and the second conveying unit.

12 Claims, 21 Drawing Sheets

FOREIGN PATENT DOCUMENTS

| | | |
|---|---|---|
| JP | 6-156787 | 6/1994 |
| JP | 9-290945 | 11/1997 |
| JP | 10-129883 | 5/1998 |
| JP | 2004-284777 | 10/2004 |
| JP | 2004-338923 | 12/2004 |
| JP | 2005-1771 | 1/2005 |
| JP | 2005-89008 | 4/2005 |

* cited by examiner

CONVEYING TIME FLUCTUATIONS BY PAPER TYPE

SHEET CONVEYING APPARATUS, IMAGE READING APPARATUS, AND IMAGE FORMING APPARATUS

CROSS-REFERENCE TO RELATED APPLICATIONS

The present document incorporates by reference the entire contents of Japanese priority documents, 2005-265256 filed in Japan on Sep. 13, 2005, 2006-065518 filed in Japan on Mar. 10, 2006, 2006-190331 filed in Japan on Jul. 11, 2006 and 2006-214779 filed in Japan on Aug. 7, 2006.

BACKGROUND OF THE INVENTION

1. Field of the Invention

The present invention relates to a sheet conveying apparatus, an image reading apparatus including the sheet conveying apparatus, such as a copier, a facsimile, a printer, a printing machine, an ink-jet recording apparatus, and a scanner, and an image forming apparatus, such as a multifunction product formed in combination of at least two of the above functions.

2. Description of the Related Art

Conventionally, in image forming apparatuses, such as a copier including a plain paper copier (PPC), a facsimile, a printer, a printing machine, and an ink-jet recording apparatus, to achieve downsizing of the entire apparatus, its conveying unit also tends to be downsized. Such a conveying unit is for conveying and supplying, from a sheet accommodating unit or a sheet stacking unit to an image forming unit body, a medium subjected to image formation or a sheet-like recording medium (hereinafter "sheet") on which an image is formed. The sheet accommodating unit that accommodates sheets is exemplarily explained below.

Also, of these image forming apparatuses, many models generally support various sheet sizes (hereinafter, "paper sizes") or sheet types (hereinafter, "paper types"). In these models of image forming apparatuses, for example, sheets (hereinafter, "papers") of several paper sizes and paper types are accommodated in advance in sheet accommodating units. Then, a paper is supplied from a sheet accommodating unit selected by the user as appropriate, or a paper automatically selected by the image forming apparatus is supplied. With such a configuration, the sheet accommodating units occupy and consume a larger space in the image forming apparatus, and therefore demands for downsizing each conveying unit are increased.

For this reason, a conveying path formed between the sheet accommodating unit and the image forming unit body in the image forming apparatus is significantly changed in its conveying direction depending on the positional relation between these units to reduce the occupied space of the conveying path itself. To successively and smoothly change the conveying direction, a curvature portion in a curved shape is provided on the conveying path, and a radius of curvature of the curvature portion is set small so that a standard-sized recording paper as a sheet for normal use in the image forming apparatus can be conveyed.

An example in the conventional technology of a sheet conveying apparatus in the image forming apparatus as mentioned above is shown in FIG. 16. That is, as shown in the drawing, an image forming unit body not shown includes stages on a lower side, each of which having disposed therein a sheet accommodating unit 101 including a paper feeding tray 109 having accommodated therein a predetermined number of stacked papers S of a predetermined paper size and paper type. Between the paper feeding tray 109 and the image forming unit body, a paper conveying apparatus (sheet conveying apparatus) 102 is provided that draws one paper S0 in an approximately horizontal direction from the selected paper feeding tray 109 and feeds it upward toward the image forming unit body. The paper conveying apparatus 102 has fixed thereto curved guide members 103 and 104 that guide the paper S0 by successively changing a sheet proceeding direction from an approximately horizontal direction to an approximately upward direction (which is also an approximately vertically-upward direction). These fixed curved guide members 103 and 104 form the curvature portion mentioned above, and also a paper conveying path (sheet conveying path) A0 is formed. In the drawing, B denotes a paper conveying path for upward-feeding of a paper S of another paper size or paper type accommodated in a paper feeding tray at a lower stage.

Here, the paper conveying apparatus 102 shown in FIG. 16 is an equivalent device specifically represented for comparison between an example of the conventional technology disclosed in, for example, Japanese Patent Application Laid-Open No. 2004-338923, FIGS. 6A to 6C and 7, and a paper conveying apparatus (sheet conveying apparatus) according to embodiments of the present invention, which will be explained further below.

The curved guide member 103 has formed thereon a fixed guide surface 103A that curves in an approximately convex shape for guiding the paper S. The curved guide member 104 is externally provided with reference to the paper conveying path A0 of the curvature portion to internally face the curved guide member 103. This external curved guide member 104 has formed thereon a fixed guide surface 104A that curves in an approximately concave shape to face the fixed guide surface 103A. At the end of a downstream in a paper conveying direction in the fixed guide surface 104A, a flexible sheet feeler 104*a* that is made of Mylar or the like and is elastically deformable is provided to extend to a nip portion of paired rollers 106, which will be explained further below.

Reference numeral 105 denotes paired rollers provided on an upstream side of the paper conveying path A0. These paired rollers 105 (first conveying unit, nip conveying unit) on the upstream side include a feed roller 105A and a reverse roller 105B. Reference numeral 106 denotes paired rollers (second conveying unit, nip conveying unit) provided on a downstream side of the paired rollers 105 on the upstream side. Reference numeral 107 denotes a pickup roller provided on the sheet accommodating unit 101 side. Of these rollers, each appropriate one is rotatingly driven at its location in an arrow direction to convey a paper. Between the paper feeding tray 109 and the external curved guide member 104, an intermediate guide member 108 is provided as an external guide that forms paper conveying path between these components 109 and 104.

However, in the paper conveying apparatus 102 configured as mentioned above, in the case of trying to convey a special paper with a relatively high stiffness or strength in a thickness direction of a subject to be conveyed, such as a paper S0 typified by a cardboard, or an envelop (hereinafter, "high-stiffness paper S0" or "high-strength paper S0"), since the radius of curvature of the curvature portion in the paper conveying path A0 is small, a resistance that occurs when the high-stiffness paper S0 is bent according to the curvature is significantly large compared with that of an ordinary paper for copy, for example. Therefore, there is a problem where it is difficult to smoothly advance the high-stiffness paper S0, causing a jam or faulty conveyance to make a stable feeding operation impossible.

The operation mentioned above is explained in further detail as follows. That is, in the paper conveying apparatus 102 in FIG. 16, the paper S0 is conveyed from the upstream paired rollers 105 provided in the paper conveying path A0, and when the tip of the paper S0 in a conveying direction reaches the curved guide member 103, the front-half of the paper S0 on the tip side is curved in a thickness direction by the fixed guide surface 103A of the curved guide member 103. Therefore, when the high-stiffness paper S0 is conveyed between the curved guide members 103 and 104, a resistance acted on this high-stiffness paper S0 against the curve is increased, thereby increasing a resistance against conveyance. Therefore, the tip side of the high-stiffness paper S0 does not reach the downstream paired rollers 106, and the high-stiffness paper S0 is conveyed only by the upstream paired rollers 105. When the high-stiffness paper S0 is bent by the curved guide member 103, only the conveying force by these upstream paired rollers 105 is not enough as an advancing force in a conveying direction against the resistance from the bent high-stiffness paper S0. For this reason, a faulty conveyance and a paper jam tend to occur. For example, a faulty conveyance may occur such that the center line of the high-stiffness paper S0 does not coincide with the center line of the conveying path. Also, for example, a paper jam may occur such that the high-stiffness paper S0 is caught in the curved guide member 103 and stops there.

On the other hand, in the paper conveying apparatus as mentioned above that is configured to change the paper conveying direction to a predetermined direction for conveyance, the rear end of the paper to be conveyed collides with a certain guide member in an impactive manner, depending on the shape of the guide member, in the course of conveyance in the paper conveying apparatus, thereby posing a problem of causing an unusual sound, such as a so-called clicking sound. In particular, in the case of conveying a paper with a high stiffness or strength in the thickness direction, that is, a high-stiffness paper, such as a cardboard, with a conveying force sufficiently larger than a conveying load being provided onto the paper, such an unusual sound as mentioned above tends to occur more significantly in the course of paper conveyance.

That is, firstly, as shown in FIG. 17, in the course of paper conveyance from the pickup roller 107 to the feed roller 105A, with a difference in height between the downstream end of the paper conveying direction on a paper stacking surface 101A and the guide member positioned on the downstream side of the paper conveying direction near the downstream end of the paper stacking surface 101A, a clicking sound occurs when the rear end of the paper goes across this difference. In more detail, a difference in height causes such a clicking sound as mentioned above when a guide surface 109A formed on the paper feeding tray 109 and positioned on the downstream side in the paper conveying direction near the paper stacking surface 101A defined by the paper S0 on top accommodated in the sheet accommodating unit 101 occupies a lower position relatively slightly away from the paper conveying path with reference thereto so as to form a predetermined space between these components 101A and 109A.

That is, in the course of paper conveyance, when the rear end of the paper S0 on top left on the paper feeding tray 109 moves from the paper stacking surface 101A to the guide surface 109A of the paper feeding tray 109, the rear end of the paper S0 collides with the guide surface 109A in an impactive manner, as depicted with a dotted line in the drawing. In particular, the high-stiffness paper S0 has a high flat-shape maintaining ability, and even if deformed, the ability of elastic returning to the flat shape is high. Therefore, this high ability of elastic returning to the flat shape promotes the tendency of the rear end of the paper S0 colliding with the guide surface in an impactive manner when moving as mentioned above, thereby making the clicking sound more significant. That is, the clicking sound occurring in the course of paper conveyance at the time of conveying a high-stiffness paper is larger than other sounds occurring in association with paper conveyance, and is significant as an unusual sound (impactive sound).

Also, as shown in FIG. 18, in the course of paper conveyance from the pickup roller 107 to the feed roller 105A, when a difference in height between the guide surface 109A of the paper feeding tray 109 and the external guide is present, a clicking sound occurs even when a rear end S0*e* of the paper S0 goes across the difference. That is, when an upstream end of the paper conveying direction on a guide surface 108A formed on intermediate guide member 108 as an external guide member on the downstream side of the paper conveying direction near the guide surface 109A of the paper feeding tray 109 occupies a lower position relatively slightly away from the paper conveying path with reference thereto, and forms predetermined space between these components 109A and 108A, the difference in height causes a clicking sound, as mentioned above. At the time of conveying a high-stiffness paper S0, a more significant clicking sound occurs, as mentioned with reference to FIG. 17.

Furthermore, as shown in FIG. 19, when a difference in height between the guide members forming an external guide is present between the feed roller 105A as a pre-turn roller and the paired rollers 106, a clicking sound also occurs when the rear end S0*e* of the paper S0 being conveyed goes over that difference. That is, among the guide members forming the paper conveying path A0, when an upstream end of the paper conveying direction on the curved guide member 104 occupies a lower position relatively slightly away from the paper conveying direction with reference thereto compared with a downstream end of the paper conveying direction on the guide surface 108A formed on the intermediate guide member 108 and a predetermined space is present between these components 108A and 104, the difference in height causes a clicking sound, as explained with reference to FIGS. 17 and 18. At the time of conveying the high-stiffness paper S0, a significant clicking sound occurs as mentioned above.

In summary, in some of the guide members forming a paper conveying path disposed on an outer-area side, consider a case where, compared with the downstream end of the paper conveying direction on a guide surface formed on one of guide members near the paper conveying direction, the upstream end of the paper conveying direction on a guide surface formed on the other following guide member is displaced in a direction of going a predetermined distance away from the paper conveying path. In this case, with the advancement of paper conveyance, when the rear end of the paper passes through one guide surface and then goes away from the downstream end of that guide surface, the rear end of the paper quickly moves in the going-away direction mentioned above to collide with the upstream end of the guide member, thereby causing an impactive clicking sound. Depending on the state of deformation in a thickness direction of the paper in the course of paper conveyance and the stiffness strength of the paper itself, the impact of the rear end of the paper is large, thereby causing a large volume of a clicking sound.

On the other hand, as shown in FIG. 20, between the feed roller 105A and the paired rollers 106, when the curved guide member 104, which is an external guide member, turns the paper S by, for example, bending the paper S as shown in states provided with reference characters Xb to Xd, that is, when the conveyed paper is in a state provided with a reference characters Xa in the case where the guide shape is such that a direction in which the tip of the paper S advances is turned to a predetermined direction by bending a portion on a rear end side of the paper S rather than the tip thereof, that is, when the tip of the paper S collides with the curved guide surface A0, the paper conveying load is larger than that of the states provided with other reference characters Xb to Xd. In particular, at the time of conveying a high-stiffness paper, the paper conveying load is larger than that of a normal-stiffness paper in any of the paper conveying states provided with the reference characters Xa to Xd. Similarly, when the tip of the high-stiffness paper S collides with the curved guide surface A0 (Xa), the load becomes the largest.

To get around this problem, in a paper feeding device disclosed in Japanese Patent Application Laid-Open No. 2004-338923, pp. 1-3, FIGS. 1-7 (hereinafter, "first patent document") that conveys a sheet conveyed from the first conveying unit to a second conveying unit positioned approximately vertically above on a downstream side of a conveying direction, a pair of linear guide members are provided between the first conveying unit and the second conveying unit, and a sheet is conveyed with the guide of these linear guide members. According to this paper conveying device, the guide members are not in a curved shape but in a linear shape. Therefore, the conveying load can be reduced, that is, an abrupt change in load can be suppressed, thereby preventing a faulty conveyance, such as a paper jam or an oblique slip.

In short, according to the paper feeding device, without concentrating a deformed portion on the sheet to be conveyed on one portion bent by a curved guide member, the deformed portion can be distributed to two portions at front and rear ends of the linear guide members in the conveying direction. Furthermore, the linear guide members are diagonally placed at an approximately intermediate angle to make the degree of curvature at these portions approximately equal to each other, thereby suppressing an abrupt change in conveying load at the time of conveyance. That is, when a sheet advancing direction is changed, two portions are bent: a portion where the sheet is passed from upstream paired rollers to the linear guide members and a portion where the sheet is passed from the linear guide members to downstream paired rollers. This makes each of the degree of curvature at least small. With this, the resistance occurring by bending each portion can be kept low, thereby preventing an abrupt increase in conveying load.

Another paper feeding device has been known (for example, refer to Japanese Patent Application Laid-Open No. 2005-89008, pp. 2-3, FIGS. 4 and 5 (hereinafter, "second patent document")). In this paper feeding device, first and second conveying units configured in a manner similar to those of the conventional paper conveying apparatus shown in FIG. 16 and the paper feeding device disclosed in Japanese Patent Application Laid-Open No. 2004-338923 (the first patent document), and a reverse guide member that forms an inclined surface leading to the second conveying unit is provided between the first and second conveying units. This reverse guide member is configured to be movable toward the second conveying unit.

According to the paper feeding device, when the rear end of a sheet makes contact with the reverse guide member, the reverse guide member is displaced in a direction in which the rear end of the sheet makes contact. With this displacement, a shock at the time of contact can be absorbed, thereby reducing a touch sound.

Also, a sheet feeding device has been known (for example, refer to Japanese Patent Application Laid-Open No. 10-129883, pp. 1-2, FIG. 1 (hereinafter, "third patent document")). In this sheet feeding device, a plurality of sheet accommodating units that accommodate sheets are provided, each of which is individually provided with a conveying path and a sheet feeding unit, wherein an end of the conveying path is joined to one common conveying path. Also, at least a conveying path provided to a sheet accommodating unit that accommodates high-stiffness sheets has provided at its end a first curvature portion for joining to the common conveying path, the first curvature portion having a radius of curvature set larger than a radius of curvature of other curvature portions for joining provided to other conveying path.

According to the sheet feeding device, at the time of conveyance, when a high-stiffness sheet advances on the conveying path to pass through the first curvature portion with a large radius of curvature, the high-stiffness sheet is prevented from being bent to a degree similar to that for an ordinary sheet, and continues to advance as being sufficiently mildly bent. With this, the resistance at the time of conveyance can be small, thereby causing the high-stiffness sheet to reach the common conveying path for conveyance without a sheet jam or delay.

Furthermore, a sheet reversing unit provided to an image forming apparatus has been known (for example, refer to Japanese Patent Application Laid-Open No. 2005-1771, pp. 1-2, FIG. 1 (hereinafter, "fourth patent document")). In this sheet reversing unit, paired reverse rollers and a reverse conveying path for conveying and guiding a sheet fed from these paired reverse rollers are provided. The reverse conveying path has a direction-change portion for changing a sheet conveying direction. A rotatable roller is disposed inside the direction-change portion in a right-angle direction when viewed in the sheet conveying direction. With this, the sheet fed to the reverse conveying path is sent in contact with the rollers.

According to the sheet reversing unit, an inner contact portion of the fed sheet always makes contact at the direction-change portion with the rollers. Also, these rollers are driven in association with advancement of the sheet in the conveying direction. Therefore, compared with a conventional guide plate, the conveying resistance can be small. That is, a friction resistance occurring between the fixed guide member and the moving sheet is resolved, thereby achieving a guide that changes a conveying direction at the direction-change portion.

However, in the conventional paper conveying apparatus and the sheet conveying apparatus disclosed in the first patent document shown in FIGS. 16 to 20, the configuration is such that a fixed member for guiding a sheet to be conveyed is merely disposed, after all. Therefore, a difference in speed between the moving sheet to be conveyed and the fixed guide member cannot be resolved. This poses a problem where a resistance acting in a direction hindering the sheet conveyance always occurs irrespectively of the shape or installation position of the guide member, and serves as a conveying load.

That is, in the conventional configuration, the effects of preventing the jam and faulty conveyance mentioned above are insufficient. Even though the linear guide members can suppress an abrupt increase in conveying load, the occurrence of the conveying load cannot be eliminated. In particular, when a high-stiffness paper (sheet), such as a cardboard or an envelope, is to be conveyed, the fault conveyance and jam mentioned above and a clicking sound of the rear end of the paper are significant.

In the configuration disclosed in the second patent document in which a reverse guide member is provided, even if the reverse guide member is a movable member in a sense of capable of being displaced in a direction in which the rear end of the paper makes contact, the reverse guide member is a fixed guide member as a guide for changing the orientation of the paper. Similarly, when guiding with the orientation being changed, a relative difference between the paper and the reverse guide member is not resolved, thereby causing a conveying load. In particular, when a high-stiffness paper (sheet), such as a cardboard or an envelope, is to be conveyed, the fault conveyance and jam mentioned above and a clicking sound of the rear end of the paper are significant.

Furthermore, even in the configuration as disclosed in the third patent document in which a dedicated conveying path with its radius of curvature being set at a predetermined large value, the sheet advancing on this dedicated conveying path is mildly bent, thereby reducing a conveying load of the sheet receiving from the conveyor path, but the occurrence of the conveying load cannot be eliminated similarly to the above. In particular, when a high-stiffness paper (sheet), such as a cardboard or an envelope, is to be conveyed, the fault conveyance and jam mentioned above are significant.

Still further, in the configuration disclosed in the fourth patent document in which movable members, such as rollers, are provided at predetermined positions on the inner conveying path portion at the direction-change portion of the conveying path, in the course of conveyance, even if the inner rollers can particularly effectively reduce a friction resistance between the front and rear ends of the sheet with an intermediate portion being supported, no consideration is given to a conveying load before and after the state explained above, that is, a conveying load when the external conveying path portion at the direction-change portion and the sheet make contact with each other. Also, no particular mention is made of behaviors of the tip and rear end of the sheet in the course of conveyance. In particular, when a high-stiffness paper (sheet), such as a cardboard or an envelope, is to be conveyed, the fault conveyance and jam mentioned above and a clicking sound of the rear end of the paper are significant.

SUMMARY OF THE INVENTION

It is an object of the present invention to at least partially solve the problems in the conventional technology.

A sheet conveying apparatus according to one aspect of the present invention includes a first conveying unit that conveys a sheet; a second conveying unit that conveys the sheet conveyed by the first conveying unit in a direction different from a sheet conveying direction of the first conveying unit; and a guiding unit that moves the sheet while maintaining a contact with a tip of the sheet, to guide the sheet to the second conveying unit. The second conveying unit is disposed on a downstream side in the sheet conveying direction of the first conveying unit. The guiding unit is disposed in an outer area of a sheet conveying path formed between the first conveying unit and the second conveying unit.

A sheet conveying apparatus according to another aspect of the present invention includes a plurality of sheet conveying devices. Each of the sheet conveying devices includes a first conveying unit that conveys a sheet; a second conveying unit that conveys the sheet conveyed by the first conveying unit in a direction different from a sheet conveying direction of the first conveying unit; and a guiding unit that moves the sheet to guide the sheet to the second conveying unit. The second conveying unit is disposed on a downstream side in the sheet conveying direction of the first conveying unit. The guiding unit is disposed in an outer area of a sheet conveying path formed between the first conveying unit and the second conveying unit. The second conveying unit is a nip conveying unit that includes a nip portion to nip and convey the sheet. The guiding unit of at least one of the sheet conveying devices is a belt conveying unit including a belt that conveys the sheet to either one of the second conveying unit and the nip portion.

An image reading apparatus according to still another aspect of the present invention includes a sheet conveying device. The sheet conveying device includes a first conveying unit that conveys a sheet; a second conveying unit that conveys the sheet conveyed by the first conveying unit in a direction different from a sheet conveying direction of the first conveying unit; and a guiding unit that moves the sheet while maintaining a contact with a tip of the sheet, to guide the sheet to the second conveying unit. The second conveying unit is disposed on a downstream side in the sheet conveying direction of the first conveying unit. The guiding unit is disposed in an outer area of a sheet conveying path formed between the first conveying unit and the second conveying unit.

An image forming apparatus according to still another aspect of the present invention includes a sheet conveying device. The sheet conveying device includes a first conveying unit that conveys a sheet; a second conveying unit that conveys the sheet conveyed by the first conveying unit in a direction different from a sheet conveying direction of the first conveying unit; and a guiding unit that moves the sheet while maintaining a contact with a tip of the sheet, to guide the sheet to the second conveying unit. The second conveying unit is disposed on a downstream side in the sheet conveying direction of the first conveying unit. The guiding unit is disposed in an outer area of a sheet conveying path formed between the first conveying unit and the second conveying unit.

A sheet conveying apparatus according to still another aspect of the present invention includes a first conveying unit that conveys a sheet; a second conveying unit that conveys the sheet conveyed by the first conveying unit in a direction different from a sheet conveying direction of the first conveying unit; a guiding unit that moves the sheet to guide the sheet to the second conveying unit; a first guide member that forms a first sheet conveying path from the first conveying unit to the guiding unit; and a second guide member that forms a second sheet conveying path from the first conveying unit to the second conveying unit. The second conveying unit is disposed on a downstream side in the sheet conveying direction of the first conveying unit. The guiding unit is disposed in an outer area of a sheet conveying path formed between the first conveying unit and the second conveying unit. The first guide member is disposed at the outer-area of the sheet conveying path between the first conveying unit and the second conveying unit. The second guide member is disposed in an inner area of the sheet conveying path between the first conveying unit and the second conveying unit. Each of the first conveying unit and the second conveying unit is a nip conveying unit that includes a nip portion to nip and convey the sheet. At least a part of the second guide member is provided outside of a line segment connecting a center of the nip portion of the first conveying unit and a center of the nip portion of the second conveying unit.

A sheet conveying apparatus according to still another aspect of the present invention includes a first conveying unit that conveys a sheet; a second conveying unit that conveys the sheet conveyed by the first conveying unit in a direction different from a sheet conveying direction of the first conveying unit; a guiding unit that moves the sheet to guide the sheet to the second conveying unit; and a guide member that forms an inner area of a sheet conveying path from the first conveying unit to the second guiding unit. The second conveying unit is disposed on a downstream side in the sheet conveying direction of the first conveying unit. The guiding unit is disposed in an outer area of a sheet conveying path formed between the first conveying unit and the second conveying unit. The guide member is provided on a side of an inner-area from a tangent line of paired facing members disposed in the first conveying unit and the second conveying unit in an inner-area direction.

A sheet conveying apparatus according to still another aspect of the present invention conveys a sheet of at least 256 g/m$^2$ to 300 g/m$^2$. The sheet conveying apparatus includes a first conveying unit that conveys a sheet; a second conveying unit that conveys the sheet conveyed by the first conveying unit in a direction different from a sheet conveying direction of the first conveying unit; and a belt conveying unit including a belt that moves the sheet to guide the sheet to the second conveying unit. The second conveying unit is disposed on a downstream side in the sheet conveying direction of the first conveying unit. The belt conveying unit is disposed in an outer area of a sheet conveying path formed between the first conveying unit and the second conveying unit. The belt conveying unit is disposed in such a manner that a tip of the sheet enters at an acute angle with respect to a conveying surface of the belt.

An image forming apparatus according to still another aspect of the present invention includes a paper feeding unit that feeds a sheet; a document reading unit that reads an image of a document; an image forming unit that forms the image read by the document reading unit on the sheet fed from the paper feeding unit; a sheet delivering unit that delivers the sheet output from the image forming unit; and a sheet conveying unit that conveys a sheet of at least 256 g/m$^2$ to 300 g/m$^2$ from the paper feeding unit to the image forming unit. The sheet conveying unit includes a first conveying unit that conveys the sheet fed from the paper feeding unit; a second conveying unit that conveys the sheet conveyed by the first conveying unit in a direction different from a sheet conveying direction of the first conveying unit; and a belt conveying unit including a belt that moves the sheet to guide the sheet to the second conveying unit. The second conveying unit is disposed on a downstream side in the sheet conveying direction of the first conveying unit. The belt conveying unit is disposed in an outer area of a sheet conveying path formed between the first conveying unit and the second conveying unit. The belt conveying unit is disposed in such a manner that a tip of the sheet enters at an acute angle with respect to a conveying surface of the belt.

A sheet conveying apparatus according to still another aspect of the present invention includes a first conveying unit that conveys a sheet; a second conveying unit that conveys the sheet conveyed by the first conveying unit in a direction different from a sheet conveying direction of the first conveying unit; a guiding unit that moves the sheet to guide the sheet to the second conveying unit; and a guide member that guides the sheet to the guiding unit. The second conveying unit is disposed on a downstream side in the sheet conveying direction of the first conveying unit. The guiding unit is disposed in an outer area of a sheet conveying path formed between the first conveying unit and the second conveying unit. The guide member is disposed at the outer-area of the sheet conveying path between the first conveying unit and the second conveying unit. The guiding unit is a belt conveying unit including a belt that conveys the sheet to the second conveying unit. The belt conveying unit further includes a belt rotating member that holds the belt to allow the belt to rotate and an outer-area rotating member in the second conveying unit, and is formed by winding the belt around the belt rotating member and the outer-area rotating member. The belt rotating member is positioned upward from an axial center of a rotating member provided in an outer area of the first conveying unit and downward from a downstream end of the second guide member.

A sheet conveying apparatus according to still another aspect of the present invention includes a first conveying unit that conveys a sheet; a second conveying unit that conveys the sheet conveyed by the first conveying unit in a direction different from a sheet conveying direction of the first conveying unit; and a guiding unit that moves the sheet to guide the sheet to the second conveying unit. The second conveying unit is disposed on a downstream side in the sheet conveying direction of the first conveying unit. The guiding unit is disposed in an outer area of a sheet conveying path formed between the first conveying unit and the second conveying unit. The guiding unit is a belt conveying unit including a belt that conveys the sheet to the second conveying unit. The belt conveying unit further includes a belt rotating member that holds the belt to allow the belt to rotate and an outer-area rotating member in the second conveying unit, and is formed by winding the belt around the belt rotating member and the outer-area rotating member. The belt conveying unit is disposed in such a manner that a tip of the sheet makes contact with a conveying surface of the belt other a portion of the belt held by the belt rotating members.

A sheet conveying apparatus according to still another aspect of the present invention includes a first conveying unit that conveys a sheet; a second conveying unit that conveys the sheet conveyed by the first conveying unit in a direction different from a sheet conveying direction of the first conveying unit; a guiding unit that moves the sheet to guide the sheet to the second conveying unit; and at least one guide member that guides the sheet to the second conveying unit the second conveying unit is disposed on a downstream side in the sheet conveying direction of the first conveying unit. The guiding unit is disposed in an outer area of a sheet conveying path formed between the first conveying unit and the second conveying unit. The guide member is disposed on a sheet conveying path between the first conveying unit and the guiding unit. A sum of a sheet conveying force by the first conveying unit and a sheet conveying force by the guiding unit is larger than a total sheet conveying load at the guide member.

An image forming apparatus according to still another aspect of the present invention is capable of conveying a sheet of at least 256 g/m$^2$ to 300 g/m$^2$. The image forming apparatus includes a paper feeding unit that feeds a sheet; a document reading unit that reads an image of a document; an image forming unit that forms the image read by the document reading unit on the sheet fed from the paper feeding unit; a sheet stacking unit that stacks the sheet output from the image forming unit; a sheet conveying unit that conveys the sheet from the paper feeding unit to the image forming unit; a sheet guiding unit that guides the sheet from the paper feeding unit to the image forming unit; and a sheet-load reducing unit that reduces a sheet conveying load. The sheet stacking unit is disposed in a space between the image forming unit and the document reading unit. The sheet-load reducing unit is disposed at a position where the sheet guiding unit makes contact with the sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
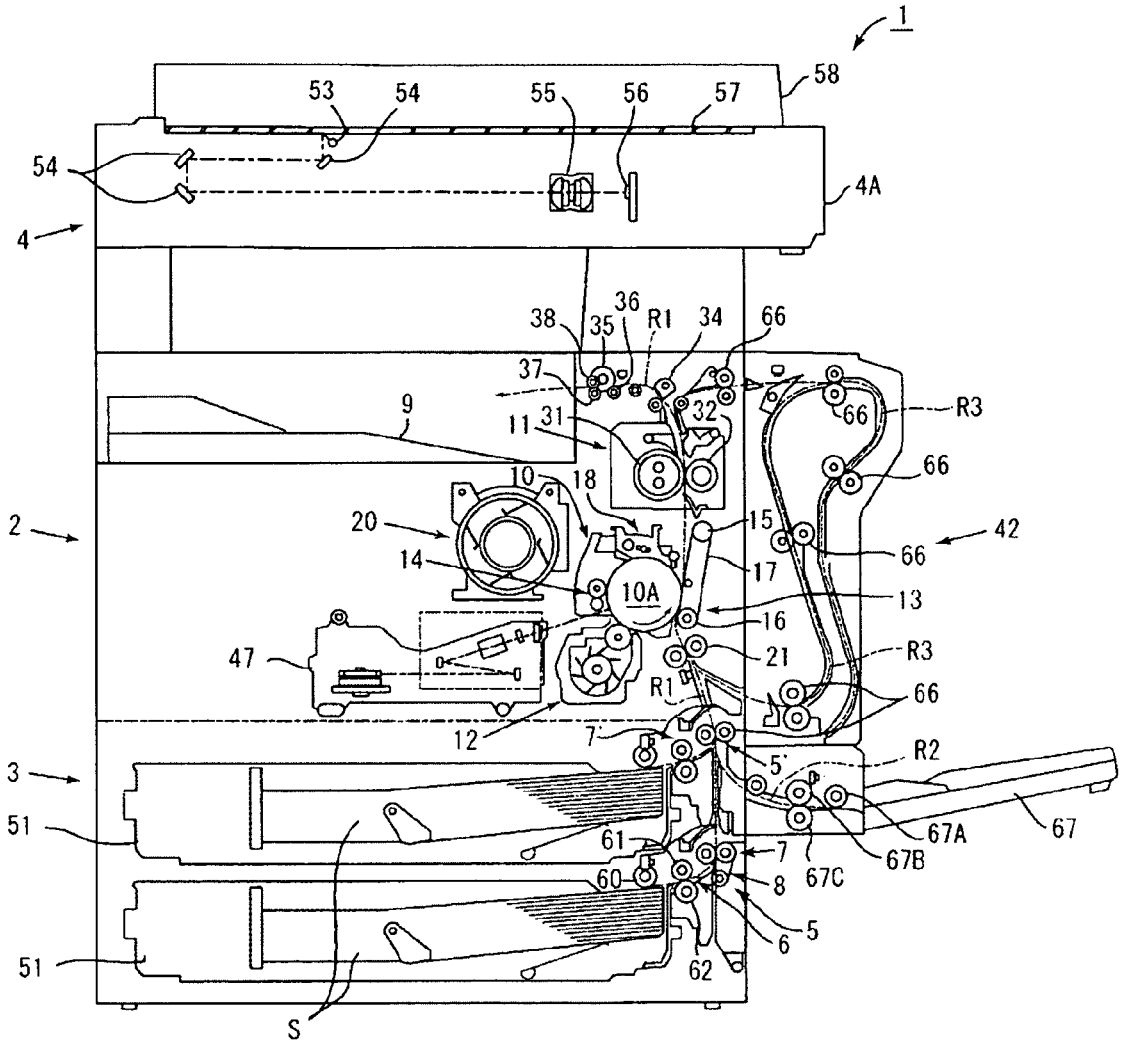
FIG. 1 is a schematic front view of an entire configuration of a paper conveying apparatus and an image forming apparatus according to a first embodiment of the present invention to which a sheet conveying apparatus and an image forming apparatus according to the present invention are applied.

Exemplary embodiments of the present invention are explained in detail below with reference to the accompanying drawings. Throughout the embodiments, modification examples, and an example, components, such as members and elements, having the same function, shape, and the like are provided with the same reference numerals, and are not explained again after once explained. For simplification of the drawings and description, components that should be represented in the drawings but not particularly need to be explained in the drawings may be omitted as appropriate without specifically noted. When components in patent gazettes and the like are directly referred to for description, the components are provided with reference numerals with parentheses, and are distinguished from those in the embodiments.

Figure 2:
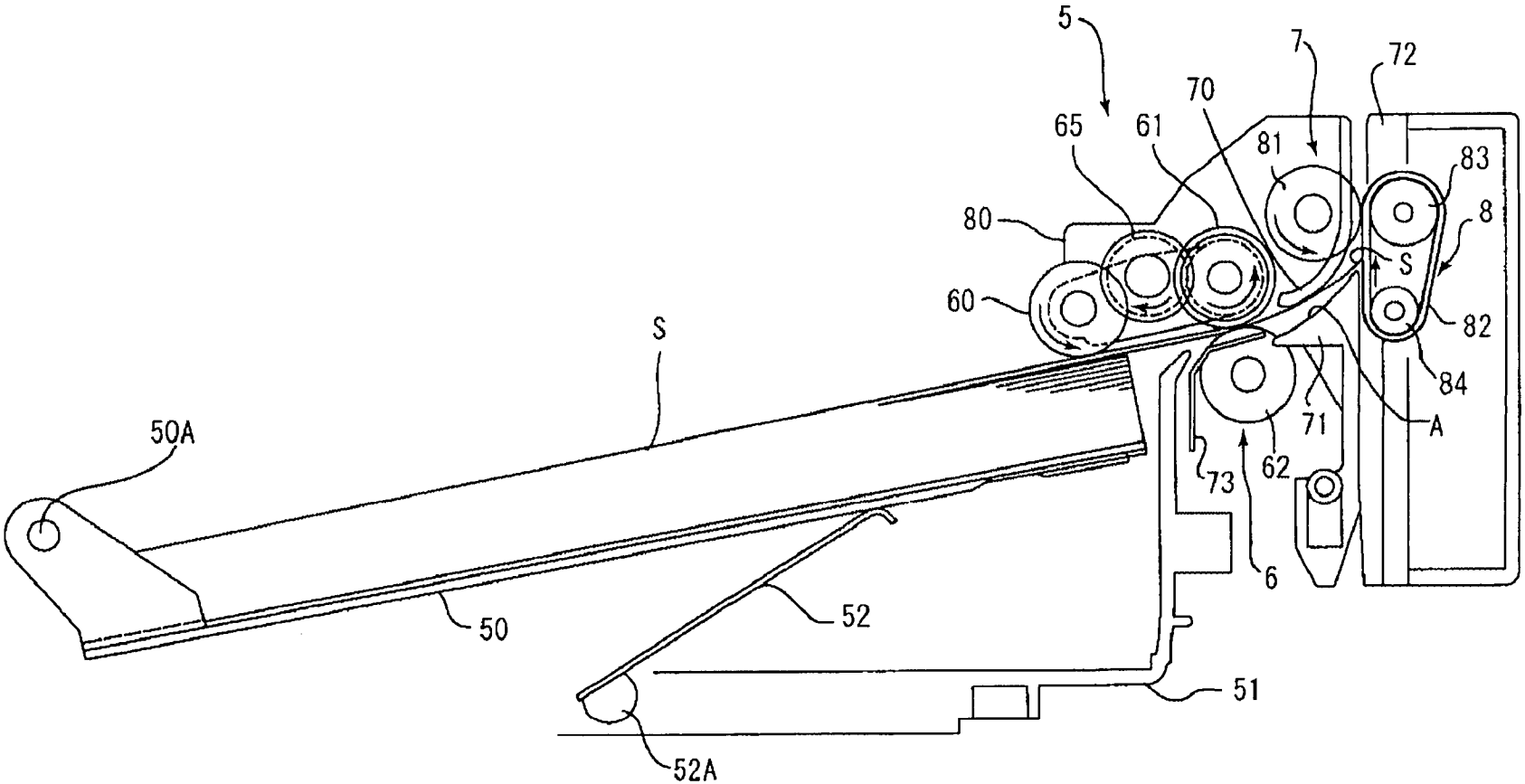
FIG. 2 is an enlarged section view of main parts of the paper conveying apparatus according to the first embodiment and its nearby paper feeding tray, the view depicting an operation state in which the tip of a paper reaches a belt conveyor unit.
Figure 3:
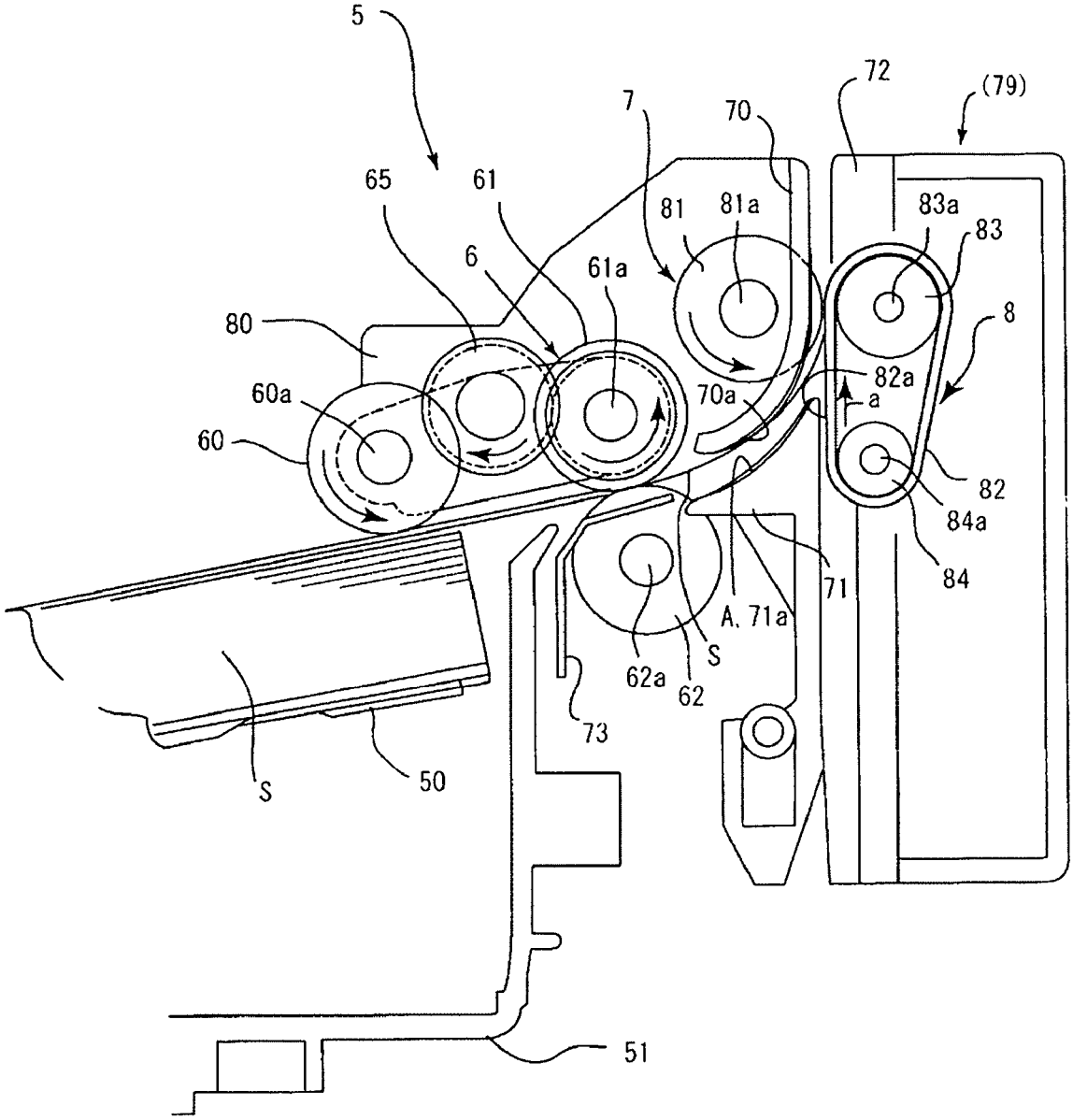
FIG. 3 is an enlarged section view of main parts of the paper conveying apparatus according to the first embodiment, the view depicting an operation state immediately before the tip of the paper reaches a nip portion of a second conveyor unit.

With reference to FIGS. 1 to 3, a first embodiment of the present invention is explained. FIG. 1 is a schematic front view of an entire configuration of an image forming apparatus including a paper conveying apparatus of the first embodiment according to the sheet conveying apparatus and the image forming apparatus including the same of the present invention. FIG. 2 is an enlarged view of a paper feeding device installed at a predetermined position in the image forming apparatus and a paper conveying apparatus that goes with a paper storage tray of the paper feeding device. FIG. 3 is an enlarged view mainly depicting the vicinity of the paper conveying apparatus.

With reference to FIG. 1, the entire configuration of a copier 1 as an example of the image forming apparatus is first explained. The copier 1 is a monochrome copier that reads an image from the surface of a document and forms a copy image on various sheet-like recording medium (hereinafter, "sheet"), such as a recording paper, a transfer sheet, a paper, and an overhead projector (OHP) film. The copier 1 includes a main body 2 having an image forming unit that performs a predetermined image forming process based on the read document image; a paper feeding device 3, on which the main body 2 is placed, to supply papers S, which are an example of sheets, one by one, to the main body 2; and a document reading device 4 mounted on the main body 2 to read the document image and send information about the document image to the main body 2.

A paper delivery tray 9 is placed at an upper portion of the main body 2 to form a space below the document reading device 4, delivering and loading a paper passing through the main body 2. Also, a paper conveying path R1 (hereinafter, "conveying path R1") is formed as a paper conveying path (a sheet conveying path) for the paper S to move from the paper feeding device 3 to the paper delivery tray 9. Most of the conveying path R1 extends from the paper feeding device 3 to the upper portion of the main body 2 in an upper direction approximately perpendicular to an approximately horizontal line, that is, in an approximately upper vertical direction. On the conveying path R1, paper conveying units are provided as several sheet conveying units formed of paired conveyor rollers, paired rollers, and others with a predetermined space being ensured for papers S of minimum size. Any of these paper conveying units is configured to always continue conveying the papers S on the conveying path R1 by nipping, for example. Furthermore, the paper feeding device 3 is provided with a paper conveying apparatus 5 as a sheet conveying apparatus that feeds and conveys the paper S accommodated in each tray of the paper feeding device 3 to the conveying path R1.

In the main body 2, from an upstream side to a downstream side of the conveying path R1, a photosensitive member unit 10 and a fixing unit 11 are sequentially disposed as an image forming unit that forms an image. After the photosensitive member unit 10 transfers its generated toner image on the paper S being conveyed on the conveying path R1 from the upstream side to the downstream side, the fixing unit 11 fixes the transferred tone image on the paper S. The paper S with the toner image fixed thereon is delivered to the paper delivery tray 9 disposed at the tail end of the conveying path R1.

The photosensitive member unit 10 has a single drum-like photosensitive member 10A as an image carrier, which is rotatably supported by a side plate not shown in the main body 2 about a rotation shaft disposed in an approximately horizontal manner. The photosensitive member 10A has a known configuration formed in a cylindrical shape with a predetermined diameter. To the photosensitive member 10A, a rotational driving force is transmitted from a driving source, such as a motor, provided either one of the photosensitive member unit 10 side and the main body 2 side, thereby rotatingly driving the photosensitive member 10A at a stable constant speed in a rotating direction represented by an arrow in the drawing.

The photosensitive member 10A is surrounded by, in the order of the rotating direction represented by the arrow in the drawing, a developing unit 12, a transfer unit 13, a photosensitive-member cleaning unit 18, a static eliminating unit, and a charging unit 14. Within a range of one rotation in the counterclockwise rotating direction of the photosensitive member 10A, a developing position, a transfer position, a cleaning position, a static eliminating position, and a charging position are sequentially set from its upstream to downstream by the units 12 to 14.

Furthermore, a latent-image forming position is set between the charging position and the developing unit. To irradiate the latent-image forming position with predetermined laser light to write an invisible latent image according to the image information, an exposing unit 47 is disposed diagonally downward to be slightly away from the photosensitive member unit 10. Also, with the photosensitive member 10A being rotatingly driven in a predetermined counterclockwise direction and with the units 12 to 14 and the exposing unit 47 performing cooperative operations in conjunction with one another in a predetermined manner in synchronization with the rotation of the photosensitive member 10A, a series of image forming processes is performed.

That is, the developing unit 12 has a known appropriate configuration with a developing roller for generating a toner brush that causes toner particles to stand from the surface in a radiating manner. The developing unit 12 applies toner particles at the tip of the toner brush to the latent image generated on a predetermined position on the surface of the photosensitive member 10A and moving on the perimeter in association with the rotation of the photosensitive member 10A and passing through the developing position. With this, the invisible latent image is visualized as a monochrome toner image.

The transfer unit 13 includes two supporting rollers 15 and 16 disposed to face each other with a predetermined space in an approximately vertical direction, and a transfer belt 17 composed of an endless belt stretching between the supporting rollers 15 and 16. The transfer unit 13 transfers a toner image on the surface of the outer perimeter of the photosensitive member 10A on the paper S, and conveys the paper S with the unfixed toner image transferred thereon to the downstream side of the conveying path R1. That is, the supporting roller 16 has a portion wound by the transfer belt 17, the portion being pressed against a portion of the photosensitive member 10A approximately diagonally downward to its right, and the transfer position is set at a portion at which the surface of the photosensitive member 10A and the transfer belt 17 make contact with each other. Also, the upper supporting roller 15 is disposed before a paper entrance of the fixing unit 11.

The photosensitive-member cleaning unit 18 has a configuration of any one or both of a blade member not shown and a rotating brush, the blade member being configured so that a blade edge at the tip abuts on the cleaning position on the photosensitive member 10A with a predetermined force being ensured, and the rotating brush being in contact with the cleaning position to rotate by following the rotation of the photosensitive member 10A. The photosensitive-member cleaning unit 18 removes residual toner or foreign substances on the surface of the photosensitive member 10A after transfer.

The static eliminating unit is mainly formed of a lamp capable of emitting light with a predetermined intensity. From this lamp, the static eliminating position is irradiated with light for static elimination, thereby clearing a charged state on the surface of the photosensitive member 10A passing through the static eliminating position and returning a surface potential of the photosensitive member 10A after passing through the transfer position to an initial state.

The fixing unit 11 has a heating roller 31 having incorporated therein an electric heater as a heating source, and a press roller 32 disposed in an approximately horizontal direction to face the heating roller 31 and pressed to the heating roller 31 side. When the heating roller 31 is rotatingly driven by a driving source not shown, such as a motor, the press roller 32 is driven to follow the driving. Also, at a portion where both of the rollers 31 and 32 make contact with each other, a nip portion for fixing the toner image on the paper is formed with a predetermined heating temperature and a predetermined pressing force being ensured.

Here, in the drawing, 20 denotes a toner accommodating container composed of, for example, a toner bottle having accommodated therein new toner. From the toner accommodating container 20 to the developing unit 12, a toner conveying path not shown is formed. When the toner inside the developing unit 12 is consumed for development and runs out, the developing unit 12 is refilled with new toner from the toner accommodating container 20.

Below the main body 2, the paper feeding device 3 is provided that can alternatively select a paper size (sheet size) automatically or by a manual setting by the user according to the size of document to be read. That is, the paper feeding device 3 is configured to have accommodated and disposed therein a plurality of paper feeding trays 51 as sheet accommodating units, each of the paper feeding trays 51 being able to be individually drawn to the outside of the paper feeding device 3. Each of the paper feeding trays 51 has refillably accommodated therein a set or an appropriate number of papers for that tray. Each of the paper feeding trays 51 has accommodated and loaded therein a plurality of papers S of a relevant paper size, that is, each different paper type (sheet type), in a portrait or landscape direction with respect to the paper conveying direction (sheet conveying direction).

The document reading device 4 has a reading device body 4A serving as a main frame. The reading device body 4A has disposed thereon a contact glass 57 extending over a predetermined area. The reading device body 4A has accommodated therein a reading unit that optically reads the document image by scanning a predetermined area on the surface of the contact glass 57. This reading unit mainly includes at least a first running body 53, a second running body 54, an imaging lens 55, and a reading sensor 56 composed of a charge-coupled device (CCD), for example.

Also, the document reading device 4 has placed on an upper surface of the reading device body 4A a document holding plate 58 configured to be able to open at an opening position for opening the contact glass 57 and to close at a closing position for covering the contact glass 57. That is, the document holding plate 58 is formed with height and width dimensions larger than those of the contact glass 57, and is supported at one end by a hinge not shown to be able to open and close on the upper surface of the reading device body 4A.

Based on the above configuration, the operation of the copier 1 is explained. First, when a document is copied by the copier 1, the user manually opens the document holding plate 58 of the document reading device 4 from the closing position to the opening position to set the document on the contact glass 57, and then manually operates the document holding plate 58 to a direction of closing it. With this document holding plate 58, the document set on the contact glass 57 is pressed from the above. With this operation, the document surface can be accurately read, with the document being flatly unfolded closely in contact with the contact glass 57 and being fixed onto the glass 57.

Then, when the user presses a start switch provided on an operation screen unit (not shown) provided in advance to the copier 1 for turning ON, a reading operation of the document reading device 4 is immediately started. With this start, a driving mechanism not shown causes the first running body 53 and the second running body 54 to run. Then, the document is irradiated with light from a light source of the first running body 53, and reflected light from the document surface is directed to the second running body 54. The reflected light is reflected by a mirror of the second running body 54 to be input via the imaging lens 55 to the reading sensor 56. As a result, the image and others on the document are read by being subjected to photoelectric conversion by the reading sensor 56.

Also, when the start switch is turned ON as mentioned above, the photosensitive member 10A of the photosensitive member unit 10 starts to rotate, thereby staring an operation of forming a toner image on the photosensitive member 10A based on the read document image. That is, with the rotation of the photosensitive member 10A, a predetermined portion on the outer perimeter surface of the photosensitive member 10A passes through the respectively-set positions of the charging unit 14, the exposing unit 47, the developing unit 12, the transfer unit 13, the photosensitive-member cleaning unit 18, and then the static eliminating unit. With this, the predetermined portion is changed in a predetermined charged state, a latent image is formed, the latent image is visualized as a toner image, the toner image is transferred to the paper S, and then residual toner is removed and the charged state is cleared to complete one cycle. According to an image size to be formed, the cycle is maintained in a predetermined manner so that a toner image is formed in an area with a predetermined length on the outer perimeter surface of the photosensitive member 10A in the rotating direction.

By pressing the start switch as mentioned above, from the paper feeding tray 51 having accommodated therein the papers S automatically or manually selected in the paper feeding device 3, one paper S is conveyed via a predetermined paper conveying path (sheet conveying path) to the conveying path R1, with the operation of the paper conveying apparatus 5 provided to the paper feeding tray. This paper S is conveyed by conveyor rollers or the like on the conveying path R1 in the main body 2 toward an approximately upward vertical direction, and the tip of the paper S then collides with paired resist rollers 21 for temporary stop.

On the other hand, in the case of manual paper feeding, the paper S set on a manual paper feeding tray 67 is reeled out with the rotation of a paper feeding roller 67A for the manual paper feeding tray. When a plurality of papers S are set and loaded, one sheet is separated by a sheet separating rollers 67B and 67C for the manual paper feeding tray to be conveyed to a manual paper feeding path R2, and is then further conveyed from the manual paper feeding path R2 to the conveying path R1. Then, the tip of the paper S collides with the paired resist rollers 21 for temporary stop.

The paired resist rollers 21 start rotating at an accurate timing that matches with a relative movement of the toner image on the rotatingly-driven photosensitive member 10A to send the temporarily-stopped paper S to the transfer position. As a result, the toner image is transferred onto the paper S by the transfer unit 13.

The paper S with the unfixed monochrome toner image transferred thereon is then conveyed by the transfer belt 17 of the transfer unit 13 forming part of the conveying path R1 to the fixing unit 11 to pass through the nip portion formed by the fixing unit 11. With this nip portion applying predetermined heat and pressure, the image is fixed onto the paper S. The paper S with the image fixed thereon is guided by a switching nail 34 toward the conveying path R1 to the paper delivery tray 9, is delivered by delivery rollers 35 to 38 onto the paper delivery tray 9, and is stacked on the paper delivery tray 9. Thus, the user can pick the paper stacked on the paper delivery tray 9 from an opening portion between the paper delivery tray 9 and the document reading device 4 at the front side of the apparatus.

Also, when a both-side copy mode is selected by a user's setting input, the paper S with the image fixed on its one side is conveyed to a paper reversing unit 42 by the switching nail 34. After the paper surface is turned upside down through a back-and-forth movement on a reverse conveying path R3 by a plurality of rollers 66 in pair disposed in the paper reversing unit 42 and a guide member not shown, the paper S is returned to the conveying path R1 from a position before the photosensitive member unit 10 via the paired resist rollers 21. The paper S is then conveyed on the conveying path R1 and is guided again to the transfer position. This time, an image is transferred and fixed on to the back of the paper S, and then the paper S is eventually delivered by the delivery rollers 35 to 38 onto the paper delivery tray 9.

Next, a characteristic configuration of the paper conveying apparatus 5 according to the first embodiment is explained.

As depicted in FIGS. 2 and 3, the paper conveying apparatus 5 draws one paper S from many papers S stacked and accommodated in the paper feeding tray 51 of a predetermined stage (in this example, a lower stage) in the paper feeding device 3 shown in FIG. 1, and changes the paper conveying direction (sheet conveying direction) of the drawn paper S for feeding to the main body 2 in an approximately upward vertical direction.

The paper conveying apparatus 5 includes a first conveying unit 6 that conveys the paper S and a second conveying unit 7 that is disposed on a downstream side of a paper conveying direction of the first conveying unit 6 and conveys the paper S conveyed by the first conveying unit 6 in a paper conveying direction different from the paper conveying direction of the first conveying unit 6, with each of the first conveying unit 6 and the second conveying unit 7 being configured as a nip conveying unit that nips the paper S for conveyance with a pair of conveyance rotating members. That is, the first conveying unit 6 has a configuration of first paired rotational conveying members composed of two rotational conveying members, that is, a feed roller 61 and a reverse roller 62, disposed to face each other. The second conveying unit 7 has a configuration of second paired rotational conveying members composed of two rotational conveying members, that is, a grip roller 81 and a conveyor belt 82 stretching between a roller-shaped pulley 83 and another roller-shaped pulley 84. One of the second paired rotational conveying members is a belt conveying unit 8 (guiding unit) including the conveyor belt 82 in contact with the paper shape S. Also, there is a feature in which a conveying surface 82*a*, which is a belt running surface formed on the conveyor belt 82 in the belt conveying unit 8, is disposed at a position displaced in an outer-area direction of a first conveying path A as a paper conveying path (sheet conveying path) formed between the first conveying unit 6 and the second conveying unit 7.

As mentioned above, the paper conveying direction of the first paired rotational conveying members composed of the feed roller 61 and the reverse roller 62 is different from the paper conveying direction of the second paired rotational conveying members composed of the grip roller 81 and the conveyor belt 82. That is, the paper conveying direction of the first paired rotational conveying members is set in an approximately horizontal direction, which is a direction diagonally upward to its right in FIGS. 2 and 3, whilst the paper conveying direction of the second paired rotational conveying members is set in an approximately vertical direction. With this, the first conveying path A formed between the first conveying unit 6 and the second conveying unit 7 forms a curved curvature portion with a small radius of curvature for abruptly changing the paper conveying direction in the first conveying path A.

Here, the paper conveying direction of each of the first conveying unit 6 and the second conveying unit 7 is strictly represented as follows. That is, in FIG. 4, the paper conveying direction of the first conveying unit 6 is set in an approximately horizontal direction orthogonal to the center of the nip portion on a line segment connecting three points, that is, the rotation center of the feed roller 61, the rotation center of the reverse roller 62, and the center of the nip portion between the feed roller 61 and the reverse roller 62.

Similarly, the paper conveying direction of the second conveying unit 7 is set in an approximately vertical direction orthogonal to the center of the nip portion on a line segment connecting three points, that is, the rotation center of the grip roller 81, the rotation center of the pulley 83, and the center of the nip portion between the grip roller 81 and the conveyor belt 82.

In other words, in a paper conveying path formed between the first conveying unit 6 and the second conveying unit 7 and configured to change the paper conveying direction, of paired facing surfaces that form the paper conveying path and define the orientation in the thickness direction of the paper S to be conveyed, one surface on which the tip of the paper S fed from the first conveying unit 6 abuts is configured as a conveyance guide plane for successively and always moving within a predetermined area in a direction of approaching the nip portion of the second conveying unit 7, the predetermined area being from a portion on which the tip of the paper S abuts as a starting end to the second conveying unit 7 across a longitudinal direction of the paper conveying direction. This conveyance guide plane is formed by a belt running surface (conveying surface) formed on the conveyor belt 82 in the belt conveying unit 8. Also, an area surrounded by an extended line along the paper conveying direction of the first conveying unit 6 and an extended line along the paper conveying direction of the second conveying unit 7 is taken as an inner area, whilst the other area is taken as an outer area. The conveying surface 82*a* of the conveyor belt 82 for paper conveyance formed by the flat belt running surface is disposed at a position displaced from the inner area to an outer-area direction, and extends to approximately cross the paper advancing direction.

Figure 4:
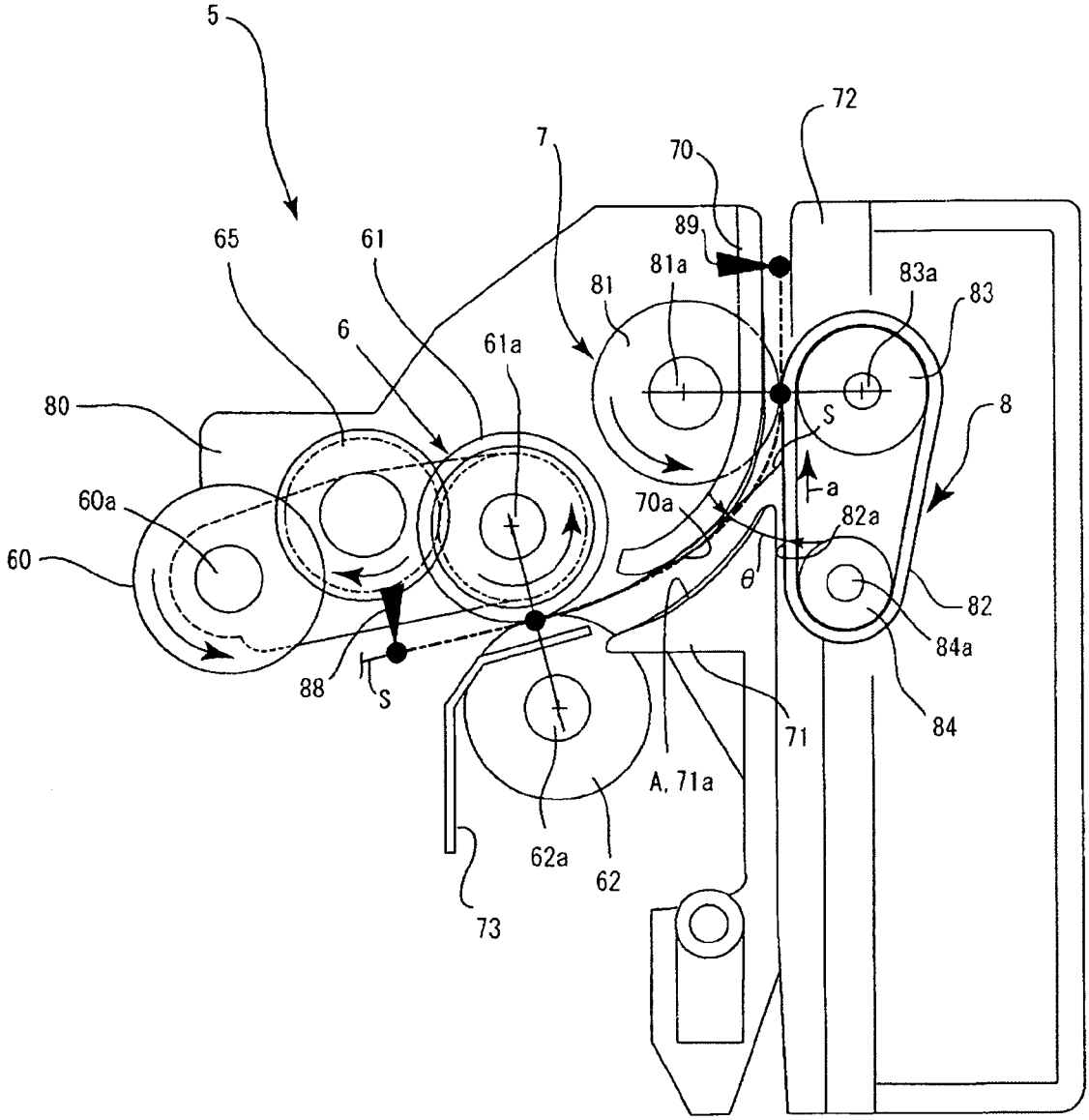
FIG. 4 is an enlarged section view of main parts of the paper conveying apparatus according to the first embodiment and a first example.

The belt conveying unit 8 mainly includes, as shown in FIGS. 3 and 4, the conveyor belt 82 and the roller-shaped pulley 83 and the roller-shaped puller 84 mentioned above as paired belt-holding rotational members that hold the conveyor belt 82 to allow the conveyor belt 82 to run.

It is important to dispose the belt conveying unit 8 so that the tip of the paper S conveyed by the first conveying unit 6 abuts on (makes contact with) the conveying surface 82*a* of the conveyor belt 82 other than portions of the conveying surface 82*a* held by the pulleys 83 and 84. As such, the belt conveying unit 8 is disposed so that the shaft center of the pulley 84 (center of a pulley shaft 84*a*) is positioned above the lower end position of the reverse roller 62 and below the height of the downstream end of a conveyance guide member 71. With this, the tip of the paper S collides with a flat portion (so-called an "effective conveying plane") of the conveyor belt 82, thereby achieving a stable and moderate elastic displacement and deformation state of the conveyor belt 82. Without inviting a repulsion of the tip of the paper S, the state in which the tip of the paper S reliably abuts on the conveying surface 82*a* of the conveyor belt 82 is maintained, thereby obtaining operation effects, which will be explained further below.

On the other hand, if the tip of the paper S is disposed so as to be allowed to abut on (make contact with) the portions of the conveyor belt 82 held by the pulleys 83 and 84 of the conveyor belt 82 are generally harder than the flat portion of the conveyor belt 82 and in a state of a small elastic displacement and deformation. Therefore, when the tip of the paper S abuts on these portions, a repulsion may occur and a state of a moderate elastic displacement or deformation may not be stably obtained. Such situation is not preferable, and the same goes to the examples and embodiments explained further below.

Also, as shown in FIG. 4, it is important to dispose the belt conveying unit 8 so that the tip of the paper S conveyed by the first conveying unit 6 enters at an acute entering angle θ with respect to the conveying surface 82*a* of the conveyor belt 82. With the belt conveying unit 8 disposed in the manner as mentioned above, the tip of the paper S can stably abut on the flat portion of the conveyor belt 82 mentioned above, thereby maintaining the state in which the tip of the paper S reliably abut on the conveying surface 82*a* of the conveyor belt 82 and achieving operation effects, which will be explained further below.

When the tip of the paper S enters approximately vertically or at a right entering angle θ with respect to the conveying surface 82*a* of the conveyor belt 82, the state in which the tip of the paper S abuts on the conveying surface 82*a* of the conveyor belt 82 becomes unstable. For example, the paper may be bent in a direction reverse to the running direction of the conveyor belt 82, or a repulsion may be invited. Such situation is not preferable, and the same goes to the examples and embodiments explained further below.

The paper feeding tray 51 at each stage in the paper feeding device 3 is formed in an approximately flat box shape with an opening on top so as to ensure a flat shape that can store papers S of a maximum size considered as usable by the copier 1. The paper feeding tray 51 is provided on its bottom surface with a bottom plate 50 as a sheet stacking unit. The bottom plate 50 has a base end at left in FIG. 2 fixedly mounted to a horizontal shaft 50A rotatably supported within a predetermined angle range, that is, in a rocking manner, with respect to the paper feeding tray 51, and also has a free end at right in FIG. 2 that can rock about the shaft 50A within the paper feeding tray 51.

Furthermore, the paper feeding tray 51 has formed at its bottom a concave portion in a predetermined shape. In this concave portion, a raising arm 52 is stored. The raising arm 52 has a base end fixedly mounted to a horizontal shaft 52A rotatably supported within a predetermined angle range, that is, in a rocking manner, within the concave portion. Also, a rotational driving force in an arbitrary direction from a rotational driving source not shown is transmitted to the horizontal shaft 52A for rotation, thereby driving the raising arm 52 in a rocking manner to occupy a predetermined tilted position about the horizontal shaft 52A. With this, a free end of the raising arm 52 pushes up the bottom plate 50 to keep the edge on one side of the paper S on top placed on the bottom plate 50 at a predetermined height position.

As mentioned above, the paper feeding tray 51 has stacked and stored on the bottom plate 50 the papers S, and causes the free end at the right end side of the bottom plate 50 in the drawing to be raised and tilted to raise the paper S. Even if the number of stacked papers S is decreased by feeding the papers one by one, the top surface is kept at the predetermined height.

The paper feeding tray 51 is configured to be removable from and insertable into the body of the paper feeding device 3, as mentioned above. That is, the paper feeding tray 51 is configured to be able to selectively occupy a mounting position allowing paper feeding when the paper feeding tray 51 is inserted in and mounted on the paper feeding device 3 as shown in FIG. 1 and a removing position allowing refill of the papers S and size change of the papers S when the paper feeding tray 51 is drawn toward the front in FIG. 1 and removed from the body of the paper feeding device 3.

Also, the first conveying unit 6, the second conveying unit 7, and the paper conveying unit (conveying path) disposed between the first conveying unit 6, the second conveying unit 7 are left in the body when the paper feeding tray 51 is drawn. Therefore, although the image forming apparatus is of internal paper delivery type according to the present embodiment, by providing a guiding unit, the paper can be conveyed through the conveying path with a curvature equal to or smaller than the conventional curvature. Thus, without increasing the width direction of the apparatus, advantages of the internal paper delivery type can be prevented from being lost.

A pickup roller 60 is rotatably and axially supported in a housing 80 forming an outer shape of the body of the paper feeding device 3 so as to make contact with the paper S on top raised to a predetermine height. On an extended line along a direction of drawing the paper S by the pickup roller 60, a sheet separating mechanism that separates one paper S for feeding is positioned. The sheet separating mechanism is configured to form a nip portion where the feed roller 61 and the reverse roller 62 make contact with each other with a predetermined pressure being ensured.

As shown in detail in FIG. 3, the pickup roller 60 is integrally fixed about a shaft 60*a* formed integrally with a core metal not shown to be freely rotated with the shaft 60*a*, or is supported so as to freely rotated with respect to the shaft 60*a* when non-driving, with a one-way clutch (not shown) provided between the shaft 60*a* and the core metal. For an outer perimeter portion including an outer perimeter surface of the pickup roller 60, a soft high-friction material, such as a rubber with a high coefficient of friction with respect to the paper S, is used to allow the paper S in contact to be easily picked. Also, to increase a friction resistance, the sawtooth protrusions may be formed, as appropriate, around the entire outer perimeter surface of the pickup roller 60.

According to the present embodiments, as a paper feeding system (sheet feeding system) for separating one sheet from the stacked papers S for feeding without feeding two or more sheets, for example, a Feed Reverse Roller (FRR) paper feeding system is adopted, which is a return-and-separation system. That is, when two or more papers S are drawn by the pickup roller 60, one paper S in contact with the feed roller 61 is separated from the other papers S in contact with the reverse roller 62. Then, the feed roller 61 causes the single paper S to advance as it is in the paper conveying direction for feeding, whilst the reverse roller 62 returns the other papers to their original position in a direction reverse to the paper conveying direction. Also, the reverse roller 62 is configured not to prevent paper conveyance by the feed roller 61.

More specifically, the paper separating and feeding mechanism by the FRR paper feeding system as a sheet separating mechanism includes the feed roller 61 rotatingly driven in a forward direction in which a paper is conveyed, and the reverse roller 62 abutting on the lower side of the feed roller 61 and reversely-rotatingly driven with a rotational driving force in a reverse rotating direction transmitted via a torque limiter. The feed roller 61 abuts on the top of the paper S placed on the bottom plate 50, whilst the reverse roller 62 is in contact with the lower surface of any paper S, irrespectively of whether the number of papers is equal to or more than two, in contact with the feed roller 61.

The feed roller 61 is integrally fixed about a shaft 61*a* formed integrally with a core metal not shown to be freely rotated with the shaft 61*a*, or may be supported in a manner similar to that of the pickup roller 60. As with the pickup roller 60, or an outer perimeter portion including an outer perimeter surface of the feed roller 61, a soft high-friction material, such as a rubber with a high coefficient of friction with respect to the paper S, is used so as to allow the paper S in contact to be easily fed in the paper conveying direction. Also, to increase a friction resistance, the sawtooth protrusions may be formed, as appropriate, around the entire outer perimeter surface of the feed roller 61.

The reverse roller 62 is integrally formed with a core metal not shown, and is rotatably supported in the housing 80 via the torque limiter together with a reverse roller driving shaft 62*a*.

In the FRR paper feeding system, the reverse roller 62 is provided with low torque via a torque limiter (not shown) toward a direction reverse to that of the feed roller 61. Therefore, in a state where the reverse roller 62 is in contact with the feed roller 61 or in a state where one paper S enters between these rollers 61 and 62, the reverse roller 62 follows the rotation of the feed roller 61. That is, with the operation of the torque limiter, the reverse roller 62 slips with respect to the reverse roller driving shaft, and is rotated in a forward direction, that is, a paper feeding direction, similarly to the feed roller 61. On the other hand, in a state where the reverse roller 62 is away from the feed roller 61 or a in state where equal to or more than two papers S enter between the rollers 61 and 62, the reverse roller 62 is reversely rotated. Therefore, when equal to or more than two papers S enter, papers S in contact with the reverse roller 62 other than one paper S on top in contact with the feed roller 61 are returned to the upstream side of the paper conveying direction, thereby preventing two or more papers S from being fed.

Therefore, with a reverse conveying force sufficient to return the paper S to the original stacking position being ensured, the conveying force supplied from the reverse roller 62 to the paper S in contact therewith is set smaller by a predetermined amount than a conveying force supplied from the feed roller 61 to the paper S for advancing the paper S in the forward direction, without hindering paper conveyance by the feed roller 61 in the forward direction. Therefore, so to speak, the conveying force supplied from the feed roller 61 to the paper S is decreased by the reverse conveying force from the reverse roller 62.

In the drawing, 65 denotes an idler gear connected to a driving shaft that outputs a rotational driving force from the driving source provided on the body side of the paper feeding device 3. With gear engagement or belt gearing, the rotational driving force supplied from the paper feeding device 3 is transmitted to be distributed between the pickup roller 60 and the feed roller 61, thereby rotatingly driving the pickup roller 60 and the feed roller 61 at each predetermined speed.

Diagonally above the feed roller 61 is the grip roller 81, which is another rotational conveying member of the second paired rotational conveying members in the second conveying unit 7, disposed to be rotatably supported in the housing 80 via a rotational driving shaft 81*a* integrally formed with the grip roller 81.

Near the grip roller 81, the pulley 83 is disposed as being rotatably and axially supported in the housing 80 to make contact with the outer perimeter surface of the roller 81 via the conveyor belt 82 and facing the grip roller 81 in a horizontal direction.

The pulley 83 is integrally formed with the pulley shaft 83*a* and is rotatably supported in the housing 80 with the pulley shaft 83*a*. Diagonally below the pulley 83 to its left is the pulley 84 rotatably and axially supported in the housing 80. The pulley 84 is integrally formed with the pulley shaft 84*a* and is rotatably supported in the housing 80 with the pulley shaft 84*a*. The pulleys 83 and 84 function as a belt holding rotating member that runs and rotatably supports the conveyor belt 82.

Here, the placement of the belt conveying unit 8 is not restricted to the placement state explained above, and may be as follows. That is, in FIG. 3, 79 with parentheses represents, as part of the paper conveying apparatus 5 body, an open-and-close guide configured to be freely open and close the housing 80. This open-and-close guide 79 is configured so that the conveyor belt 82 can attach and detach the grip roller 81 about a hinge fulcrum shaft (not shown) below the housing 80, so as to allow the user to easily solve paper clogging, jam, and others in the first conveying path A, a vertical conveying path extending in an approximately vertically upward direction, and other paths.

When such an open-and-close guide 79 is provided, the pulley 83 and the pulley 84 are rotatably supported on the open-and-close guide 79 together with each of the pulley shafts 83*a* and 84*a*.

As partly mentioned above, the conveyor belt 82 is an endless belt, and stretches between the pulleys 83 and 84. An inter-shaft distance between the pulleys 83 and 84 is set in advance to a predetermined distance. That is, the linear belt running surface (conveying surface 82*a*) of the conveyor belt 82 stretching by these pulleys 83 and 84 and being formed between the pulleys 83 and 84 is disposed at a position with which the tip of the paper S fed by the first conveying unit 6 always makes contact. As such, the outer perimeter surface of the conveyor belt 82 wound around the outer perimeter of the pulley 83 directly makes contact with the outer perimeter surface of the grip roller 81 with a predetermined pressure. At this contact portion, a nip portion is formed.

The conveyor belt 82 is formed of an elastic member, such as a rubber member, and has a surface having set thereto a predetermined coefficient of friction with respect to the paper S for use (sheet) by the material of the belt itself or by being subjected to an appropriate surface treatment. That is, the conveyor belt 82 has set thereto a predetermined coefficient of friction so as to prevent a sliding contact between a belt surface, which is as a conveying surface facing the paper S and making contact with the paper surface, and the paper surface and allow reliable transmission of a conveyance driving force from the belt surface to the paper surface.

Also, the conveyor belt 82 has a belt width in a paper width direction orthogonal to the paper conveying direction, the belt width being ensured to be approximately equal to a paper width of a maximum size to be conveyed. That is, as the belt width of the conveyor belt 82, at least a belt width equal to or larger than the paper width of the maximum size to be conveyed is set and ensured. Similarly, the pulleys 83 and 84 between which the conveyor belt 82 stretches and the grip roller 81 facing and making contact with the belt each has a pulley or roller length in a paper width direction (axially longitudinal direction) formed to be equal to or longer than the belt width. Therefore, the paper S sent from the first conveying unit 6 always make contact with the conveyor belt 82 over its entire paper width, thereby ensuring the largest possible contact area between the paper and the conveyor belt. Accordingly, a driving force supplied to the paper S from the conveyor belt 82 moved in a paper conveying direction, that is, a conveyance driving force for advancing the paper S in its conveying direction, can also be transmitted from the conveyor belt 82 to the paper S also as the largest possible force.

As will be explained with reference to FIGS. 21 and 22, the rotational driving shaft 81*a* of the grip roller 81 has connected thereto a rotational driving source, such as an electric motor, dedicated for rotatingly driving the grip roller 81 via a driving force transmitting unit, such as a gear or belt. To the grip roller 81, a rotational driving force at a predetermined rotating speed is transmitted from the rotational driving source via the driving force transmitting unit and is rotatingly driven. With this, the grip roller 81 is taken as a driving roller. On the other hand, the conveyor belt 82 in contact with the grip roller 81 and the pulley 83 supporting the contact portion with the conveyor belt 82 from the inside of the belt are respectively taken as a follower belt driven forward and a follower roller rotationally driven by following the rotation of the grip roller 81 as a driving roller. As a matter of course, the pulley 84 is also a follower roller rotatingly driven via the follower belt.

Figure 21:
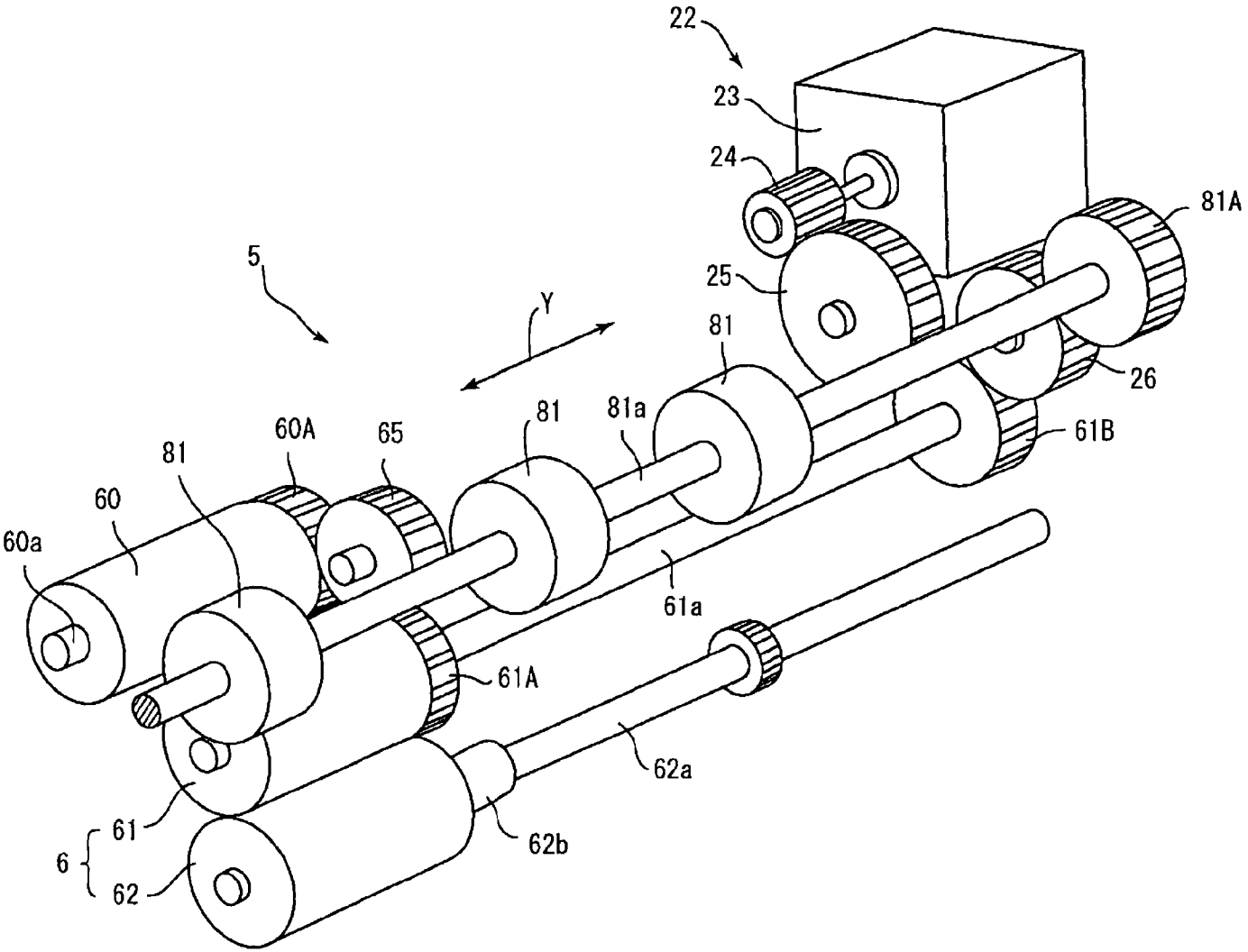
FIG. 21 is a simplified perspective view of a driving mechanism in the paper conveying apparatus according to the first embodiment.
Figure 22:
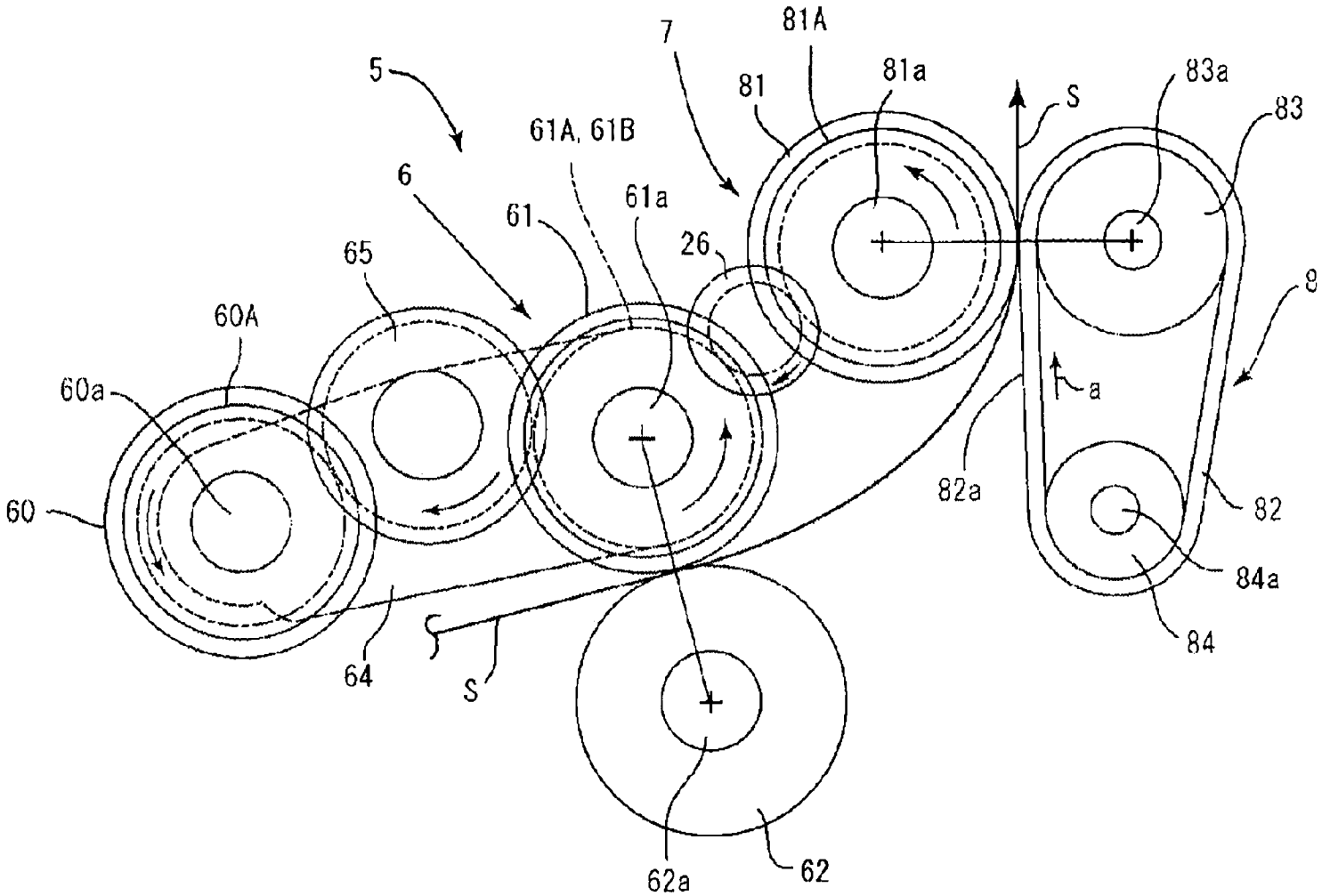
FIG. 22 is a schematic front view of main parts of FIG. 21.

As shown in FIGS. 21 and 22, a driving mechanism 22 mainly includes a paper feeding motor 23 composed of a stepping motor as a single driving source and driving unit, a motor gear 24 fixedly provided to an output shaft of the paper feeding motor 23, an idler gear 25 engaging with this motor gear 24, a feed-roller driving gear 61B engaging with the idler gear 25 and being fixed to one end of the shaft 61*a* of the feed roller 61, a idler gear 26 engaging with this feed-roller driving gear 61B, a grip-roller driving gear 81A engaging with this idler gear 26 and being fixed to one end of the rotational driving shaft 81*a* of the grip roller 81, a feed-roller gear 61A fixed to the other end of the shaft 61*a* near the feed roller 61, the idler gear 65 mentioned above engaging this feed-roller gear 61A, and a pickup-roller gear 60A engaging this idler gear 65 and being fixed to the other end of the shaft 60*a* of the pickup roller 60.

The paper feeding motor 23 is fixed to the housing 80. The idler gears 25, 26, and 65 are rotatably supported in the housing 80.

As explained above, according to the present embodiment, the paper conveying apparatus 5 is configured to be compact and space-saving. That is, as exemplified in a first example, which will be explained further below, for example, the first conveying path A includes a curvature portion with a relatively small radius of curvature. For this reason, a single paper feeding motor 23 is provided, and is shared between the first conveying unit 6 and the second conveying unit 7 as a driving unit, thereby contributing toward making the apparatus more compact.

Here, the reverse roller 62 is driven in another system provided with, for example, a solenoid for releasing pressure for the feed roller 61. In FIG. 21, 62*b* denotes a component explained as a torque limiter not shown in the example shown in FIGS. 1 to 4.

According to the exemplary embodiment shown in FIGS. 1 to 4, a rotational driving relation between the pickup roller 60 and the feed roller 61 has been briefly explained. In practice, as shown in an enlarged view of FIG. 22, the both rollers 60 and 61 have connected thereto the shafts 60*a* and 61*a*, respectively, by a pickup arm member 64. The rollers 60 and 61 are driven by the solenoid not shown or by combination of springs so that pickup rocking and displacement of the pickup roller 60 can be achieved via the pickup arm member 64 about the shaft 61*a* on the feed roller 61 side.

In the actual driving mechanism 22, driving-force transmitting members, such as more gears and timing belts, are disposed as appropriate between the paper feeding motor 23 and the feed roller 61. Here, for clarifying that the grip roller 81 is a rotational conveying and driving member, one example is briefly depicted in FIGS. 21 and 22.

Here, the conveyor belt 82 of the belt conveying unit 8 has the configuration of rotating directly in contact with the grip roller 81 (rotational conveying and driving unit, rotational conveying and driving member) rotatingly driven by the driving mechanism 22 so as to follow the rotation of the grip roller 81. Therefore, fluctuations in linear velocity of the conveyor belt 82 can be more decreased when the grip roller 81 side is driven rather than when the conveyor belt 82 side is driven. With this, by disposing the conveyor belt 82 rotating toward the nip portion of the second conveying unit 7, outside (outer-full direction) of the turn of the first conveying path A (paper conveying path), the conveying ability for papers with a relatively-high stiffness, such as cardboards, at a turn portion of the first conveying path A can be increased. Also, by driving the grip roller 81 facing and directly making contact with the conveyor belt 82 and rotating the conveyor belt 82 to follow the rotation of the grip roller 81, the paper can be conveyed at a stable linear velocity toward the second conveying unit 7 onward.

Such advantages and effects can be easily understood by considering the following technical subject. That is, when the grip roller 81 is driven, the linear velocity of the grip roller 81 is determined only by the outer diameter and the number of rotations of the grip roller 81 itself. By contrast, in the case of driving the conveyor belt 82 side, when the conveyor belt 82 is driven, the roller-shaped pulley 83 (belt driving roller, main pulley) provided inside of the conveyor belt 82 is generally used for driving the conveyor belt 82.

In this case, the linear velocity of the conveyor belt 82 is influenced by, in addition to the outer diameter and the number of rotations of the pulley 83 provided inside of the conveyor belt 82, fluctuations in thickness of the conveyor belt 82 due to component fluctuations, the thickness of the conveyor belt 82 due to abrasion, or a slip between the conveyor belt 82 and the pulley 83. Therefore, fluctuations in linear velocity of the conveyor belt 82 can be more decreased when the grip roller 81 side is driven rather than when the conveyor belt 82 side is driven.

Here, if the effects explained above are not so desired, for example, the driving system of the grip roller 81 may be removed from the driving mechanism 22, and the grip roller 81 side may be taken as a follower side. Also, the conveyor belt 82 side may be driven by a driving mechanism not shown.

In FIGS. 2 and 3, 70 denotes a conveyance guide member provided at a position on the inner-area side in the paper conveying apparatus 5, with a curved and fixed guide surface 70*a* extending approximately downward in a convex shape to make contact with the paper S. Reference numeral 71 denotes the conveyance guide member at a position on the outer-area side in the paper conveying apparatus 5. This conveyance guide member 71 has a curved and fixed guide surface 71*a* in a concave shape corresponding to the conveyance guide member 70, the guide surface 71*a* being disposed so as to face the guide surface 70*a* of the conveyance guide member 70 with a predetermined space. As such, with the conveyance guide member 70, the conveyance guide member 71 facing the conveyance guide member 70, and the conveyor belt 82, the first conveying path A is formed between the first conveying unit 6 and the second conveying unit 7.

In FIGS. 2 and 3, 72 denotes a conveyance guide member provided at a position on the outer-area side in the vertical conveying path from the second conveying unit 7 as a starting point toward an approximately vertically upward direction. 73 denotes a conveyance guide member forming a paper conveying path from the paper feeding tray 51 to the nip portion between the feed roller 61 and the reverse roller 62 and forming on the nip portion a paper entrance for guiding and allowing the entrance of the paper S. Also, the conveyance guide member 70 is provided with the curved surface (guide surface 70*a*) extending approximately downward (on the conveyance guide member 71 side provided in the outer area) across a line connecting the nip portions of the first conveying unit 6 and the second conveying unit 7. The degree of extension is set to cause the tip of the paper S to always reach the belt conveying surface, that is, such a degree that the paper S is mildly bent.

Here, in FIG. 1, the device configuration of the upper stage in the paper feeding device 3 is similar to the conventional device configuration, and is different from the device configuration of the lower stage only in that the paper conveying apparatus 5 is replaced by a paper conveying apparatus 5'. The paper conveying apparatus 5' is different from the paper conveying apparatus 5 only in that the second conveying unit 7 is replaced by a second conveying unit 7'. The second conveying unit 7' is different from the second conveying unit 7 only in that it includes the grip roller 81 and a roller (which is substantially identical in size and shape to the pulley 83) rolling by following the rotation of the grip roller 81, as the second paired rotational conveying members. In the paper feeding tray 51 of the upper stage and the paper conveying apparatus 5', papers (sheets) S with a relatively high stiffness, such as cardboards and envelops, are not used, but ordinary papers (sheets) S, for example, with a relatively low stiffness are used.

Next, a paper feeding operation from a predetermined stage in the paper feeding device 3 and the conveying operation of the paper conveying apparatus 5 started in conjunction with the paper feeding operation are explained.

As shown in FIG. 2, the paper S stacked on the bottom plate 50 is raised by the rocking and raising operation of the raising arm 52 so that the top surface has a predetermined height. First, the paper S on top is drawn by the rotation of the pickup roller 60, and is then conveyed to the sheet feeding and separating mechanism composed of the feed roller 61 and the reverse roller 62. Then, in the sheet feeding and separating mechanism, with the cooperative operation of the feed roller 61 and the reverse roller 62, only one sheet on top is separated. This separated one paper S is further conveyed to the downstream side in the paper conveying path. Then, as shown in FIG. 2, with the tip of the paper S in contact with the belt conveyor surface of the conveyor belt 82, the paper S is moved and guided by the running of the conveyor belt 82 in an arrow direction. When reaching the nip portion between the grip roller 81 and the conveyor belt 82, the paper S is nipped and conveyed by the grip roller 81 and the conveyor belt 82 and is further conveyed vertically upward. Eventually, the paper S is sent vertically upright.

In more detail, the tip of the paper S nipped by the nip portion between the feed roller 61 and the reverse roller 62 and sent from the nip portion first reaches and makes contact with the belt conveying surface of the conveyor belt 82, as shown in FIG. 2. Then, as shown in FIG. 3, according to the movement of the belt conveying surface in the paper conveying direction based on the running of the conveyor belt 82 in a direction represented by an arrow a, the paper S is gradually curved from its tip side. With the advancement of this curve, a contact area between the belt conveying surface and the paper surface is increased. Therefore, even if the paper S is a high-stiffness paper, a sufficient conveyance driving force for advancing the paper S can be given from the belt conveying surface to the paper surface. As such, the paper S is given a sufficient supplemental conveyance driving force from the belt conveying unit 8 in addition to a conveyance driving force from the first conveying unit 6 which would be insufficient due to a conveying resistance occurring at the time of conveying the high-stiffness paper S as being further deeply bent. Therefore, it is at least possible to prevent a faulty conveyance of the paper S between the first conveying unit 6 and the second conveying unit 7 and allows the tip of the paper S to reach the nip portion of the second conveying unit 7.

On the other hand, the conveying surface 82*a* of the conveyor belt 82 successively extends to the nip portion of the second conveying unit 7. Therefore, the tip of the paper S in contact with the belt conveying surface can reliably, stably, and smoothly reach the nip portion. In other words, firstly, even the high-stiffness paper S is conveyed by the first conveying unit 6 while being mildly bent to a degree that its tip always makes contact with the belt conveying surface. After the tip of the paper S makes contact with the belt conveying surface, with an active conveyance guide operation by the belt conveying surface, a so-called second conveying force for advancement in the paper conveying direction is obtained from the belt conveying surface to the paper S. Then, the paper S is further deeply bent so that the tip of the paper S reaches the nip portion of the second conveying unit 7.

In this manner, after the tip of the paper S reaches the second conveying unit 7 and the paper S is nipped and conveyed by the first conveying unit 6 and the second conveying unit 7, a sufficient conveying force is acted on the paper S from the first conveying unit 6 and the second conveying unit 7, thereby continuing smooth conveyance of the high-stiffness paper S. Furthermore, even when the rear end of the paper S is away from the first conveying unit 6 and can no longer obtain a conveying force from the first conveying unit 6, a conveyance driving force is supplied again from the belt conveying surface to the paper surface, depending on the contact state of the belt conveying surface on the paper S from the nip portion of the second conveying unit 7 to the rear end side. Furthermore, the degree of curvature of the paper S is mitigated. Therefore, paper conveyance can be continued. As a result, in the paper conveying apparatus 5, the paper S received by the first conveying unit 6 can be reliably and stably sent to the paper conveying path on the downstream side from the second conveying unit 7, irrespectively of the stiffness of the paper S.

As explained above, the belt conveying unit 8 is disposed in an outer-area direction of the first conveying path A formed between the first conveying unit 6 and the second conveying unit 7, and functions as a guiding unit that moves and guides the paper S toward the second conveying unit 7 while keeping the state of being in contact with the tip of the paper S.

According to the present embodiment, the belt conveying unit 8 as the guiding unit also has a function of moving and guiding the paper S with the conveying direction being changed by the conveyor belt 82 to a direction toward the nip portion of the second conveying unit 7.

FIRST EXAMPLE

A comparison test was performed regarding a paper feeding and conveying state (paper passing state) by using a copier with its basic configuration and specifications being the same as those of the paper feeding device 3 of the paper conveying apparatus 5 shown in FIGS. 1 to 3 and with only a paper feeding device of "imagio Neo 453" manufactured by Ricoh Co., Ltd. being modified for test (the system of this copier is represented as a "belt system" in Table 1) and a copier of "imagio Neo 453" manufactured by Ricoh Co., Ltd. having incorporated therein a paper feeding device including a conventional paper feeding device (in FIGS. 1 to 3, the device is such that the rotational conveying member facing and making contact with the grip roller 81 is the roller-shaped pulley 83 and the conveyor belt 82 and the roller-shaped pulley 84 are removed, and corresponds to a conventional paper conveying apparatus 5' shown in the paper feeding device 3 in FIG. 1) (the system of this copier is represented as a "conventional system" in Table 1).

In the belt system mentioned above, details of the belt conveying unit 8 and its surrounding main members for use in the comparison test (including members of the conventional system) are as follows.

Material of the conveyor belt 82: ethylene-propylene dien monomer (rubber) (EPDM)

Hardness of the conveyor belt 82: Japanese Industrial Standards (JIS) A 40 degrees Coefficient of friction of the conveyor belt 82: 2.6 (with respect to a paper)

Thickness of the conveyor belt 82: 1.5 millimeters

Diameter of the pulley 83: 13 millimeters

Diameter of the pulley 84: 7 millimeters

Space between the pulleys 83 and 84: 13 millimeters (an inter-axial distance between pulley shafts 83*a* and 84*a*)

Extension ratio of the conveyor belt 82: 7%

Figure 5:
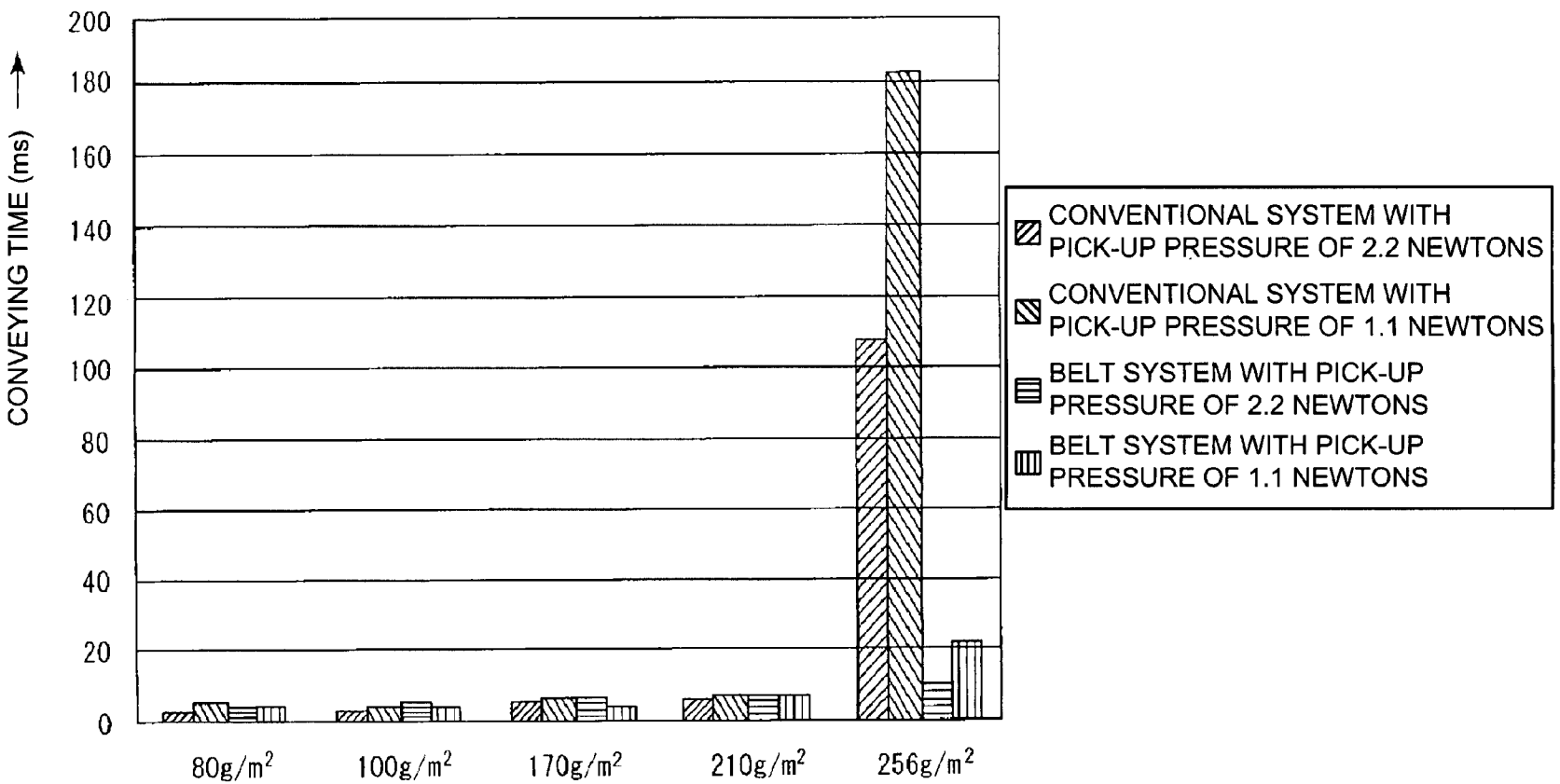
FIG. 5 is a graph for explaining test results regarding fluctuations in conveying time by paper type in the first example of the first embodiment.

Diameter of each of the rollers 60, 61, 62, and 81: 20 millimeters each As basic test conditions, a paper weight (grams per square meter basis weight) is used as an alternative value of the strength (stiffness) of the paper. Six paper types are used, and each type of paper goes through from a paper feeding tray of the same stage in each copier under a room-temperature environment (23 degrees Celsius, 50% relative humidity). Also, in consideration of the following test conditions explained below with reference to FIG. 4, a test for examining fluctuations in conveying time for each paper type was performed. The results of the test for examining fluctuations in conveying time are shown in FIG. 5, and the paper passing states based on the test results of FIG. 5 are shown in Table 1.

In FIG. 4, reference numeral 88 denotes a paper feeding sensor that detects the tip of the paper S picked up by the pickup roller 60. 89 denotes a vertical conveyance sensor that detects the tip of the paper conveyed from the second conveying unit 7 (in the belt system) or the pair of the grip roller 81 and the roller-shaped pulley 83 (in the conventional system). The paper feeding sensor 88 and the vertical conveyance sensor 89 are each composed of a reflective photosensor.

Also, a conveying path length between the disposed or mounted paper feeding sensor 88 and vertical conveyance sensor 89, that is, a paper conveying distance (sheet conveying distance), is set to a constant value of 57 millimeters in both of the belt system and the conventional system, as explained below. That is, a conveying path length from the disposed paper feeding sensor 88 to the nip portion between the feed roller 61 and the reverse roller 62 is 10 millimeters; a conveying path length from the nip portion between the feed roller 61 and the reverse roller 62 to the nip portion of the second conveying unit 7 (in the belt system), or a conveying path length from the nip portion between the feed roller 61 and the reverse roller 62 to the nip portion between the grip roller 81 and the roller-shaped pulley 83 (in the conventional system) is 38 millimeters each; a conveying path length from the nip portion of the second conveying unit 7 (in the belt system) to the disposed vertical conveyance sensor 89, or a conveying path length from the nip portion between the grip roller 81 and the roller-shaped pulley 83 (in the conventional system) to the disposed vertical conveyance sensor 89 is 9 millimeters; and the total conveying path length is 57 millimeters.

The radius of curvature at the center of the curved paper conveying path (first conveying path A) between the first conveying unit 6 and the second conveying unit 7 in the paper conveying apparatus 5 was set to a constant value of approximately 22 millimeters in both of the conventional system and the belt system for testing.

Also, in both of the conventional system and the belt system, a pickup pressure (paper feeding pressure) by the pickup roller 60 is taken as a parameter, and two types of pickup pressure are provided as 1.1 Newtons and 2.2 Newtons. Furthermore, the linear velocity of the feed roller 61 on the driving side and that of the grip roller 81 on the driving side are both set to the same constant value of 154 mm/s. A reaching time of the tip of the paper conveyed through the conveying path length of 57 millimeters from the paper feeding sensor 88 to the vertical conveyance sensor 89 was examined for five paper types. Results by measuring fluctuations in conveying time by paper type with an oscilloscope are shown in a graph of FIG. 5.

From the test results of FIG. 5, it was found that, for the paper type with equal to or more than 256 grams per square meter basis weight, the conveying time is long and the slip of the paper is large in the conventional system, whilst the conveying time is not so long and the slip of the paper is small in the belt system according to the present invention. It was also found that, although the conveying force is small when the pickup pressure is small, a small pickup pressure does not affect the conveying time much in the belt system according to the present invention. Therefore, when the belt system according to the present invention is adopted, a small pickup pressure can be achieved, thereby reducing power of the driving motor. As a result, the apparatus can be downsized.

Next, Table 1 that lists the paper passing states based on the test results of FIG. 5 is explained.

Here, a "square meter basis weight" means a weight in gram of one paper per square meter to represent the weight of paper and paperboards (papers). In general, a paper with a light basis weight can be said as a "light paper" or a "thin paper", whilst a paper with a heavy basis weight can be said as a "heavy paper" or a "thick paper".

In the test results of Table 1, "good paper passing" indicated by "GOOD" represents that the paper (sheet) reached the vertical conveyance sensor 89 within a predetermined time after the paper feeding sensor 88 had been turned on and then the tip of the paper had been detected, that is, good conveyance. On the other hand, "paper passing impossible" indicated by "BAD" represents that the paper did not reach the vertical conveyance sensor 89 within the predetermined time after the paper feeding sensor 88 had been turned on and then the tip of the paper had been detected, that is, faulty conveyance.

TABLE 1

| Weight per square meter | Conventional system | Belt system |
|---|---|---|
| 80 g/m$^2$ | ○ | ○ |
| 100 g/m$^2$ | ○ | ○ |
| 170 g/m$^2$ | ○ | ○ |
| 210 g/m$^2$ | ○ | ○ |
| 256 g/m$^2$ | x | ○ |
| 300 g/m$^2$ | x | ○ |

○: Good paper passing
x: Bad paper passing

From the test results shown in Table 1, it was found that, for the paper type with equal to or more than 256 grams per square meter basis weight, paper passing was impossible in the conventional system, whilst good paper passing was achieved for all cases in the belt system according to the present invention shown in FIGS. 1 to 3. With this, significant effects of the belt system according to the present invention were found.

From comparison and observation of paper passing and conveyance states, for the paper type with equal to or more than 256 grams per square meter basis weight, the paper has a large strength and difficult to bend along the curved paper conveying path in the conventional system. With reference to FIGS. 1 to 3 for explanation, it was found that the tip of the paper collides with the roller-shaped pulley 83 facing and making contact with the grip roller 81.

Also, a paper type with equal to or more than 256 grams per square meter basis weight with its surface subjected to coating and such a paper type without coating were used for comparison and observation of paper passing and conveyance states. However, no significant differences were observed other than the test results shown in Table 1.

The results of observing the course of paper conveyance in the first example have revealed the following. That is, when a high-stiffness paper with 256 grams per square meter basis weight or more is conveyed from the first conveying unit 6 via the first conveying path A to the conveying surface 82*a* of the conveyor belt 82 in the belt conveying unit 8, it was found that various guide members forming the first conveying path A can be modified to a simple shape so that the conveying load resistance is small, or all of such various guide members can be unnecessary.

Therefore, in the case of the paper conveying apparatus that conveys relatively-high-stiffness papers only, indispensable components are those described above that is, the first conveying unit 6, the second conveying unit 7, and the belt conveying unit 8 (guiding unit) disposed in the outer-area direction of the first conveying path A formed between the first conveying unit 6 and the second conveying unit 7 (in this case, no guide members are required), the belt conveying unit 8 moving and guiding the paper S toward the second conveying unit 7 while keeping the state of making contact with the tip of the paper S.

From the above, it can be said that various guide members forming the first conveying path A are required to introduce and guide a paper S with a relatively low stiffness, such as an ordinary paper or a paper S for PPC, to the conveying surface 82*a* of the conveyor belt by supplementing the weakness in straight-ahead movement of the low-stiffness paper S (compared with a straight-ahead movement of a paper S with a relatively high stiffness). In other words, as the stiffness of the paper S is lower, a decrease in straight-ahead movement is supplemented more. Also, to cause the tip of the paper S to reliably abut on the flat portion of the conveying surface 82*a* of the conveyor belt 82, the shape of the guide surface of each of various guide members forming the first conveying path A has to be set.

In other words, as a higher-stiffness paper S (a paper S with a heavier basis weight) is used, more flexibility can be achieved in designing, for example, the shape and placement, of each of various guide members used in configuring the paper conveying path with a curvature portion with a relatively small radius of curvature.

Here, the material of the conveyor belt 82 is not restricted to the one used in the comparison test. For example, chloroprene-rubber, urethane rubber, or silicon rubber may be used. Also, each rubber hardness of the conveyor belt 82 may be JIS A 40 to 60 degrees.

As explained above, according to the paper conveying apparatus 5 and the copier 1 having the paper conveying apparatus 5 shown in FIGS. 1 to 4, it is possible to provide a paper conveying apparatus and an image forming apparatus that are compact and space-saving with a simple device configuration at low cost and with an excellent supportability for paper types. That is, basically, the configuration is such that the existing roller forming the second conveying unit is wound by a conveyor belt to newly and additionally form the belt conveying unit 8. Furthermore, even a driving source dedicated to the belt conveying unit 8 is not required. With this, it is possible to achieve a paper conveying apparatus and an image forming apparatus with an extremely simple configuration and therefore at low cost.

In the conventional configuration, because of, for example, a large conveying resistance due to the contact of the paper with the conveyance guide member 70, or a conveying load or the like at the paper conveying path (conveying path) from the first conveying unit 6 to the second conveying unit 7, a high-stiffness paper type cannot be supported, thereby causing a faulty conveyance. By contrast, in the paper conveying apparatus 5, even such a high-stiffness paper type can be supported, and therefore the paper conveying apparatus is excellent in supportability for paper types. That is, the conventional configuration is such that a fixed member for guiding a paper is merely disposed, after all. Therefore, a difference in speed between the moving paper to be conveyed and the fixed guide member cannot be fundamentally resolved, and a conveying resistance always occurs. By contrast, according to the paper conveying apparatus 5 and the copier 1, such a conveying resistance can be almost completely eliminated. Furthermore, the paper can be guided with a conveying force being actively applied for advancing the paper downstream (alternatively, with the paper conveying force by the second conveying unit 7 being added to the paper conveying force (sheet conveying force) by the first conveying unit 6, it is possible to resist the conveying load in the conveying path from the first conveying unit 6 to the second conveying unit 7, thereby advancing the paper downstream). That is, in the paper conveying apparatus 5, the friction resistance occurring between the paper S and the conveyor belt 82 is not a resistance that hinders the conveyance of the paper S, but a so-called negative resistance for adding a conveying force to the paper S. In other words, the friction resistance is not a resistance that acts so as to hinder the conveyance of the paper S, but is converted to a preferable negative resistance acting so as to add a conveying force to the paper S.

Furthermore, in the conveying direction in which the paper S is conveyed for advancement, after the tip of the paper S abuts on the running surface (conveying surface) of the conveyor belt 82, with the advancement of the conveyance, the tip of the paper S gradually overlaps the running surface of the conveyor belt 82 for conveyance, although the degree of overlap varies depending on the stiffness of the paper type. Therefore, an area of the paper surface in contact with the belt running surface is gradually increased. For this reason, an increase in resistance between the conveyor belt 82 and the paper S can be achieved according to an increase in contact area. Thus, a larger conveying force for advancing the paper S in the conveying direction can be provided from the conveyor belt 82 to the paper S. Also, with the conveyor belt 82, the advancing direction of the paper S can be changed toward the nip portion between the grip roller 81 and the conveyor belt 82. That is, a force acting as a conveying force transmitted from the running surface (conveying surface) of the conveyor belt 82 to the paper surface can be steadily increased.

Therefore, even if the stiffness of the paper S is high, this stiffness can be overcome, and the paper S can be reliably and stably conveyed toward the nip portion of the second conveying unit on the downstream while the paper S is being deformed, that is, being bent, in the thickness direction, as appropriate. As such, main factors responsible for a faulty conveyance due to high stiffness of the paper S can be addressed. Therefore, paper conveyance even after the tip of the paper S reaches the nip portion of the second conveying unit can be reliably and stably continued. As a result, the paper conveying apparatus can support various paper types, thereby expanding conveyance supportability and achieving a high paper conveying ability.

Figure 6A:
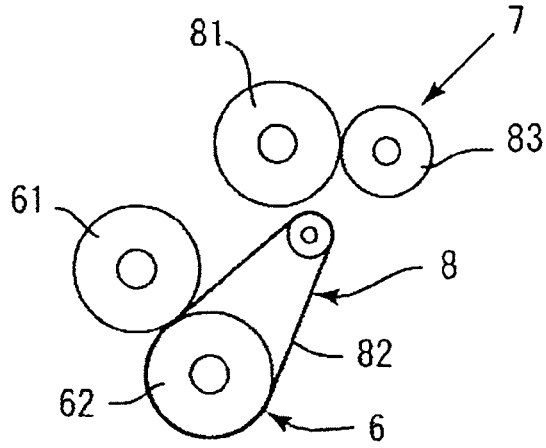
FIG. 6A is a drawing of a modification example of the paper conveying apparatus according to the first embodiment, the drawing depicting an example in which a belt conveyor unit is provided to a first conveying unit.
Figure 6B:
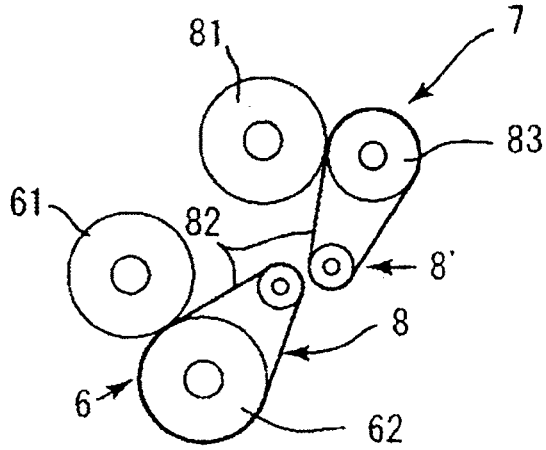
FIG. 6B is a drawing of a modification example of the paper conveying apparatus according to the first embodiment, the drawing depicting an example in which a belt conveyor unit is provided to each of the first conveying unit and the second conveying unit.
Figure 6C:
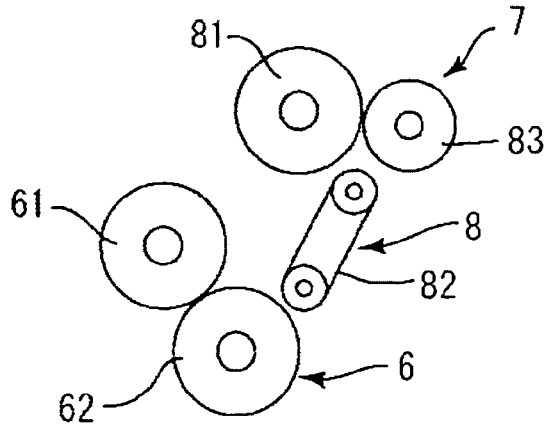
FIG. 6C is a drawing of a modification example of the paper conveying apparatus according to the first embodiment, the drawing depicting an example in which a belt conveyor unit is provided separately from the first conveying unit and the second conveying unit.

Modification examples of the first embodiment are depicted in FIGS. 6A to 6C.

As shown in FIG. 6A, one of the paired rollers facing and making contact with each other that is disposed on the upstream side of the first conveying unit 6 may be the belt conveying unit 8. Also, as shown in FIG. 6B, one of the paired rollers facing and making contact with each other in the first conveying unit 6 may be the belt conveying unit 8, and also one of the paired rollers facing and making contact with each other in the second conveying unit 7 may be a belt conveying unit 8'. Furthermore, as shown in FIG. 6C, as a guiding unit (moving guide) that replaces one of the paired rollers that is disposed on the upstream side of the first conveying unit 6 and one of the paired rollers that is disposed on the downstream side of the second conveying unit 7, a separate and independent belt conveying unit 8 may be provided between these two pairs of rollers.

In the belt conveying unit 8 in the modification examples shown on the lower side of each of FIGS. 6A and 6B, for example, to prevent an influence on a separating operation of reverse roller 62 (a counterclockwise direction for returning the paper), the reverse roller 62 is provided as being divided in the axial direction as if they are skewered. On the outer perimeter side of the shaft between the divided reverse rollers 62 (portions where no reverse rollers 62 are present), skewered-roller-shaped pulleys (not shown) having a slightly smaller outer diameter than the outer diameter of the reverse rollers 62 are provided via rolling bearings not shown or the like. With this, the conveyor belt 82 is driven so as to run and rotate in a clockwise direction, thereby conveying the paper to the second conveying unit 7 and the belt conveying unit 8 on the downstream side of the conveying path. At the nip portion between the feed roller 61 and the reverse rollers 62, the conveyor belt 82 is provided one stage lower than the outer perimeter surface of the reverse rollers 62 so as not to form a nip portion with the conveyor belt 82. With this, after one paper is separated at the nip portion between the feed roller 61 and the reverse rollers 62 for feeding, the operation as explained above of the conveyor belt 82 can be achieved.

Therefore, according to any one of the modification examples, at least operation effects equivalent to those in the first embodiment can be achieved.

Figure 7:
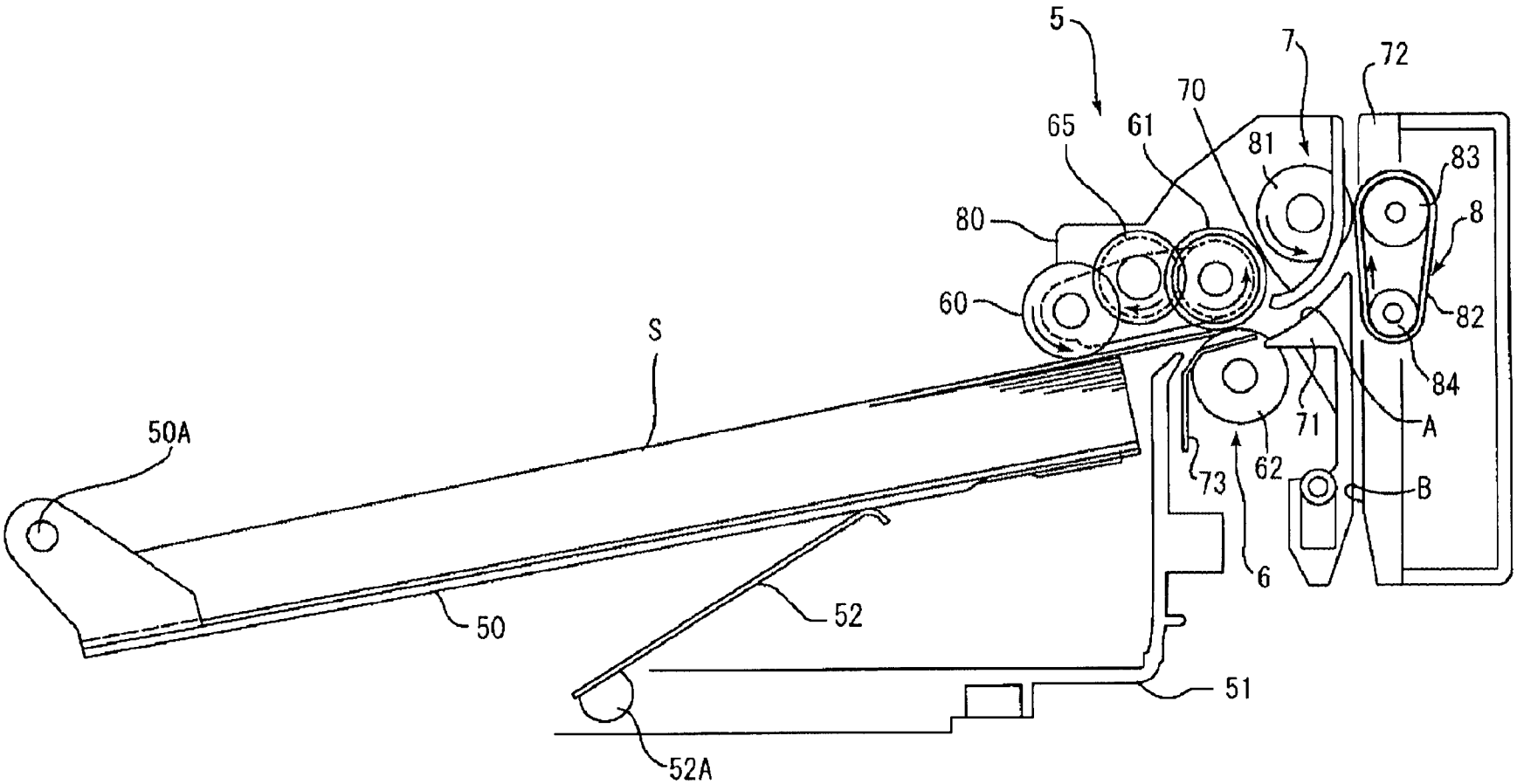
FIG. 7 is a schematic section view of a second embodiment of the present invention to which the sheet conveying apparatus according to the present invention is applied, the view depicting a paper feeding tray having stored therein stacked papers and a paper conveying apparatus provided for that tray.
Figure 8:
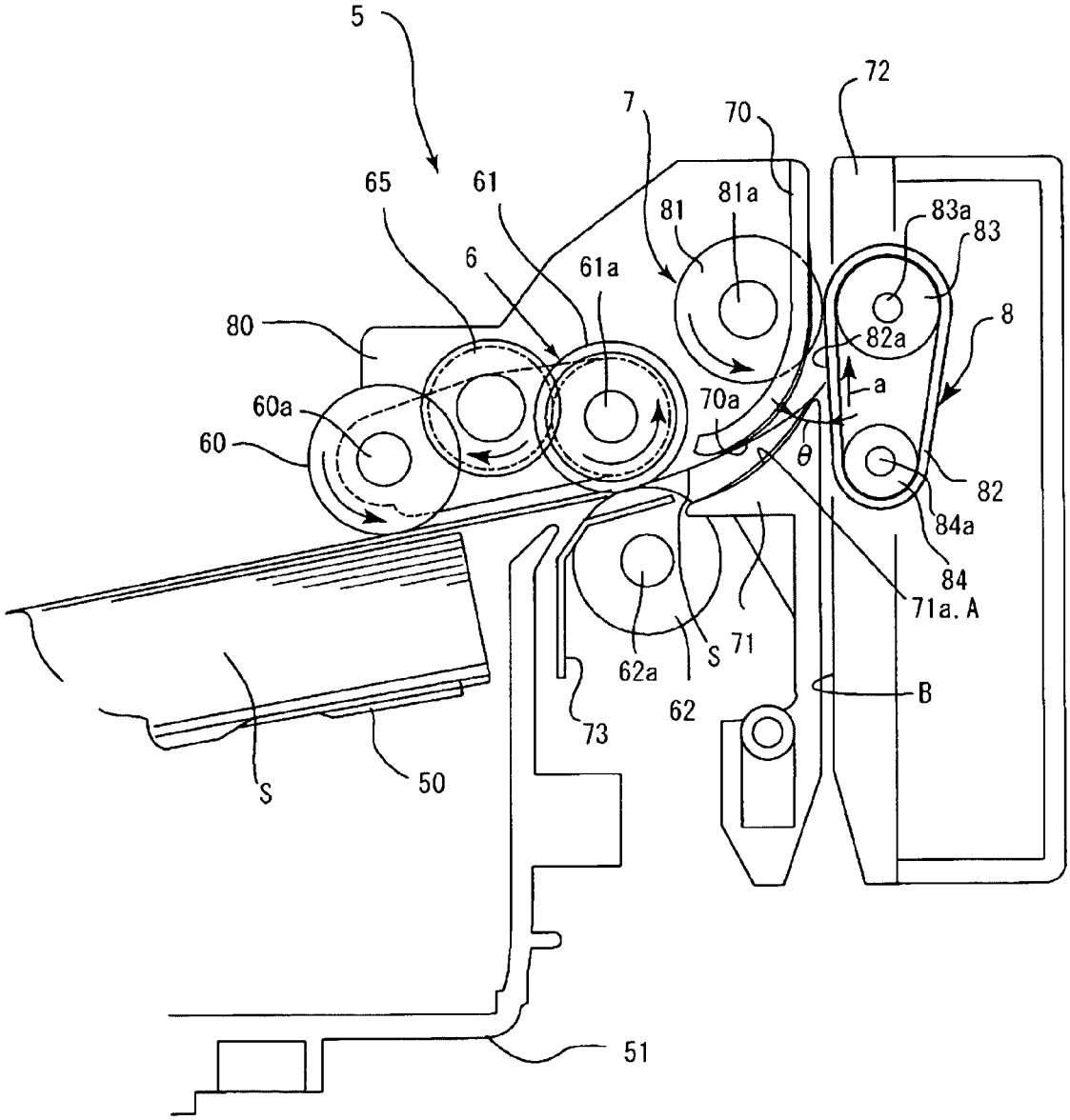
FIG. 8 is a schematic enlarged section view of the paper conveying apparatus according to the second embodiment, the view mainly depicting the paper conveying apparatus in a state where the tip of a paper reaches a belt conveying unit.
Figure 9:
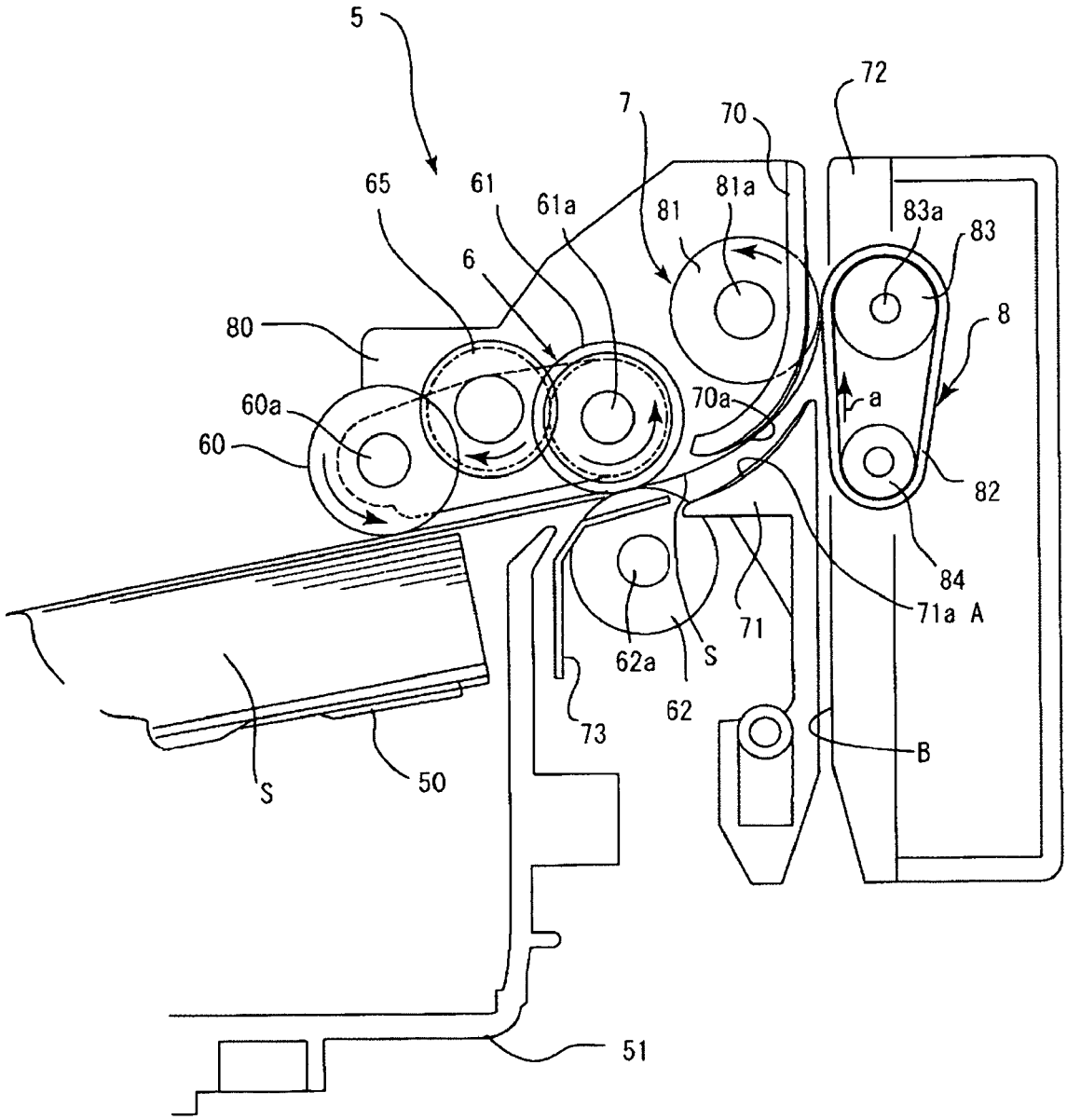
FIG. 9 is a schematic enlarged section view of the paper conveying apparatus according to the second embodiment, the view mainly depicting the paper conveying apparatus in a state immediately before the tip of the paper reaches a nip portion (holding portion) of a second conveying unit.

With reference to FIGS. 7 to 9, a second embodiment of the present invention is explained. Here, components and members identical to those in the paper conveying apparatus 5 depicted in FIGS. 1 to 4 are provided with the same reference numerals, and their description is omitted or simplified. Also, although not particularly noted, configurations not explained according to the present embodiment, that is, the paper conveying apparatus and other configurations, their operations, and others, are similar to those in the paper conveying apparatus 5 according to the first embodiment depicted in FIGS. 1 to 4.

The paper conveying apparatus 5 depicted in FIGS. 7 to 9 is different from the paper conveying apparatus 5 depicted in FIGS. 1 to 4 mainly in the following three points. That is, firstly, in addition to the first conveying path A as a first sheet conveying path formed between the first conveying unit 6 and the second conveying unit 7, a second conveying path B is provided as a second sheet conveying path that is formed from the upstream of the second conveying unit 7 to the second conveying unit 7 and is different and independent from the first conveying path A. Secondly, a merging path (hereinafter referred to as a "merging path") where the first conveying path A and the second conveying path B are joined on the upstream of the second conveying unit 7. Thirdly, one belt conveying unit 8 of the second paired rotational conveying members is displaced in the outer-area direction of the merging path of the first and second conveying paths A and B. Other than those mentioned above, the paper conveying apparatus 5 depicted in FIGS. 7 to 9 is similar to the paper conveying apparatus 5 depicted in FIGS. 1 to 3.

That is, in the belt conveying unit 8, of the paired roller-shaped pulleys 83 and 84 between which the conveyor belt 82 stretches, the pulley 84 is disposed straight below the pulley 83 and a predetermined distance away therefrom, and is rotatably and axially supported in the housing 80. With this, the belt conveying surface is formed as a surface in the outer-area direction of the second conveying path B. Therefore, the tip of the paper S conveyed by the first conveying unit 6 on the first conveying path A always makes contact with the belt conveying surface. Furthermore, the paper S conveyed by a conveying unit not shown on the second conveying path B is not prevented from reaching the second conveying unit 7.

Next, the conveying operation of the paper conveying apparatus 5 depicted in FIGS. 7 to 9 is explained. The paper S is let out and conveyed from the state of being horizontally stacked in the paper feeding tray 51. Therefore, the paper conveying direction in the sheet feeding and separating mechanism of the first conveying unit 6 is an approximately horizontal direction. Thereafter, since the paper is conveyed to the image forming unit of the main body 2 positioned upward, the paper S has to be conveyed in an approximately vertically upward direction orthogonal to the approximately horizontal direction.

To achieve this, as shown in FIG. 8, after separation of the papers S one by one by the paper feeding and separating mechanism, one paper S is conveyed as being mildly bent with a small conveying resistance, and then its tip abuts on the conveyor belt 8.

The conveyor belt 82 runs so as to advance toward an approximately vertically upward (approximately straight above) direction represented by an arrow a in FIG. 8. Therefore, the tip of the paper S abutting on the conveyor belt 82 is conveyed to the nip portion between the grip roller 81 and the conveyor belt 82 as shown in FIG. 9. Then, with the pair of the grip roller 81 and the conveyor belt 82, the paper is nipped and conveyed to the downstream side of the approximately vertically upward direction. At this time, as explained above, a conveyance driving force for advancement in the conveying direction is transmitted to and acted upon the paper S from the conveyor belt 82. Also, with the conveyor belt 82, the direction is changed toward the nip portion between the grip roller 81 by the conveyor belt 82. Therefore, even a high-stiffness paper S can be stably conveyed without a faulty conveyance.

As explained above, according to the paper conveying apparatus 5 depicted in FIGS. 7 to 9, even in the paper conveying apparatus having a merging path, operation effects similar to those in the paper conveying apparatus 5 explained with reference to FIGS. 1 to 4 can be achieved. That is, a high-stiffness paper, such as a cardboard or the like, can be stably conveyed. Also, an excellent supportability for paper types can be achieved. Furthermore, the present invention can be applied to a paper conveying apparatus having two or more, which is, a plurality of, conveying paths, such as at least the first and second conveying paths A and B. Thus, the application range can be widened. That is, a paper conveying apparatus excellent also in supportability to various models can be achieved.

Here, the second embodiment is not restricted to the example as shown in FIGS. 7 to 9 where the existing second paired conveyor rollers 81 and 83 are used to configure the belt conveying unit 8. As with the modification example of the first embodiment shown in FIG. 6C, an independent belt conveying unit 8 separate from the second paired conveyor rollers 81 and 83 may be provided.

Figure 10:
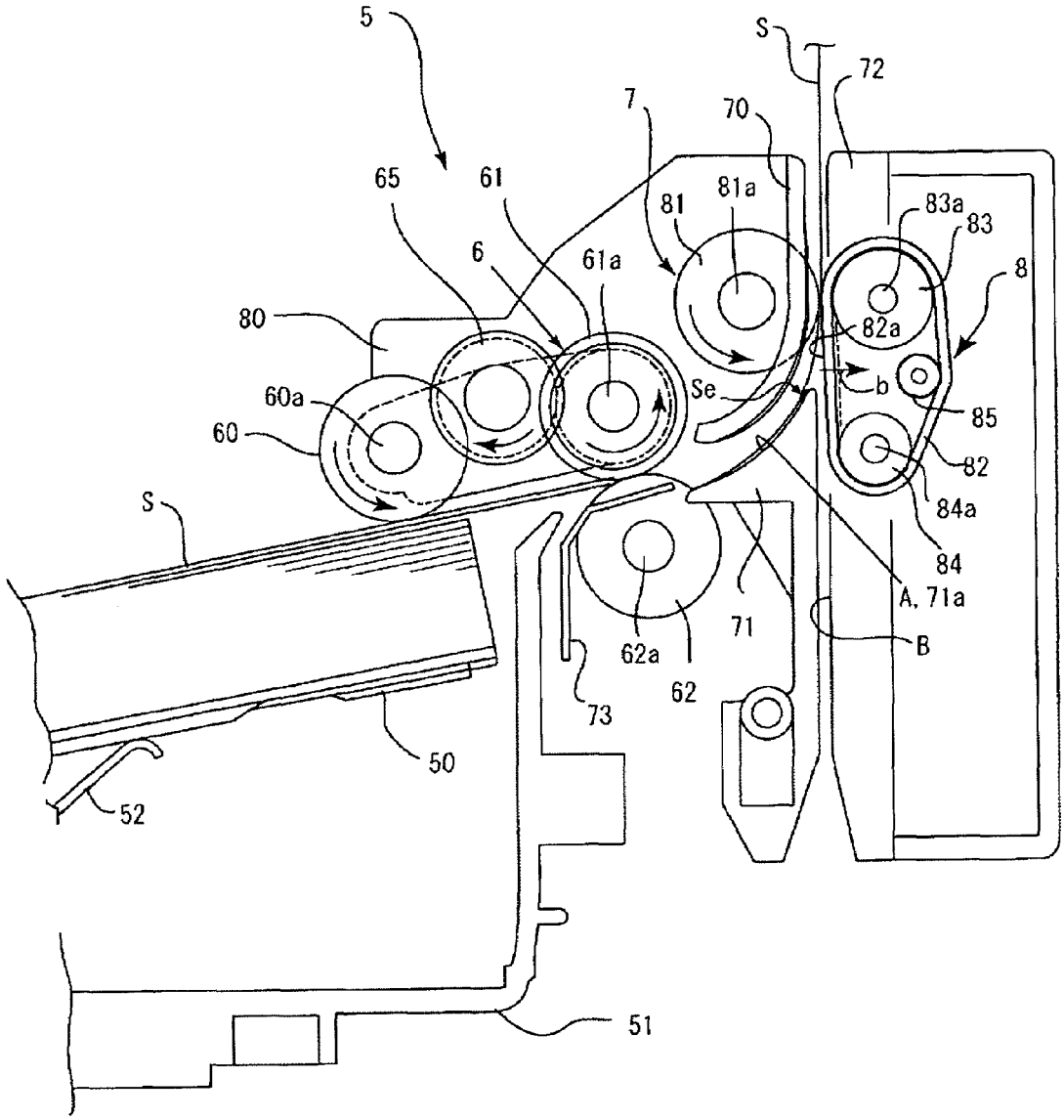
FIG. 10 is a schematic enlarged section view of a third embodiment of the present invention to which the sheet conveying apparatus according to the present invention is applied, the view mainly depicting a paper conveying apparatus.

With reference to FIG. 10, a third embodiment of the present invention is explained. Here, components and members identical to those in the second embodiment are provided with the same reference numerals, and their description is omitted or simplified. Also, although not particularly noted, configurations not explained in the third embodiment, that is, the paper conveying apparatus and other configurations, their operations, and others, are similar to those in the paper conveying apparatus 5 according to the second embodiment depicted in FIGS. 7 to 9.

As shown in FIG. 10, when a rear end Se of the bent paper S at the time of conveyance is away from the support by the guide member 71 or the like, with a reaction force of the bent paper S, a spring phenomenon occurs where the rear end Se of the paper S moves in a direction represented by an arrow b in the drawing. In particular, for a high-strength, that is, high-stiffness, paper S, such as a cardboard, its reaction force is large. Therefore, a sudden sound due to this spring poses a problem.

That is, in the course of conveyance, the paper S is supported by at least two supporting points and is forcibly bent. When the rear end Se side of the paper S is away from one of the supporting points, such as the nip portion of the first conveying unit 6 or the guide member 71, the paper is supported only at its tip. With an elastic returning force of the bent paper S, the rear end Se of the paper S instantaneously collides with the conveying surface 82*a* of the conveyor belt 82. The impact at that time is larger as the stiffness strength of the paper S is higher. Therefore, a sudden sound occurring due to a collision of the rear end Se of the paper S with the conveyor belt 82 based on the spring phenomenon mentioned above not only makes the user feel uncomfortable, but also may invite a misconception that a failure has occurred. That is, irrespectively of whether the paper S is an ordinary paper or a high-stiffness paper, a sudden sound will occur even with normal paper conveyance. This may cause the user unnecessary concern that the device is in trouble.

To get around this, as shown in the drawing, in the paper conveying apparatus 5 according to the third embodiment, in the belt conveying unit 8, an abutting member, such as a tension roller 85, as a member in contact with the conveyor belt 82 except the paired roller-type pulleys 83 and 84 between which the conveyor belt 82 stretches and the grip roller 81 is disposed not on the conveying surface 82*a* side of the conveyor belt 82. With this, a moderate elasticity is provided to a portion on the conveying surface 82*a* side of the conveyor belt 82, thereby absorbing the impact by the spring of the rear end Se of the paper S through an elastic action of the conveyor belt 82. Thus, even at the time of conveying a high-stiffness paper S, such as a cardboard, the paper conveying apparatus 5 capable of ensuring silence can be achieved and provided.

The tension roller 85 is placed at a position in contact with the inner perimeter surface of one of two linear portions formed on the conveyor belt 82 stretching between the pulleys 83 and 84, the linear portion being opposite to the other portion on the conveying surface 82*a* side, and is axially supported so as to be able to be displaced outward from the position mentioned above across the conveyor belt 82. The roller 85 is pressed in an outer right direction in the drawing by a pressing member not shown. With this, the tension roller 85 is rotated by following the running of the conveyor belt 82, and also always makes contact with the inner perimeter surface of the conveyor belt 82 so as to be displaced outward by receiving a predetermined pressing force. Thus, without looseness of the conveyor belt 82, certain tension can be maintained in a perimeter length direction.

Therefore, according to the paper conveying apparatus 5 of the third embodiment, the tip of the paper in the paper conveying direction is nipped and conveyed by the second conveying unit 7. Even when the rear end Se of the paper S is away from the support by the guide member 71 and collides with the conveying surface 82*a* of the conveyor belt 82, as represented by a two-dot chain in the drawing, the conveying surface 82*a* of the conveyor belt 82 can be elastically deformed sufficiently to be displaced in a collision direction. With this, the impact by the spring of the rear end Se of the paper S can be absorbed, thereby reducing the volume of the sound occurring due to the collision and suppressing and mitigating an unusual sound as an operation sound of the paper conveying apparatus.

As explained above, according to the paper conveying apparatus 5 of the present embodiment, the tension roller 85 as an abutting member that makes contact with and supports the belt 82 is disposed at a position different from a position where the rear end Se of the conveyed paper S makes contact with the conveying surface 82*a* of the conveyor belt 82. When the paper S is bent in a predetermined manner and conveyed, the rear end Se of the paper S is away from the nip portion of the first conveying unit 6 or the guide member 71 to collide with the conveying surface 82*a*, the collided portion of the conveyor belt 82 can be sufficiently and elastically sagged to absorb the impact, thereby suppressing a sudden sound (clicking sound) occurring due to the collision. That is, when the rear end Se of the paper S makes contact with the conveying surface 82*a* of the conveyor belt 82, the abutting member does not hinder the deformation of the portion of the conveyor belt 82 with which the rear end Se of the paper S makes contact, thereby sufficiently sagging the conveyor belt 82 in a contact direction of the rear end Se of the paper S.

In particular, at the time of conveying the high-stiffness paper S, such as a cardboard, even when the rear end Se of the paper S strongly collides with the conveyor belt 82 in the paper conveying direction, the impact due to the collision can be absorbed and mitigated by elastic deformation of the conveyor belt 82, thereby sufficiently suppressing an occurring impact sound.

Therefore, as explained above, a suddenly occurring sound at the time of paper conveyance can be suppressed. This can achieve silence, while preventing the user from feeling uncomfortable and also preventing a misconception that a failure has occurred, thereby improving usability of the apparatus.

On the other hand, in the course of paper conveyance mentioned above, when the tip of the paper S makes contact with the conveying surface 82*a* side of the conveyor belt 82 for the first time, such a contact of the tip of the paper S is expected to cause an elastic deformation of the conveyor belt 82 to some degree, even through no sudden sound may occur. Therefore, the tip of the paper S can be caused to softly abut on the conveying surface 82*a* without springing back therefrom, that is, without repulsion, and then this abutting state can be continued as it is. That is, even when the tip of the paper S conveyed by the first conveying unit 6 diagonally collides with the conveying surface 82*a* of the conveyor belt 82 running in the paper conveying direction at an entering angle θ (refer to FIG. 8) with respect to the conveying surface 82*a*, it is possible to cause the direction in which the tip of the paper S to follow the conveying surface 82*a* without repulsion of the tip of the paper S from the conveying surface 82*a*, thereby changing the direction to a direction in which the conveyor belt 82 is running.

The third embodiment is not restricted to the one depicted in FIG. 10. For example, as long as the conveyor belt can be deformed to a degree that sufficient silence can be obtained, unlike the configuration shown in FIG. 10, the tension roller 85 is not restricted to be placed only on the non-conveying surface not facing the first conveying unit 6, which is one of two belt running surfaces each in an approximately straight line formed on the conveyor belt 82 stretching between the one paired pulleys 83 and 84 facing each other in a predetermined-manner. Alternatively, one of these two belt running surfaces, including the facing conveying surface, may be selected, and the roller may be placed at any position on the selected belt running surface. That is, since the position at which the rear end of the paper makes contact on the conveying surface of the belt due to the spring phenomenon explained above is approximately constant irrespectively of the stiffness strength in the thickness direction of the paper, the tension roller can be disposed so as to abut on an appropriate position on the conveying surface a predetermined distance away from the contact position, the predetermined distance allowing belt deformation as explained above.

Also, according to the third embodiment, with the predetermined position being ensured, a tension roller for ensuring tension by pressing the stretched belt from inward to outward is provided. Conversely, a tension roller for ensuring tension by pressing the belt from outward to inward may be provided.

In this configuration, in addition to the function of providing tension, a function of cleaning the outer perimeter surface of the belt can be provided. According to the configuration of such a tension roller having both of the function of providing tension to the belt and the function of cleaning the conveying surface of the belt, the conveying surface of the belt can be kept clean. As a result, it is expected to contribute to an improvement in image quality. That is, with the belt conveying surface kept clean, the surface of the paper in contact with the conveying surface of the belt can similarly be kept clean. Also, with the predetermined position being ensured, a tension roller and a cleaning roller may be separately provided. Furthermore, only a cleaning roller may be provided, whose main function is not a tension providing function but a cleaning function.

Figure 11:
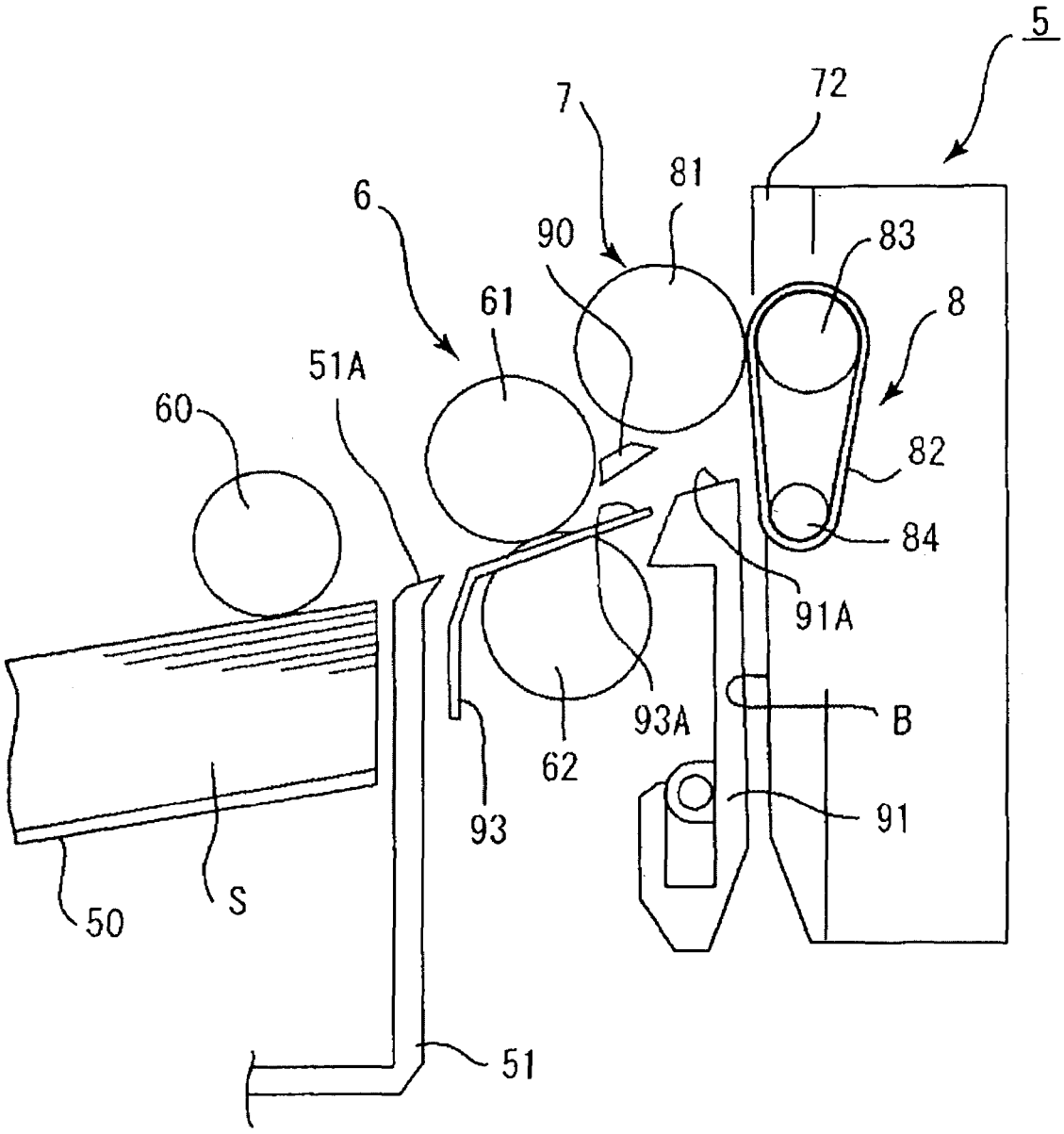
FIG. 11 is a schematic enlarged section view of a fourth embodiment of the present invention to which the sheet conveying apparatus according to the present invention is applied, the view mainly depicting a paper conveying apparatus.
Figure 12:
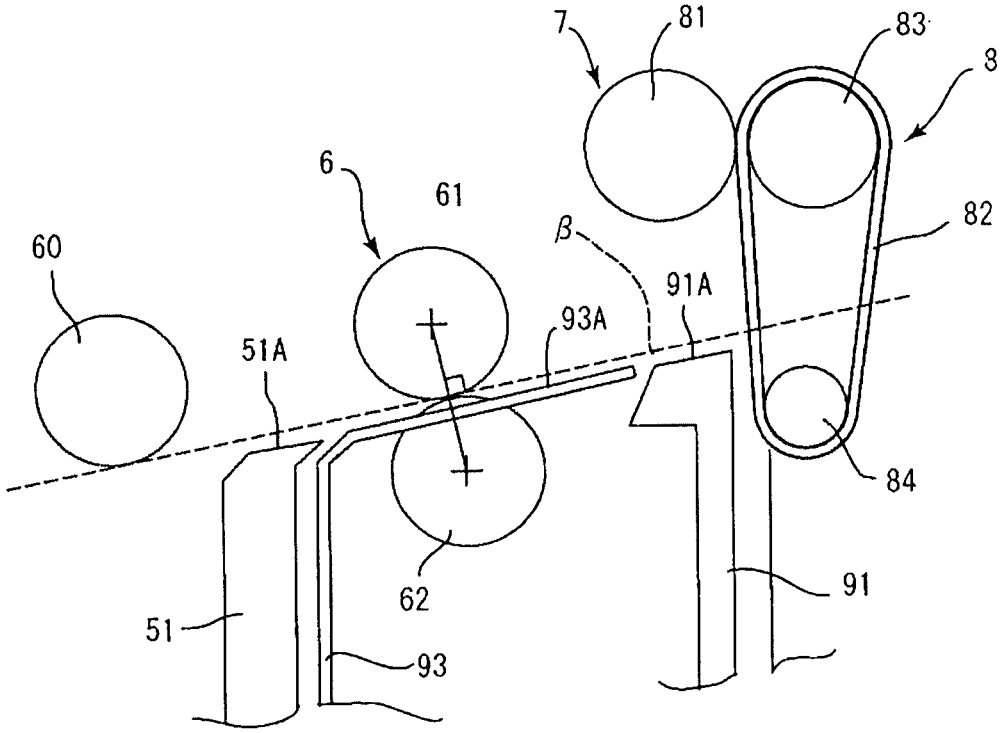
FIG. 12 is a partial enlarged section view of the paper conveying apparatus according to the fourth embodiment, mainly depicting a summary of a guide member provided in a conveying path outer-area direction in the paper conveying apparatus.
Figure 13:
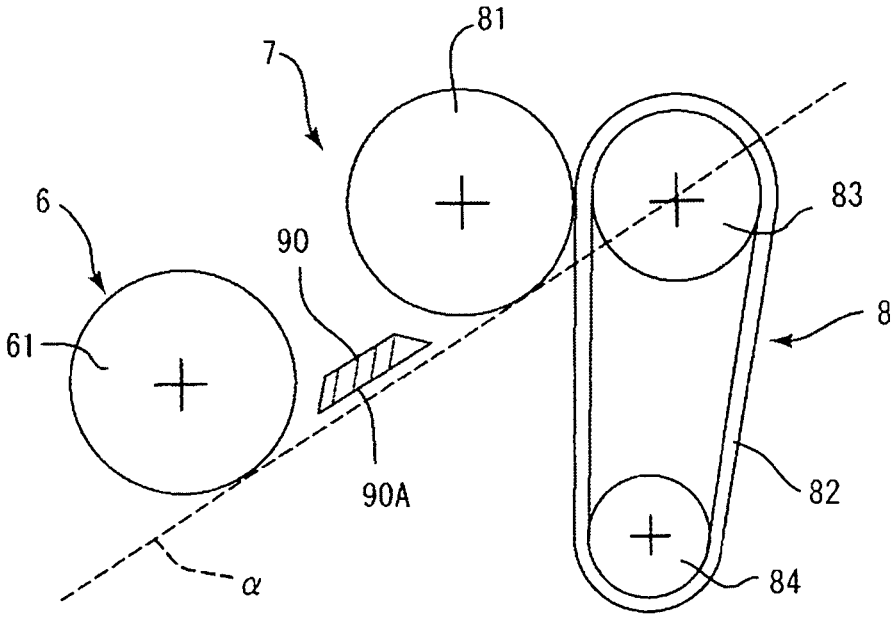
FIG. 13 is a partial enlarged section view of the paper conveying apparatus according to the fourth embodiment, mainly depicting the guide member between a first conveying unit and a second conveying unit in the conveying path inner-area direction in the paper conveying apparatus.

With reference to FIGS. 11 to 13, a fourth embodiment of the present invention is explained. Here, components and members identical to those in the second embodiment depicted in FIGS. 7 to 9 and the third embodiment depicted in FIG. 10 are provided with the same reference numerals, and their description is omitted or simplified. Also, although not particularly noted, configurations not explained according to the fourth embodiment, that is, the paper conveying apparatus and other configurations, their operations, and others, are similar to those in the third embodiment.

According to the fourth embodiment, in a paper conveying path from the first conveying unit to the belt conveying unit, the load from the fixed guide member forming the conveying path between these two units can be reduced. Also, a clicking sound occurring because the rear end of the paper makes contact with the fixed guide member in an impactive manner can be suppressed, thereby reducing a paper conveying sound. In addition, in a paper conveying path from the paper accommodating unit to the first conveying unit, the load from the fixed guide member can be reduced. Also, a clicking sound can be suppressed by preventing the rear end of the paper from making contact with the fixed guide member in an impactive manner, thereby reducing paper conveying sound.

In the paper conveying apparatus 5 according to the fourth embodiment, as depicted in FIGS. 11 to 13, when the paper S on top of the papers S stacked on the bottom plate 50 is started to be conveyed, the paper advances approximately straight in a section starting from the position of the tip of the paper in the conveying direction to a reaching point where the tip of the paper reaches the first conveying unit 6. Then, with reference to the position of the tip of the paper during the paper is being conveyed, the paper advances approximately straight in a section starting from a position where the tip of the paper is away from the first conveying unit 6 to a reaching point where the tip of the paper reaches the belt conveying unit 8. Furthermore, in this section, advancement of the tip of the paper directly toward the nip portion of the first conveying unit 6 is prevented from being hindered by a fixed guide member 90 disposed in the inner-area direction on the paper conveying path between the first conveying unit 6 and the second conveying unit 7. Also, at least after the tip of the paper reaches the belt conveying unit 8, if the paper is further conveyed and nipped by the first conveying unit 6 and the second conveying unit 7, an intermediate portion of the nipped portion by these two units on the paper is prevented from being unnecessarily bent by the fixed guide member 90.

As shown in FIG. 11, in the paper conveying apparatus 5, on the downstream side of a paper turning unit in a sense of changing the advancing direction of the paper, the grip roller 81 is provided on the inner side of the turn as a roller after turn. Facing this grip roller 81, the conveyor belt 82 as the belt conveying unit 8 is provided outside of the turn. Also, the conveyor belt 82 extends so that its belt running surface (conveying surface) approximately crosses the advancing direction of the paper when the paper is conveyed by the first conveying unit 6 itself as the paired rollers before turn on the upstream side, accurately, so that the tip of the paper makes contact with the belt running surface at an acute entering angle θ.

Also, in a paper conveying path from the feed roller 61 as a roller before turn on the upstream side in the turn unit to the conveyor belt 82, which is a belt on the downstream side, paper guide members 93 and 91 are disposed to form the paper conveying path and serve as a second guide member that guides the paper to the belt conveying unit 8. Based on the shapes of these paper guide members (hereinafter also simply referred to as "guide members") 93 and 91, the paper S is conveyed approximately straight from the first conveying unit 6 to the conveyor belt 82 on the paper conveying path. The tip of the paper starting from the first conveying unit 6 is conveyed with its advancing direction unchanged, and then reaches the belt running surface of the conveyor belt 82.

As more specifically depicted in FIG. 12, the guide members 93 and 91 provided in the outer-area direction of the paper conveying path are configured to have a shape and placement without a turn or curve or the like in the middle and also have an approximately same plane.

The guide members 93 and 91 have formed thereon guide surfaces 93A and 91A, respectively, which guide the paper. Among the paper guide members forming the paper conveying path from the first conveying unit 6 until the paper reaches the belt conveying unit 8, several guide members 93 and 91 in the outer-area direction of the paper conveying path have the guide surfaces 93A and 91A that are defined in shape such that the guide surfaces 93A and 91A of the guide members 93 and 91 belong to an approximately same plane, and a space distance between adjacent ends of the guide surfaces 93A and 91A is formed so as to be a predetermined small distance. That is, the guide surfaces 93A and 91A are formed to configure a plane (represented by a broken line in FIG. 12) that is assumed to be approximately successive in view of paper conveyance, with a space in a horizontal direction in the drawing being provided to a degree that the tip and rear end of the paper advancing in the paper conveying direction are prevented from being caught or falling. Also, the successive plane includes a contact point at which the feed roller 61 and the reverse roller 62 as a separating member make contact with each other. For the plane other than this contact point, an approximately parallel relation is set with respect to a plane defined in consideration of the dimension approximately equal to the thickness of the paper to be conveyed. With this, until the tip of the paper starts from the first conveying unit 6 and reaches the belt conveying unit 8, the paper is conveyed approximately straight in the course of conveyance.

Therefore, even if the paper is conveyed in contact with the guide surfaces 93A and 91A of the guide members 93 and 91 in the section from the first conveying unit 6 to the conveyor belt 82, a difference in height is eliminated in that section. Therefore, when the rear end of the paper moves from the guide surface 93A to the guide surface 91A, the clicking sound explained above can be prevented. Also, the conveying resistance from the guide members 93 and 91 to the paper can be minimized, thereby reducing the load from the fixed guide onto the paper.

As explained above, the first conveying unit 6 composed of the feed roller 61 and the reverse roller 62 is a paper feeding and separating mechanism of an FRR paper feeding system or the like as a sheet separating mechanism. In this paper feeding and separating mechanism, a paper is separated by friction. Therefore, the conveying force of the feed roller 61 is relatively small. Thus, when the conveying load is large with respect to the paper conveyed by the paper feeding and separating mechanism, the paper may slip, thereby making it often impossible to send the paper at a conveying speed (linear velocity) as designed. With this, a decrease in copy productivity and a paper jam tend to occur. In more detail, when the conveying load of the paper is large, a slip occurs between the feed roller 61 in contact with the one paper to be separated and that paper. Even if this paper can be separated, the paper cannot be sent at an accurate conveying speed as designed. This decreases the number of sheets conveyed per unit time, thereby inviting a decrease in productivity in image formation. Also, a paper jam that stops the conveyance of the paper tends to occur.

By contrast, according to the fourth embodiment, assuming that there are no deformation action onto the paper itself due to external force or gravity at all, the guide surfaces 93A and 91A of the guide members 93 and 91 are formed, with a predetermined space distance being ensured, so as to have an approximately parallel relation with a virtual paper conveying plane on which the paper conveyed by the first conveying unit 6 itself advances and also to belong to an approximately same plane. Therefore, various problems discussed above can be sweepingly solved.

That is, the guide members 93 and 91 merely guide the paper starting from the first conveying unit 6 for conveyance so as to maintain its straight-like path, without deforming the paper or changing the advancing direction of the paper. Therefore, the conveying resistance is minimized. Thus, it is possible to prevent a decrease in productivity and a paper jam.

Then, in the course of paper conveyance after the tip of the paper reaches the conveyor belt 82, when the rear end of the paper moves from the guide surface 93A of the guide member 93, which is a guide member on the upstream side in this section, to the guide surface 91A of the guide member 91, which is a guide member on the downstream side, both of the guide surface 93A and the guide surface 91A are formed so as to belong to the same plane to eliminate a difference in height between these guide surface 93A and the guide surface 91A. Therefore, the contact of the rear end of the paper with both of the guide surfaces 93A and 91A can be sustained in an approximately continuous manner. Thus, the rear and of the paper is once away from the guide surface 93A to a degree that at least a clicking sound is prevented, thereby preventing the paper from abutting on the guide surface 91A in an impactive manner.

On the other hand, as shown in FIG. 13, among paper guide members forming the paper conveying path from the first conveying unit 6 to the second conveying unit 7, a fourth guide member 90 disposed in the inner-area direction of the paper conveying path is provided at a position retreated in the inner-area direction by a predetermined distance. With this, even if the paper is nipped by the first conveying unit 6 and the second conveying unit 7 and an intermediate portion of the sheet paper positioned between the first conveying unit 6 and the second conveying unit 7 is in a state of being approximately linearly extended, the fourth guide member 90 can prevent the guide member 90 itself from abutting on or sliding through the intermediate portion to produce a conveying resistance that hinders the advancement of the paper.

The guide member 90 is provided internally from a tangent line $\alpha$ represented by a broken line in FIG. 13 connecting a tangent line of the feed roller 61, which is a roller disposed inside of the turn in the first conveying unit 6, and a tangent line of the grip roller 81, which is a roller disposed inside of the turn in the second conveying unit 7. With this, in the course of paper conveyance, the paper can be sent without making contact with the guide member 90 as an inner guide. Therefore, in the course of paper conveyance from the time when the tip of the paper comes from the first conveying unit 6 to the time when the rear end of the paper passes through the second conveying unit 7, the load at the time of paper conveyance can be further reduced. Thus, a high-stiffness or strength paper, such as a cardboard, can be stably conveyed.

In more detail, the guide member 90 is formed on a plane obtained by moving an entire area of the guide surface 90A formed on the guide member 90 diagonally upward to the left in the drawing by a predetermined space distance from the tangent line α so as to be parallel thereto. In other words, the guide surface 90A is formed so that the entire area occupies a position a predetermined space distance away from the tangent line α in a diagonally upward direction to the left in the drawing orthogonal to the paper conveying direction, and is also formed on a successive plane approximately parallel to the tangent line α.

Figure 20:
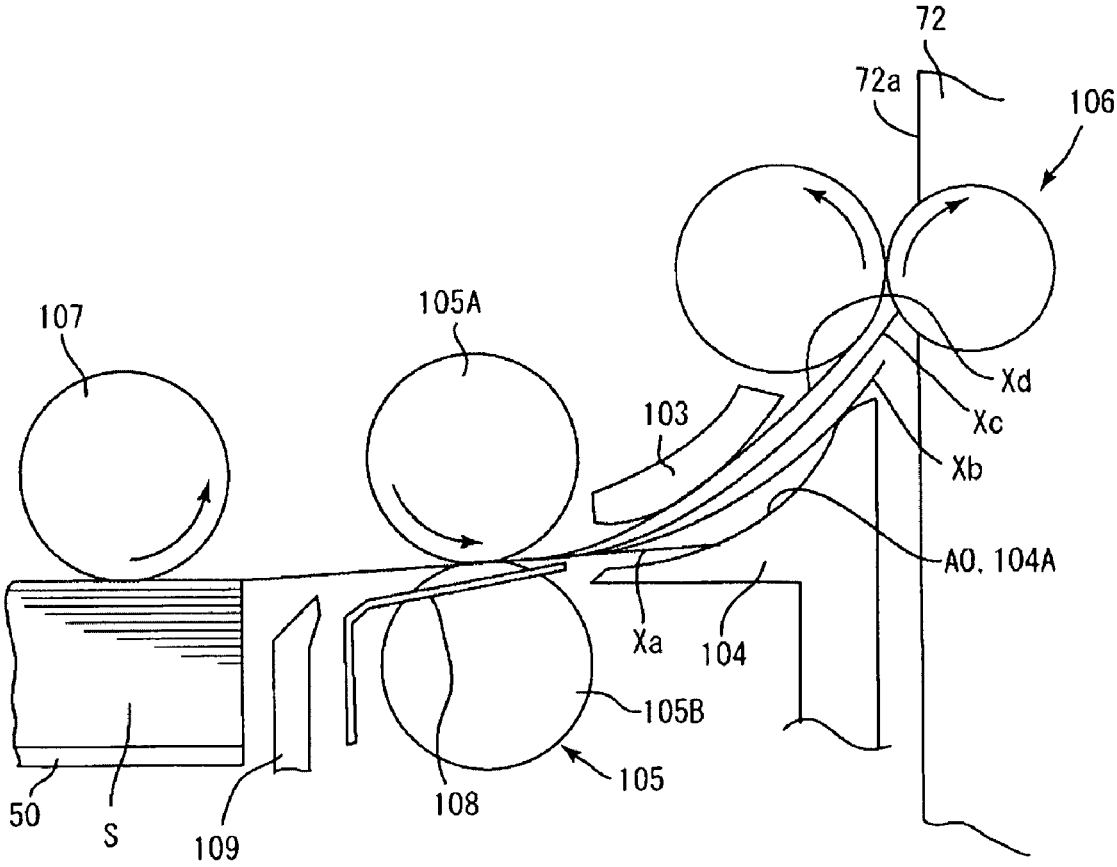
FIG. 20 is a schematic view of the paper conveying apparatus according to the conventional configuration for explaining an increase in conveying load due to an internal guide member in the course of paper conveyance.

Here, the paper conveying apparatus of the conventional configuration shown in FIG. 20 and that according to the fourth embodiment are explained in comparison with each other. In the conventional paper conveying apparatus shown in FIG. 20, after the tip of the paper S abuts on the guide member 72 forming the vertical guide surface 72*a*, the tip of the paper S is sent along the guide surface 72*a* upward in the drawing, which is on the downstream side of the paper conveying direction. At this time, as represented by the reference characters Xa to Xd in FIG. 20, after the tip of the paper reaches the paired rollers 105 on the upstream side, the paper S abuts on the inner guide member 103 extending over the tangent line. At this portion, the paper is bent for conveyance. As such, when the paper is bent inward, the paper conveying load is increased. That is, part of the paper conveying force transmitted to the paper from the paired rollers 105 on the upstream side as the first conveying unit and the paired rollers 106 on the downstream side as the first conveying unit is used to bend the paper in the manner explained above. Therefore, not all of the conveying force is not used for advancing the paper. As long as the paper is bent by the inner guide member 103, partial consumption of the paper conveying force is not removed but is continued. Moreover, an intermediate portion of the paper is sent while sliding over the inner guide member 103, thereby increasing the paper conveying load. That is, the intermediate portion of the paper in contact with the inner guide advances in the conveying direction while being pressed and deformed by the inner guide member 103, thereby increasing a contact pressure between the paper and the inner guide member 103. This increases a sliding resistance occurring therebetween.

By contrast, according to the present embodiment, as shown in FIG. 13, the guide surface 90A of the guide member 90 is formed at a position not beyond the tangent line α, that is, a position retreated in a direction away from the paper conveying path so as not to make contact with the tangent line α, and is also formed so as to be approximately parallel to the tangent line α. Therefore, an increase in paper conveying load can be prevented. The guide member 90 according to the present embodiment achieves a minimum guide function of preventing the paper from being deviated from the paper conveying path. Also, in general, the guide member 90 does not obstruct the path of the tip of the paper advancing toward the nip portion of the second conveying unit 7, or does not bend the intermediate portion of the paper positioned between the point nipped by the first conveying unit 6 and the point nipped by the second conveying unit 7 or cause a sliding resistance. Therefore, no loads associated with conveyance can be prevented.

As shown in FIGS. 11 and 12, according to the present embodiment, the pickup roller 60 serves as a paper-feeding rotating member that feeds the paper S to the first conveying unit 6, the feed roller 61 serves as a sheet-feeding rotating member, and the reverse roller 62 serves as a separating unit.

From the pickup roller 60 to the feed roller 61 on the paper conveying path, the paper is conveyed approximately straight based on the shape of the paper guide outside of the turn. That is, it is set that the paper feeding direction by the feed roller 61 and the direction of the paper conveyed from the pickup roller 60 to the feed roller 61 belong to an approximately same plane.

Specifically, the position of the pickup roller 60, the shape of a paper guide surface 51A, as a first guide member, at the front of the paper feeding tray 51, and the shape of the guide member 93 as a second guide member are configured in a manner such that there is no turn or curve in the middle and these components are on an approximately same plane. Also, the plane is set so as to have an approximately parallel relation with the paper conveying surface defined by the pickup roller 60 and the feed roller 61. That is, as shown in FIG. 12, a line β orthogonal to a line connecting the rotation center of the feed roller 61 and that of the reverse roller 62 and passing through contact points of both of the rollers 61 and 62 is on the same line having a contact point at which the pickup roller 60 makes contact with the paper on top of the stack. The guide surfaces 51A and 93A of the respective guide members from the pickup roller 60 to the feed roller 61 provided on an approximately same plane are provided so as to have an approximately parallel relation with this line β.

In other words, among the guide members forming the paper conveying path from the pickup roller 60 to the first conveying unit 6, all the guide surfaces 51A and 93A formed by the paper feeding tray 51 and the guide member 93 as guide members in the outer-area direction of the paper conveying path belong to an approximately same plane. Also, these guide surfaces 51A and 93A are set so as to have an approximately parallel relation, with a predetermined space distance being ensured, with a single virtual plane with which both of the pickup roller 60 and the feed roller 61 make contact.

Therefore, all the guide surfaces 51A and 93A formed by the paper feeding tray 51 and the guide member 93 as fixed guide members disposed in the outer-area direction form the approximately-successive same plane belonging to the virtual plane obtained by extending the paper stacking surface defined as the paper surface of the paper on top with which the pickup roller 60 makes contact. With this, the difference in height causing a clicking sound is eliminated. Therefore, it is possible to prevent an unusual sound from being mixed into paper conveying sounds. Also, the conveying resistance received by the paper conveyed from the guide surfaces 51A and 93A can be minimized.

On the other hand, even after the tip of the paper reaches the first conveying unit 6 as a paper feeding and separating mechanism, the conveying resistance received by a downstream portion of the paper not yet reaching the first conveying unit 6 from the fixed guide member disposed in the outer-area direction can be minimized and reduced. Therefore, a decrease in productivity or a paper jam can be prevented. Also, the paper separating ability or conveyance performance of the first conveying unit 6 itself can be prevented from being decreased.

Here, in the first conveying unit 6 composed of the feed roller 61 and the reverse roller 62, the nip portion formed by the feed roller 61 and the reverse roller 62 making contact with each other is set on the single virtual plane explained above. Therefore, the paper conveying direction defined by the pickup roller 60 and the feed roller 61 approximately coincides with the paper conveying direction defined by the first conveying unit 6. Also, two virtual paper conveying surfaces defined by these direction are aligned on an approximately same plane. Therefore, the guide member 93 is a common member as a guide member positioned in the outer-area direction and forming the paper conveying path in a section from the pickup roller 60 to the feed roller 61, which is the first conveying unit 6 and as a guide member positioned in the outer-area direction and forming the paper conveying path in a section from the feed roller 61 as the first conveying unit 6 to the belt conveying unit 8. Also, the guide member 93 is set so as to be approximately parallel to two paper conveying surfaces aligned on the same plane. With this, the guide surface 93A is formed as one plane. As a result, the paper starting from the paper accommodating unit for conveyance advances in a manner such that the tip of the paper advances straight ahead with the orientation of the paper being approximately kept, and then reaches the belt running surface of the belt conveying unit 8.

As explained above, according to the paper conveying apparatus of the fourth embodiment, among the guide members forming the paper conveying path in a section from the first conveying unit to the belt conveying unit, all guide surfaces formed by several guide members positioned in the outer-area direction of the paper conveying path form a single approximately-successive plane with a difference in height in the paper conveying direction being eliminated. Therefore, the paper conveyed through the section mentioned above advances straight ahead, thereby minimizing the conveying load received from the guide members. Furthermore, between the first conveying unit to the belt conveying unit, a difference in height causing at least the rear end of the paper to abut on any of the guide members in an impactive manner can be completely eliminated, thereby preventing the occurrence of a collision sound as a clicking sound. Thus, a faulty conveyance, such as a paper jam, due to the difference in height in that section can be prevented. It is also possible to prevent the occurrence of an unusual sound as a conveying operation sound of the paper conveying apparatus due to the difference in height in that section. In particular, even when a high-stiffness paper, such as a cardboard or the like, is conveyed, the occurrence of a faulty conveyance in that section or an unusual sound from the rear end of the paper can be sufficiently prevented, thereby improving, as the paper conveying apparatus, its supportability for paper types.

Also, the guide member in the inner-area direction of the paper conveying path disposed between the first conveying unit and the second conveying unit is disposed so as not to go over the tangent line connecting, in a predetermined manner, the most outer shapes of the first and second conveying units associated with paper conveyance. Therefore, the occurrence of a conveying resistance due to this guide member can be prevented. Also, at least the load of the first conveying unit can be reduced, thereby allowing stable paper conveyance. The guide surface formed by the guide member in the inner-area direction of the paper conveying path is provided so as to be positioned in a direction away from the paper conveying path, so as not to make contact with a single virtual plane with which the first and second conveying units for paper conveyance both make contact, and so as to be approximately parallel to this single plane. Therefore, in the course of paper conveyance from the time when the tip of the paper passes through the first conveying unit to the time when the rear end of the paper passes through the second conveying unit, the intermediate portion between the tip portion where the tip of the paper collides with the guide member in the inner-area direction of the conveying path and the portion nipped by the first conveying unit can be prevented from being deformed. Also, in particular, when both conveying units nip the paper, the paper can be conveyed by preventing the intermediate portion on the paper between the portion nipped by the first conveying unit and the portion nipped by the second conveying unit from making contact with the guide member in the inner-area direction of the paper conveying path between both conveying units. Therefore, the occurrence of a friction resistance based on the contact of the intermediate portion with the guide member and, in turn, the occurrence of a conveying resistance can be completely eliminated. Also, it is possible to completely eliminate a situation that deformation of the intermediate portion is hindered by the guide member to be changed to a conveying resistance.

In particular, when a high-stiffness paper, such as a cardboard, with a high resistance against deformation is conveyed, at least in the course of conveyance in which the high-stiffness paper is nipped by both conveying units, it is possible to maintain the high-stiffness paper in a non-contact state with respect to the guide member, thereby preventing the occurrence of various conveying resistance. Therefore, the high-stiffness paper nipped by both conveying units can be smoothly conveyed. Also, as the paper conveying apparatus, its supportability for paper types can be improved.

Furthermore, among the guide members forming the paper conveying path in a section from the pickup roller to the first conveying unit, all guide surfaces formed by several guide members positioned in the outer-area direction of the paper conveying path form a single approximately-successive plane with a difference in height in the conveying direction being eliminated. Therefore, the paper conveyed through the section mentioned above advances straight ahead, thereby minimizing the conveying resistance received from the guide members. Furthermore, between the pickup roller and the first conveying unit, a difference in height causing at least the rear end of the paper to abut on any of the guide members in an impactive manner can be completely eliminated, thereby preventing the occurrence of a collision sound as a clicking sound. Thus, a faulty conveyance due to the difference in height in that section and the occurrence of an unusual sound can be prevented. In particular, even when a high-stiffness paper, such as a cardboard, is conveyed, the occurrence of a faulty conveyance in that section or an unusual sound can be sufficiently prevented, thereby improving, as the paper conveying apparatus, its supportability for paper types.

In particular, in the paper conveying apparatus according to the present invention, the paper is consistently conveyed to go straight from the paper feeding position without any change on the paper in the thickness direction, so that the tip of the paper reaches the flat belt running surface at the belt conveying unit. Therefore, the ability of the belt conveying unit can be maximized, thereby improving paper conveying ability.

That is, in the course of paper conveyance in the papery conveying device, the fixed guide members in the outer-area and inner-area directions forming the paper conveying path are not almost completely involved in deforming the paper in the thickness direction and changing the advancing direction to a predetermined direction, but the belt conveying unit is mainly involved. At least the guide member in the outer-area direction only ensures a straight directivity until the tip of the paper reaches the belt running surface, and is disposed at a position that does not hinder the change in direction and deformation by the belt conveying unit. Rather, when the paper is bent for changing the advancing direction of the paper, the tip of the paper changed in direction is always away from the guide member in the outer-area direction, and the rear end portion of the paper follows this to continue to be away. Therefore, the conveying resistance occurring between the guide member in the outer-area direction and the paper is minimized and is gradually reduced. Also, the guide function of changing the direction by the belt conveying unit as the so-called active guide member can be sufficiently achieved, thereby attaining operation effects. In addition, once the paper is started to be deformed, since the guide member in the inner-area direction positioned inward in deforming direction is disposed at a retreated position not hindering this deformation, a conveying resistance due to the guide member in the inner-area direction at the time of deformation can be prevented. With this, it is particularly advantageous to prevent a faulty conveyance when a high-stiffness paper with a high resistance ability against deformation, such as a cardboard, is conveyed. As the paper conveying apparatus, its supportability for paper types can be extended, thereby increasing a conveyance performance.

Here, in the explanation of the paper conveying apparatus according to the fourth embodiment, the abutting member accompanying the belt conveying unit explained in the third embodiment shown in FIG. 3 is not explained or shown. As with the third embodiment, an abutting member may be provided as appropriate, and the same goes for each of the following embodiments. Also, according to the fourth embodiment, an example of the paper conveying apparatus having a second conveying path has been explained. However, the present embodiment may be applied to a paper conveying apparatus without a second conveying path, and the same goes for each of the following embodiments.

Figure 14:
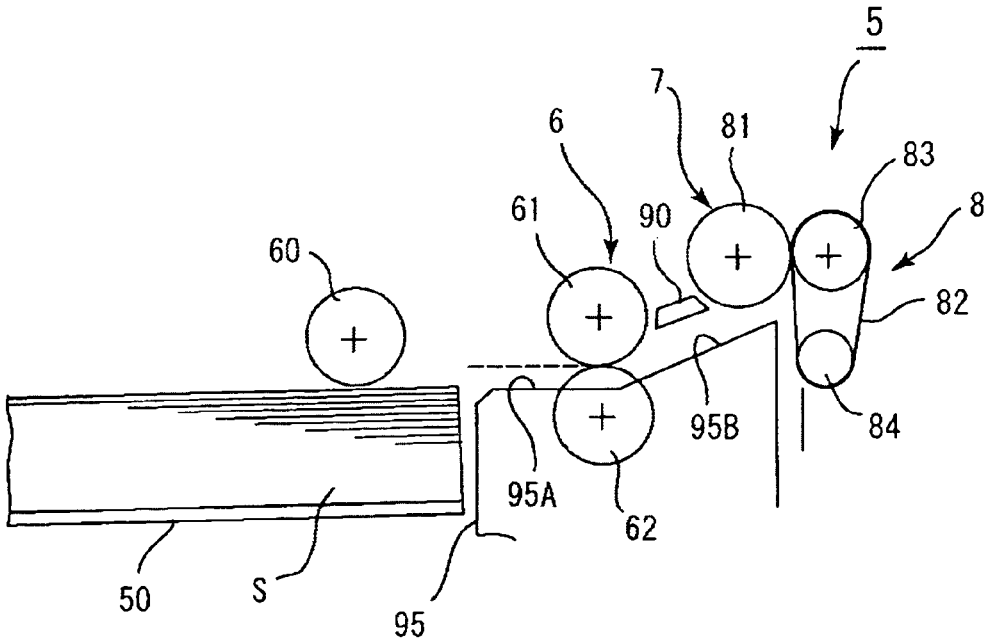
FIG. 14 is a schematic enlarged section view of a fifth embodiment of the present invention to which the sheet conveying apparatus according to the present invention is applied, the view mainly depicting a paper conveying apparatus.

Next, with reference to FIG. 14, a fifth embodiment of the present invention is explained. Here, components and members identical to those in the fourth embodiment are provided with the same reference numerals, and their description is omitted or simplified. Also, although not particularly noted, configurations not explained according to the fifth embodiment, that is, the paper conveying apparatus and other configurations, their operations, and others, are similar to those in the fourth embodiment.

In the paper conveying apparatus 5 according to the fifth embodiment, as shown in FIG. 14, the paper guide shape outside the turn between the pickup roller 60 to the feed roller 61 and the paper guide shape outside the turn between the feed roller 61 and the belt are not on the same plane, that is, are provided on different planes.

In more detail, as shown in the drawing, in a conveyance guide member 95 disposed in the outer-area direction of the paper conveying path, a guide surface 95A formed correspondingly to the section between the pickup roller 60 and the feed roller 61 is formed on a plane approximately parallel to a virtual plane with which both rollers 60 and 61 make contact. By contrast, a guide surface 95B formed correspondingly to the section between the feed roller 61 and the belt conveying unit does not belong to a virtual plane obtained by extending the guide surface 95A, but is formed so as to be an approximately-flat inclined surface inclined upward at a predetermined angle so as to be directed near the nip portion of the second conveying unit. Here, a connecting portion between the guide surface 95A and the guide surface 95B is provided at a position displaced by a predetermined amount to the downstream side of the paper conveying path in consideration of the radius of the feed roller 61 and the stiffness strength of various papers to be conveyed.

Therefore, the contact of the tip of the paper reaching the nip portion of the feed roller 61 with the fixed guide member near the feed roller 61 is changed from the guide surface 95A to the guide surface 95B, and the advancing direction is changed to a direction diagonally upward to the right in the drawing at a predetermined inclined angle. That is, the advancing direction is changed to a relatively mild direction diagonally upward to the right. Therefore, compared with the configuration in which the paper is caused to pass straight in contact with the feed roller 61, the contact area on the paper with respect to the feed roller 61 can be increased. Thus, even if the advancing direction of the paper is changed in this manner, a sufficient conveying force can be supplied from the feed roller 61 to the paper. That is, in the configuration in which the paper is caused to pass straight, the contact portion between the feed roller 61 and the paper is an approximately linear contact. By contrast, in the configuration in which the direction is changed near the feed roller 61 to involve the roller 61, the paper can be wound around the outer perimeter of the feed roller 61 to some extent, thereby extending the contact portion therebetween in an approximately outer perimeter shape. With this, since the contact portion therebetween is increased, the conveying force transmitted by friction contact is increased with the extension of the friction contact area as the contact portion.

Until the paper advancing direction is changed, that is, until the paper reaches the belt conveying unit 8 in the course of paper conveyance after direction change, the paper is guided by the guide surface 95B, which is an upward inclined surface, so as to go straight ahead in the direction diagonally upward to the right.

With a transition from the guide surface 95A to the guide surface 95B, even with a deduction of a conveying force used for changing the paper advancing direction, a sufficient conveying force can be supplied from the feed roller 61 to the paper. Also, once the direction is changed, the paper advancing the section guided by the guide surface 95B goes in the changed direction without changing the direction again. Therefore, similarly to the above, the conveying resistance from the guide surface 95B against the paper portion advancing the section can be reduced.

On the other hand, the rear end of the paper conveyed in this manner is also prevented from causing a clicking sound due to an impactive contact with the conveyance guide member 95. That is, the guide surface 95A and the guide surface 95B as guide surfaces formed by the conveyance guide member 95 are successive. Also, between these guide surfaces, no difference in height changing from a high position to a low position to instantaneously remove the support of the rear end of the paper is formed. Therefore, once the rear end of the paper makes contact with the guide surface 95B, the paper does not go away from the guide surface 95A and the guide surface 95B to a degree of not causing a clicking sound.

Figure 24:
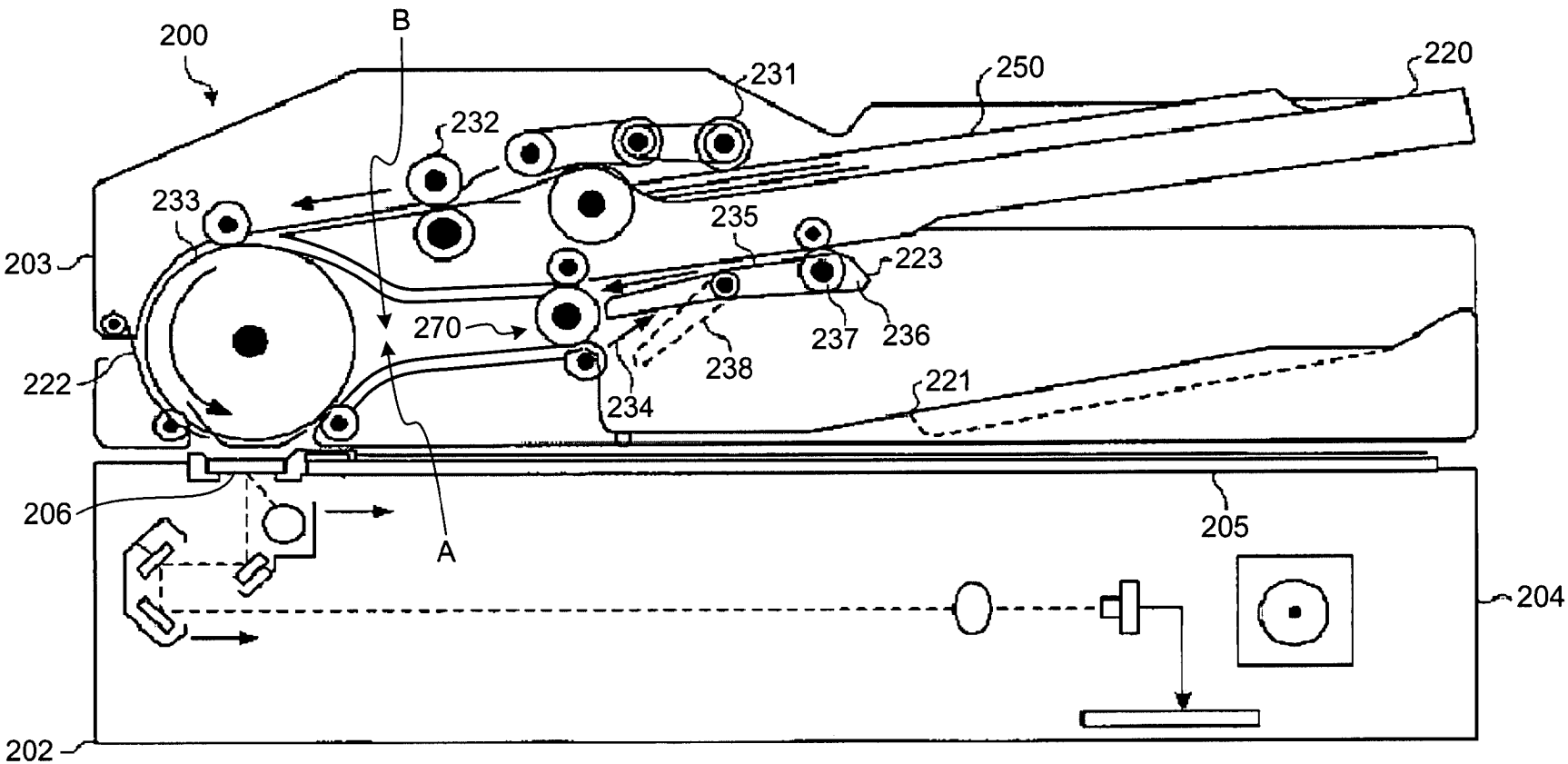
FIG. 24 is a section view of an automatic document feeding device.

Specifically, a modification example is explained in which the sheet conveying apparatus according to the present embodiment is applied to a scanner device having an automatic document feeding device. FIG. 24 is a sectional side view schematically depicting the internal configuration of a scanner device 200 according to the present modification example. As shown in FIG. 24, the scanner device 200 includes a scanner body 202, and a reversing automatic document feeder (RADF) 203, which is one type of an automatic document feeder (ADF) serving as an automatic document feeding unit, provided on the upper portion of the scanner body 202.

On the upper surface of a box 204 of the scanner body 202 are a document placement glass 205 on which a document is placed at the time of reading a document image in a book document reading mode, and an ADF document glass 206, which is a conveyed document reading glass for use at the time of reading a document image in a sheet document reading mode.

Here, the book document reading mode is an operation mode of reading an image on a document placed on the document placement glass 205. The sheet document reading mode is an operation mode of reading an image on a document when the document is automatically fed by the RADF 203 and the automatically-fed document passes through the ADF document glass 206. Here, such operation modes can be set through a main operation panel (not shown) provided outside the box 204.

Next, the RADF 203 for use under the setting of the sheet document reading mode is explained. Here, under such setting of the sheet document reading mode, a first carriage 210 and a second carriage 213 stop under the ADF document glass 206 as a home position. Then, the document automatically fed by the RADF 203 is read and scanned.

The RADF 203 is provided with a document table 220 on which a document 205 is placed at the time of reading the document in the sheet document reading mode, a paper delivering unit 221 for delivering the document 250 after reading is completed, a document conveying path 222 communicating from the document table 220 to the paper delivering unit 221, and a reversing unit 223 that reverses the document 250 in a reverse reading mode. Here, the reverse reading mode is one type of sheet document reading mode in which, after the document 205 is automatically fed by the RADF 203 and an image on the front side is read and scanned, the document 250 is reversed for reading and scanning an image on the back side.

On the document table 220 side of the document conveying path 222, a pickup roller 231 and a conveyor roller 232 are provided for separating document sheets placed on the document table 220 one by one for feeding. These pickup roller 231 and conveyor roller 232 are driven by a paper feeding motor (not shown). That is, with the pickup roller 231 and the conveyor roller 232 being driven by the paper feeding motor, the document 250 placed on the document table 220 is fed one by one to the document conveying path 222.

In addition, the document conveying path 222 is provided with a conveyor drum 233 for conveying the document 250 and conveying the document 250 to the paper delivering unit 221. Under this conveyor drum 233 is the ADF document glass 206. This conveyor drum 233 is driven by a stepping motor (not shown). Therefore, with the conveyor drum 233 being driven by the stepping motor, the document 250 fed from the document table 220 to the document conveying path 222 is guided onto the ADF document glass 206.

With this, the document 250 placed on the document table 220 is fed one by one by the pickup roller 231, and then conveyed by the conveyor roller 232 and the conveyor drum 233 to the ADF document glass 206, which is a document reading position.

Also, the reversing unit 223 is provided with a reversing table 236 that forms a reverse path 235 with one end communicating with a branching point 234 at which the document conveying path 222 is branched midway. This reversing table 236 is provided with a reverse roller 237 rotatably driven by a paper-feeding and reverse motor (not shown) in forward and reverse directions. Also, the reverse path 235 has mounted thereon a branch nail 238 that can freely rotate about a spindle. This branch nail 238 distributes the document 250 conveyed from the conveyor drum 233 to a paper delivery unit 270 to either one of the reversing unit 223 or the paper delivering unit 221 by opening and closing the reverse path 235 with respect to the document conveying path 222 through rotation of the spindle. That is, under the setting of the reverse reading mode, which is one type of sheet document reading mode, the branch nail 238 opens the reverse path 235 with respect to the document conveying path 222 through rotation of the spindle, thereby guiding the document 250 conveyed by the conveyor drum 233 to the reverse path 235. Then, the branch nail 238 causes the reversed document 250 to be again conveyed by the reverse roller 237 to the document conveying path 222.

In the scanner device 200 according to the present modification example, the sheet conveying apparatus explained above can be applied to a curved portion A in the paper delivery unit 270 to a paper delivery outlet from which the paper is delivered after passing through the reading position, and also can be applied to the reversing unit.

That is, the curved portion A where the sheet conveying direction is abruptly changed in a conveying path between the conveyor drum 233 and the paper delivery unit 270 and a curved portion B in a conveying path between the reversing unit 233 that reverses the sheet side to the conveyor drum 233 can be configured to be provided with the first conveying unit 6 (the feed roller 61 and the reverse roller 62), the second conveying unit 7 (the grip roller 81, the pulley 83, the pulley 84, the conveyor belt 82, and the belt conveying unit 8 including the conveyor belt 82), the tension roller 85, and the paper guide members 91 and 93. Other than these portions, any curved portion in which the sheet conveying direction is abruptly changed in the sheet conveying path can be configured to be provided with the first conveying unit 6 (the feed roller 61 and the reverse roller 62), the second conveying unit 7 (the grip roller 81, the pulley 83, the pulley 84, the conveyor belt 82, and the belt conveying unit 8 including the conveyor belt 82), the tension roller 85, the paper guide members 91 and 93.

As described above, according to the paper conveying apparatus of the present embodiment, operation effects similar to those of the fourth embodiment can be achieved. In addition, the advancing direction of the tip of the paper is changed by a predetermine angle near the feed roller of the first conveying unit so as to go to the second conveying unit. Also, with the feed roller being taken as a boundary, in a section from the feed roller to the belt conveying unit, the paper advances in the changed direction. Therefore, with a sufficient conveying force being supplied from the feed roller to the paper, a conveying resistance from the fixed guide against the paper advancing from the feed roller to the belt conveying unit can be minimized. As a result, even at the time of conveying a paper with a high stiffness strength, such as a cardboard, the occurrence of an unusual sound and a faulty conveyance can be prevented, thereby allowing reliable paper conveyance and also increasing paper conveying ability.

On another hand, compared with the fourth embodiment, according to the fifth embodiment, at least, a portion of the belt conveying unit of the second conveying unit reached and touched by the tip of the paper can be closer to the nip portion of the second conveying unit. That is, according to the fourth embodiment, it is configured that the paper discharged from the paper accommodating unit reaches the belt conveying unit without changing the advancing direction. By contrast, according to the fifth embodiment, it is configured that the advancing direction is changed once near the second conveying unit so that the paper is directed to the nip portion of the second conveying unit. Therefore, a contact portion of the tip of the paper on the belt conveying unit can be closer to the nip portion of the second conveying unit, compared with the fourth embodiment. Therefore, for example, it is easily configured that either one or both of the tip and rear end of the paper make contact with an approximately center portion on the linear belt running surface in the belt conveying unit. For this reason, with such a configuration, either one or both of the tip or rear end of the paper makes contact with an approximately center portion on the belt running surface to sufficiently sag the belt conveying unit. With this an impact at the time of contact can be mitigated.

On another hand, the entire length of the belt conveying unit can be reduced. That is, a length approximately equivalent to a length from one pulley of the second paired conveyor rollers to the approximately center portion on the belt can be secured as a length from the approximately center portion to the other pulley on the belt. Therefore, as explained according to the fifth embodiment, both lengths can be reduced by a length obtained by making the contact portion on the belt closer to the nip portion of the second conveying unit. With this, the belt length can be reduced. Furthermore, in the configuration with a shortened belt length, an abutting member for providing a moderate tension to the belt can be unnecessary. With this, the configuration of the belt conveying unit can be simplified.

Figure 15:
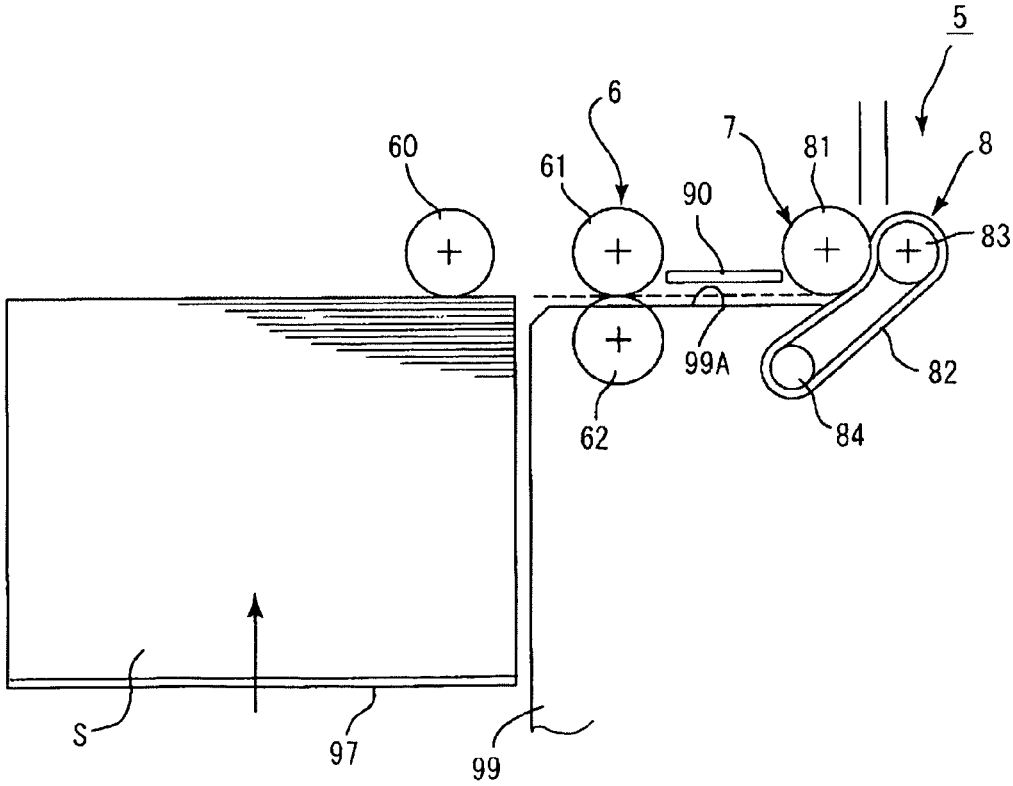
FIG. 15 is a schematic enlarged section view of a sixth embodiment of the present invention to which the sheet conveying apparatus according to the present invention is applied, the view mainly depicting a paper conveying apparatus.
Figure 16:
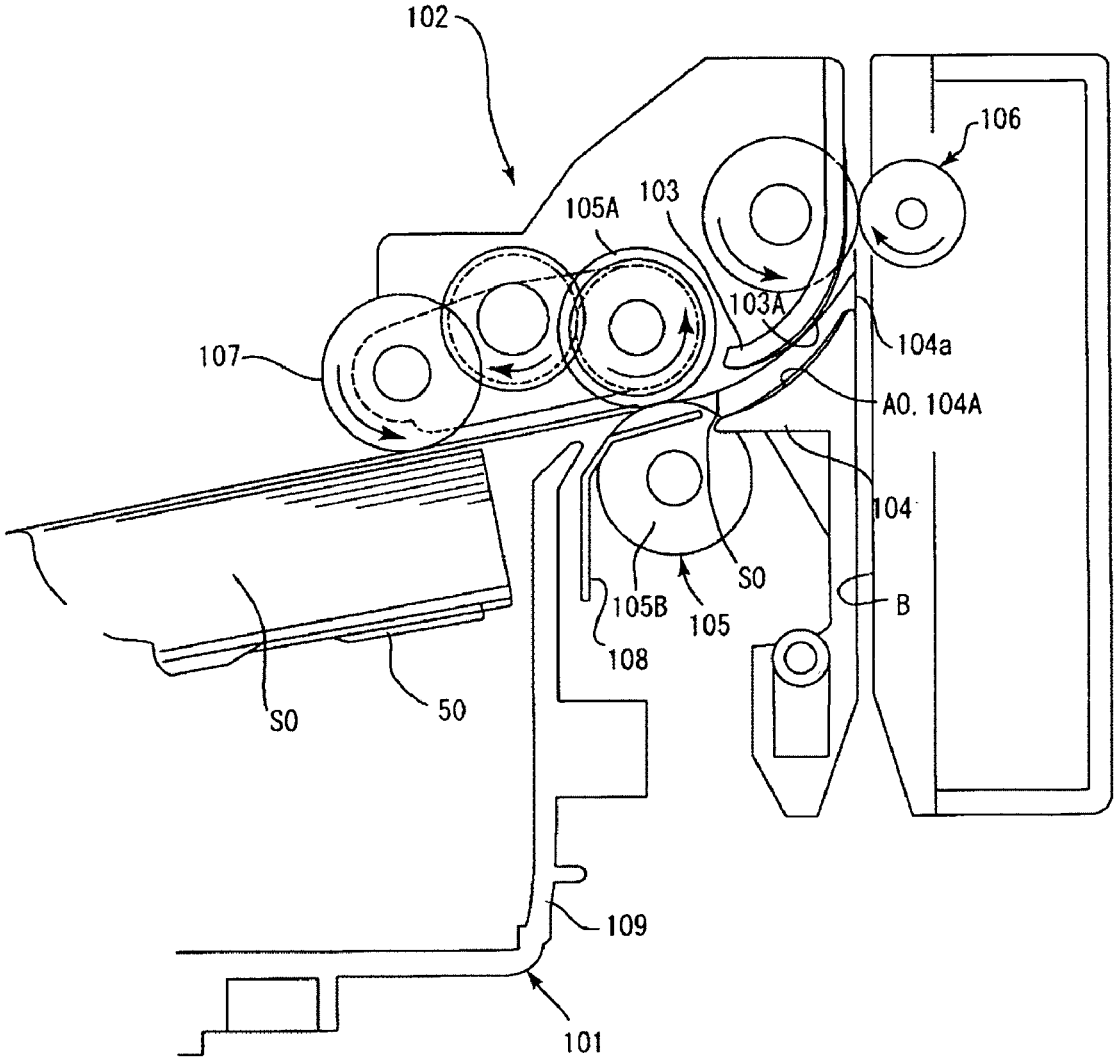
FIG. 16 is a schematic enlarged section view mainly depicting a paper conveying apparatus according to a conventional configuration.
Figure 17:
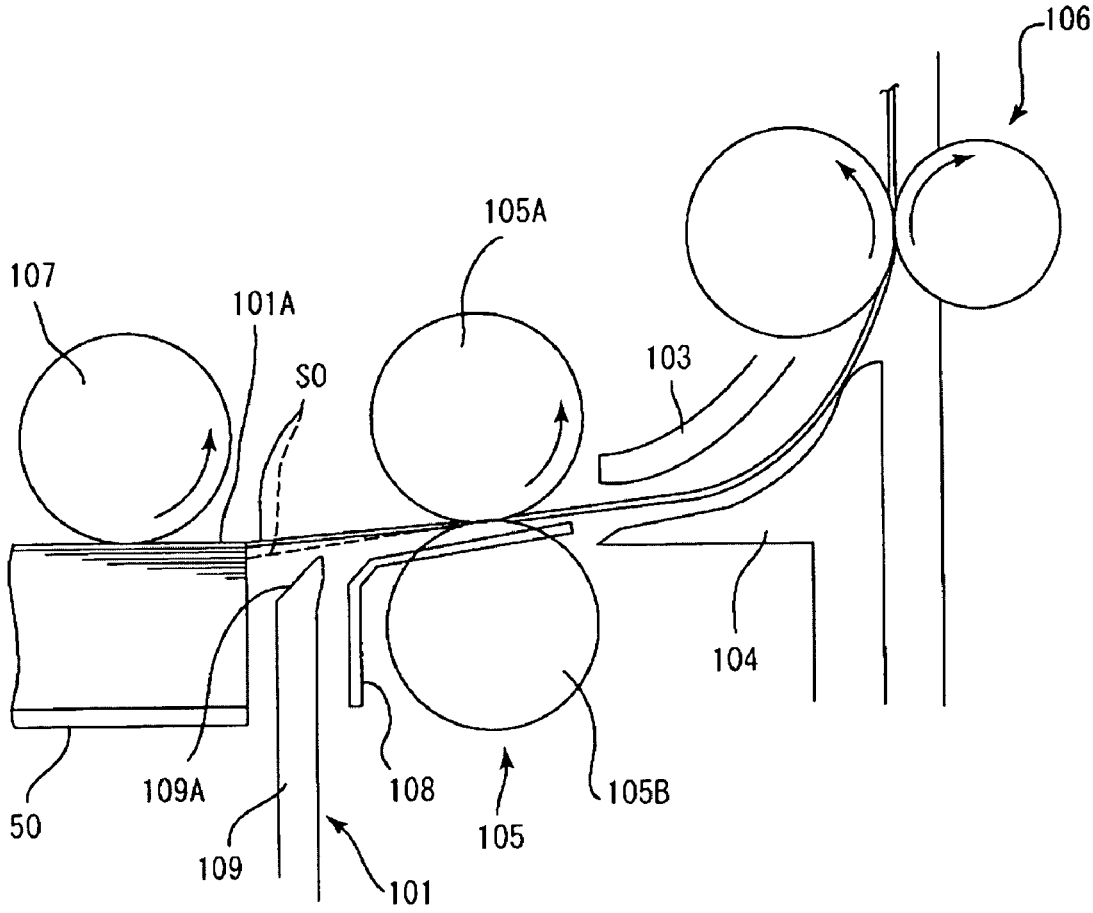
FIG. 17 is a schematic view of the paper conveying apparatus according to the conventional configuration for explaining the occurrence of an unusual sound due to a difference in height between a paper stacking surface and a paper feeding tray in the course of paper conveyance.
Figure 18:
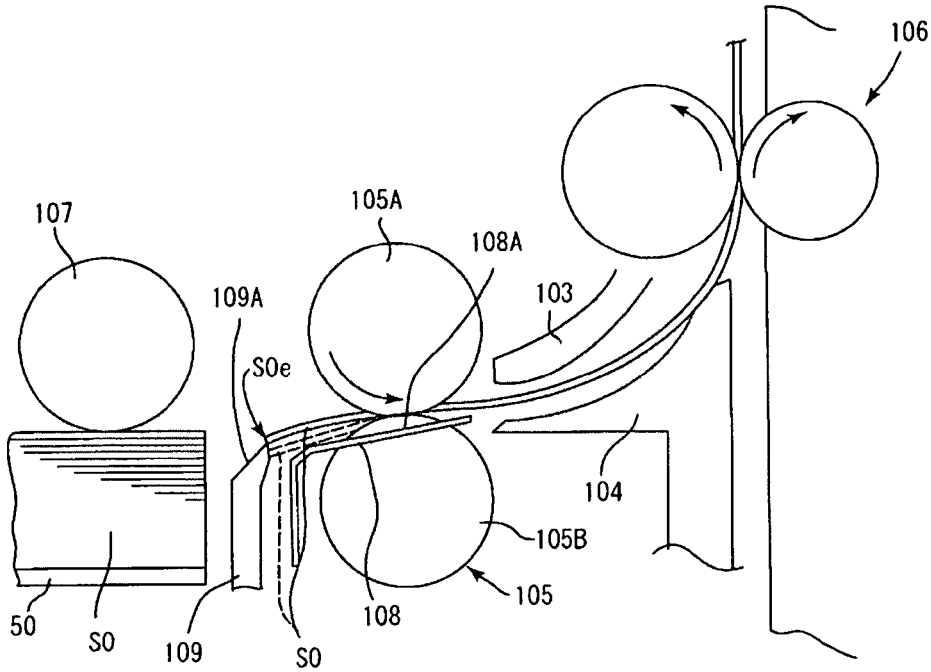
FIG. 18 is a schematic drawing of the paper conveying apparatus according to the conventional configuration for explaining the occurrence of an unusual sound due to a difference in height between the paper feeding tray and its adjacent external guide member in the course of paper conveyance.
Figure 19:
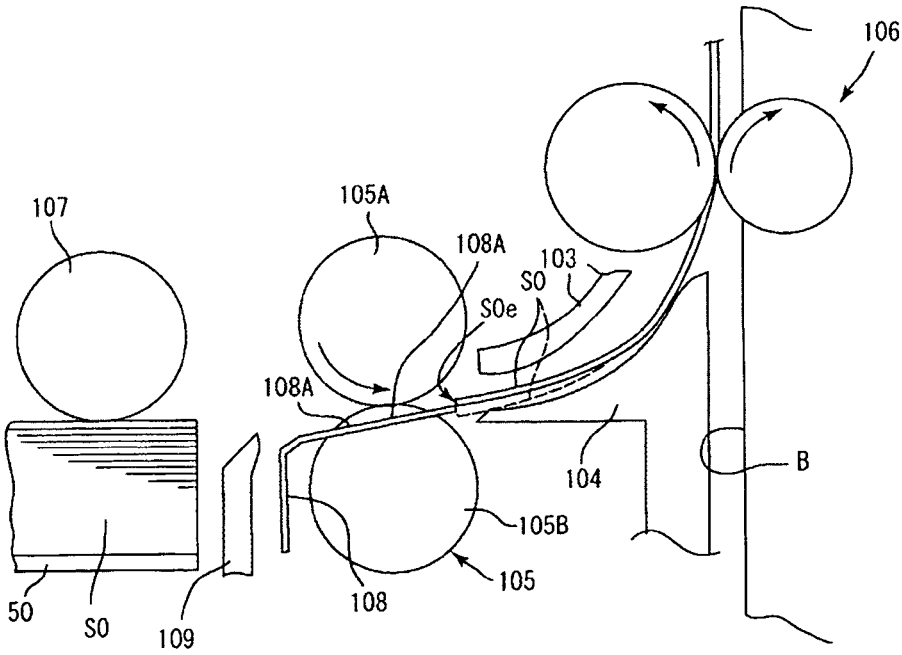
FIG. 19 is a schematic drawing of the paper conveying apparatus according to the conventional configuration for explaining the occurrence of an unusual sound due to a difference in height between an external guide member and another external guide member adjacent thereto in the course of paper conveyance.

Next, with reference to FIG. 15, a sixth embodiment of the present invention is explained. Here, components and members identical to those in the fifth embodiment are provided with the same reference numerals, and their description is omitted or simplified. Also, although not particularly noted, configurations not explained according to the fifth embodiment, that is, the paper conveying apparatus and other configurations, their operations, and others, are similar to those in the fifth embodiment.

As shown in FIG. 15, the paper conveying apparatus 5 according to the sixth embodiment is a conveying device configured such that, irrespectively of the number of stacked papers, the orientation of the paper is kept constant and, from a paper accommodating unit as a paper feeding unit configured to always supply a paper on top to a paper feeding position fixed to a constant position, the paper on top is drawn for conveyance. Between the pickup roller 60 to the feed roller 61, at least with the orientation of the paper as being stacked being kept as it is, the paper is conveyed approximately straight. Similarly, between the feed roller 61 and the belt, the paper is conveyed approximately straight until the tip of the paper reaches the conveying surface of the belt.

The tray bottom plate on which papers are stacked is configured as a so-called paper feeding table, and is provided so as to move upward and downward, with an angle for approximately horizontally stacking the papers being kept. That is, such a system in which the bottom plate as a paper feeding table is moved upward and downward is often used for a Large Capacity Tray (LCT), a manual paper feeding tray, and others. In this system, the bottom plate on which papers are stacked and placed is raised. In the drawing, the configuration of an LCT is depicted.

In more detail, as shown in the drawing, a tray bottom plate 97 is generally formed in a flat plate shape with a flat shape being ensured so as to allow papers S of a maximum size supported by the copier 1 to be stacked. With a surface in contact with the paper being always kept as a flat plane by a regulating member configured as appropriate, the tray bottom plate 97 is regulated in a manner such that a positional change in the horizontal direction is prohibited, but upward and downward movements are allowed. For example, an appropriated portion on the tray bottom plate 97 fits in a rail-shaped fixed guide member in a convex or groove shape extending in the vertical direction to be slidable in its extending direction. Also, the tray bottom plate 97 is driven by an up-and-down mechanism not shown and configured as appropriate in a rising and falling manner to an arbitrary position within a range allowing movements in upward and downward directions regulated by the regulating member. This up-and-down mechanism takes a stepping motor not shown or the like as a driving source. Furthermore, as a position detection sensor for detecting whether the paper on top of the stack is present at a paper feeding position, a position detection sensor not shown or the like is provided at the paper feeding position or as accompanying the pickup roller 60. Based on the detection result, an upward driving operation of the up-and-down mechanism is controlled by, for example, an appropriate control circuit, in a predetermined manner.

Therefore, in the configuration mainly including the tray bottom plate 97, based on the detection result of the position detection sensor, while the stacking surface is kept as a horizontal plane, the tray bottom plate 97 is driven by the up-and-down mechanism to be raised in a predetermined manner. With this, the papers stacked on the tray bottom plate 97 are conveyed upward with the paper surface being maintained on the horizontal plane. Then, the paper on top is positioned at the paper feeding position defined as a position where the paper makes contact with the pickup roller 60 driven at a predetermined fixed position.

Then, in the paper conveying apparatus 5 according to the present embodiment, in a section until the tip of the paper reaches the first conveying unit 6, the paper advances approximately straight. Also, in a section until the tip of the paper having reached the first conveying unit 6 further reaches the belt conveying unit 8, the paper advances approximately straight.

In other words, with reference to the paper feeding position and the paper surface at the paper feeing position, the first conveying unit 6 is disposed in a predetermined manner so that the paper conveying surface approximately coincides with a virtual plane obtained by extending the paper surface. Then, the grip roller 81 as a conveying member in an inner-area direction in the second conveying unit 7 is disposed upon selecting whether the grip roller 81 has its roller outer perimeter in contact with a virtual plane obtained by extending the paper conveying surface of the first conveying unit 6 or ensures a predetermined space distance away from the virtual plane. The belt conveying unit 8 facing the grip roller 81 and extending diagonally downward is disposed.

That is, as with the embodiments explained above, as a paper feeding and separating mechanism adopting an FRR paper feeding system, the first conveying unit 6 is configured in a manner such that the upper feed roller 61 and the lower reverse roller 62 are disposed to face each other in an approximately vertical direction so as to make contact with each other. The nip portion as a contact point of these rollers 61 and 62 is positioned on a virtual plane represented by a broken line in the drawing. The rollers 61 and 62 are disposed so that the rotation centers of the rollers 61 and 62 are positioned on a line orthogonal to the virtual plane and passing through the nip portion.

Also, the second conveying unit 7 includes a grip roller 81 as one of paired facing members disposed in the inner-area direction, and the belt conveying unit 8 as the other one of the paired facing members disposed in the outer-area direction. The belt conveying unit 8 has disposed therein the pulley 83 having a rotation center at a predetermined position on a line in the horizontal line with respect to the rotation center of the grip roller 81. The belt conveying unit 8 has also disposed therein the pulley 84 a predetermined distance below the paper conveying surface and having a rotation center at a position closer to the first conveying unit than the pulley 83. The conveyor belt 82 is wound and stretched around these pulleys 83 and 84. The outer perimeter of the conveyor belt 82 whose inner perimeter is supported by the pulley 83 makes contact with the outer perimeter of the grip roller 81 with a predetermined pressure being ensured. A contact point between the conveyor belt 82 and the grip roller 81 is taken as a nip portion.

Then, in the two sections explained above, a conveyance guide member 99 is singularly provided as a guide member provided in an outer-area direction of the paper conveying path. The conveyance guide member 99 has formed thereon a guide surface 99A, which is common between the two sections, is formed in a successively-provided flat shape, and is provided so as to be approximately parallel to the virtual plane, which is also a paper conveying surface by the first conveying unit 6 itself.

According to the present embodiment, a paper accommodating unit mainly including a tray base plate having the stacked papers placed thereon and capable of moving upward and downward to an arbitrary position is used. With reference to the paper stacking surface of the paper on top positioned at the paper feeding position, the nip portion of the first conveying unit is positioned on a virtual plane obtained by extending that paper surface. Also, the first conveying unit is configured in a manner such that the paper conveying direction of the first conveying unit itself is aligned with a direction obtained by extending the virtual plane. The belt conveying surface of the belt conveying unit of the first conveying unit is disposed so as to cross this extended direction. Then, a paper conveying path for a section from the pickup roller to the feed roller, which is the first conveying unit, is formed so as to be approximately parallel to the virtual plane with a predetermined space distance being ensured. Also, a paper conveying path for a section from the guide surface of the guide member positioned in the outer-area direction of the conveying path mentioned above and the feed roller, which is the first conveying unit, to the belt conveying unit is formed, thereby forming a guide surface of the guide member positioned in the outer-area direction of the conveying path. Furthermore, for these two guide surfaces, the single conveyance guide member 99 is responsible. The conveyor guide member 99 forms the single successive flat guide surface 99A set with the approximately parallel relation explained above.

The guide surface 99A of the conveyance guide member 99 is provided with an edge, which is a downstream end in the conveying direction, near but not in contact with the belt running surface of the conveyor belt 82. That is, the edge of the downstream of the guide surface 99A is formed approximately linearly in a direction orthogonal to the conveying direction with a predetermined small space distance being ensured to a degree of not causing a clicking sound. Also, the conveyance guide member 99 has a vertical surface facing a tip surface of the paper S stacked on the tray bottom plate 97 in the paper conveying direction. The tip surfaces of all papers S stacked abut on this vertical surface, thereby causing these papers S to be stacked and placed on the tray bottom plate 97 properly and orderly. Furthermore, an end of the papers S other than the tip abut on another member not shown with an appropriate configuration and, similarly, the position of the papers S in the horizontal direction on the tray bottom plate 97 is regulated in a predetermined manner.

Also, according to the present embodiment, at least, the paper accommodating unit mainly including the tray bottom plate 97 driven upward and downward is not provided thereunder with another paper accommodating unit. At least, there is no such a second conveying path as explained above that is configured to pass through the paper accommodating unit having the tray bottom plate 97 from the bottom.

As explained above, according to the paper conveying apparatus of the sixth embodiment, at least operation effects similar to those of the paper conveying apparatus of the fourth embodiment can be achieved. Also, in addition, the paper accommodating unit for use according to the first to the fifth embodiments where the angle of the bottom plate is changed depending on the number of stacked sheets, that is, the inclined angle of the paper stacking surface is changed within an allowable conveyable range, the angle of the bottom plate can be constant irrespectively of the number of sheets according to the present embodiment. In other words, the paper surface of the paper on top as the paper stacking surface at the time of starting conveyance can be kept at a constant angle and a constant position, for example, can be kept horizontal. Furthermore, in both of a section between the position where the paper on top is stacked to the position where the tip of the paper reaches the first conveying unit and a section where the tip of the paper goes from the first conveying unit to the belt conveying unit, the paper advances straight in the conveying direction without changing the orientation of the paper surface at all to reach the belt conveying unit. Therefore, the conveying resistance can be more reduced, thereby achieving more stable conveyance and preventing a clicking sound as explained above.

That is, according to the first to the fifth embodiments, when the number of sheets placed on the bottom plate is large, the inclined angle of the bottom plate is small, and the bottom plate is mildly inclined. As papers are conveyed more and paper feeding proceeds, when the number of sheets left on the bottom plate becomes small, the inclined angle of the bottom plate is increased to cause the bottom plate to be more steeply inclined. Accordingly, the inclined orientation of the paper on top is changed.

By contrast, according to the sixth embodiment, for the paper going on the conveying path from a point in contact with the pickup roller to the first conveying unit, the guide member in the outer-area direction of the conveying path does not change the advancing direction of the paper at all or deform the paper in the thickness direction of the paper. The resistance received by the paper going on the conveying path from the guide member is minimized. Furthermore, the resistance received by the latter half of the moving paper from the papers left and stacked on the tray bottom plate can be also minimized. That is, irrespectively of a decrease in the number of sheets placed on the tray bottom plate, the orientation of the paper surface of the paper on top is always kept the same. With a direction obtained by extending the paper surface being taken as the advancing direction, at least, the paper on top is conveyed with the same orientation at least until the tip of the paper reaches the belt conveying surface. Therefore, in a conveying state where any one point on the paper makes contact with the pickup roller, the first half and the latter half of the paper in the conveying direction with the pickup roller being taken as a boundary are not deformed at all in the paper thickness direction, and can be held on a virtual plane obtained by extending the paper surface of the paper stacked on top. For these reason, the resistance received by the paper in the course of paper conveyance to the first conveying unit can be minimized. Still further, a difference in height, which may cause an unusual sound, can be prevented for the guide member in the outer-area direction of the paper conveying path from the pickup roller to the belt conveying unit.

Furthermore, according to the first to the fifth embodiments, the number of papers that can be stacked and accommodated in the paper tray is restricted by the height dimension of the paper tray corresponding to the thickness direction of the papers. In the paper conveying apparatus according to the present embodiment, the number of papers is defined by the movable range of the bottom plate movable in upward and downward directions. Therefore, a sufficiently larger movable range of the bottom plate than the height dimension of the paper tray can be ensured in the configuration, thereby allowing a large number of papers to be stacked on the bottom plate for paper feeding. Therefore, according to the large capacity tray and an image forming apparatus adopting the paper conveying apparatus of the sixth embodiment, the number of times of paper refilling can be reduced, and image formation with stable and successive feeding of a large number of papers at one time can be achieved, thereby improving usability and image formation ability as the image forming apparatus.

As has been explained above, the belt conveying unit 8 of the paper conveying apparatus 5 according to each of the embodiments and others can be said as an example of a guiding unit that moves and guides the paper S to the nip portion with the grip roller 81 while maintaining a contact (abutment) of one of paired facing members of the second conveying unit 7 (nip conveying unit) with the tip of the paper (sheet). Thus, the moving and guiding member is not restricted to the belt conveying unit 8, but can be an arbitrary unit as long as it has the configuration and functions explained above and achieve the operation effects explained above.

According to the present embodiments, the first conveying unit and the second conveying unit are both nip conveying units, but may not be nip conveying units forming a nip portion by facing members if all that is required is that a bottom surface of the subject to be conveyed is supported for conveyance according to the conveying direction of each conveying unit.

Furthermore, according to the present embodiments, the example has been explained in which, as for different paper (sheet) conveying directions, an approximately horizontal direction is changed to an upward direction perpendicular thereto (approximately vertical direction). This is not meant to be restrictive. For example, a change from an approximately horizontal direction to a downward direction perpendicular thereto (approximately vertical direction), or a change from a perpendicularly upward or downward direction to an approximately horizontal direction are possible. Furthermore, both directions may be diagonal directions.

Members forming the first conveying unit, the second conveying unit, and the pickup roller are not restricted to those explained above, and may be approximately elongated cylindrical roller members with a predetermined length being ensured in the axial longitudinal direction of each rotation shaft, or short cylindrical roller members. Also, as appropriate, a plurality of roller members may be disposed on one rotation shaft so as to be a predetermined space apart from one another.

Furthermore, such a configuration is possible that, on some of the spaces without the roller members, guide surfaces formed by several guide members in the outer-area direction and the inner-area direction in each embodiment are positioned. For such guide surfaces, belt-shaped guide surfaces, approximately linear guide surfaces, or mixture of both as appropriate may be formed in the paper (sheet) direction as long as they are disposed regularly and symmetrically as appropriate with respect to a conveyance center line in the conveying direction.

Figure 23:
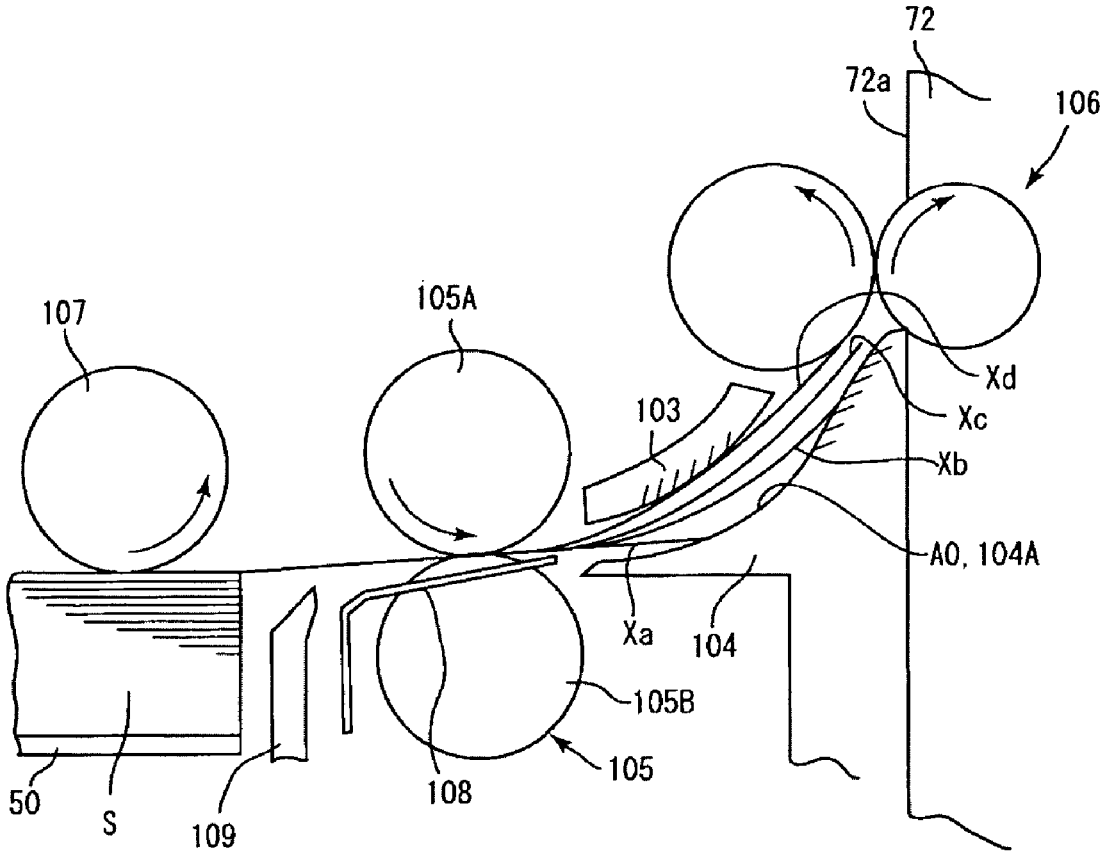
FIG. 23 is a schematic enlarged section view depicting an example in which a friction reducing process is performed on a curved guide member of the paper conveying apparatus, a low-friction member is affixed to the curved guide member, or a low-friction member is used as the curved guide member.

Moreover, in the explanation above, the guiding unit is capable of adding a paper advancing force. In view of the entire apparatus, it can be said that this capability is based on reduction in conveying load. In this case, for example, as a measure for reducing the conveying load occurring due to a contact of the paper with the inner area of the guide surface, even without adding an advancing force to the paper by the guiding unit, the portion of the inner or outer area of the guide surface in contact with the paper may be subjected to a friction reducing process to a degree that no paper jam occurs, or may be attached with a low-friction member or may be formed of a low-friction member (as shown in FIG. 23, refer to hatched portions of the fixed guide surface 103A of the curved guide member 103 and the curved guide member 104). Furthermore, it is possible to combine the guiding unit and the low friction portion together.

Furthermore, according to the present embodiments, the FRR paper feeding system is adopted as a paper feeding and separating mechanism. This is not meant to be restrictive. An arbitrary friction separation system can be adopted as long as it is a separation mechanism in which a paper stacked in a predetermined manner is separated by friction and only one paper is continued to be advanced in the conveying direction. For example, as for the feed roller, a separation nail may be used in place of the reverse roller. Alternatively, a friction pad system with the configuration in which a friction pad, which is a fixed member, is pressed may be adopted. That is, in this friction pad system, a friction pad as a friction member is pressed against the feed roller at an appropriate separation angle and separation pressure, thereby causing the paper to pass through a nip formed between the feed roller and the friction pad. Therefore, according to the paper feeding and separating mechanism adopting such a friction pad system, even if two papers are drawn as being stacked, further movement of the paper at the bottom in the conveying direction is stopped because a resistance received from the friction pad is larger than a resistance due to friction of stacked papers. On the other hand, as for the paper on top, since a conveying force received from the feed roller is larger than the resistance due to friction of stacked papers and also the resistance received from the friction pad. As a result, only the paper on the upper side continues to advance in the conveying direction.

The present invention is not limited to the monochrome copier 1. The sheet conveying apparatus according to the present invention can be applied to image forming apparatuses related to printers, the printers including color copiers, monochrome laser printers, inkjet printers, printers using an ink transfer ribbon.

As for the color copier, the present invention can be similarly applied for implementation to a tandem-type color image forming apparatus of a direct transfer system of sequential transfer and overlapping while a paper (sheet) being transferred by a transfer member, or a tandem-type image forming apparatus of a system of collective transfer on a paper after transfer is performed on an endless intermediate transfer belt as an intermediate transfer member. As a matter of course, the present invention can be similarly applied for implementation to an image forming apparatus with a single endless-belt-shaped photosensitive member.

The present invention is not restrictively applied to an image forming apparatus of an internal paper delivery type in which a paper is delivered between an image forming unit and a scanner, but can be applied to an image forming apparatus in which a paper is delivered to a paper delivery tray provided on a side portion of the image forming apparatus body. Also, the conveying path is formed in an approximately perpendicular direction (approximately vertically-upward direction) toward an upper portion of the main body 2 to convey the paper sent from the paper feeding device 3, but this is not meant to be restrictive. The present invention can be applied to an image forming apparatus in which the conveying path from the paper feeding device to the paper delivery tray from which a paper is delivered is in not an approximately perpendicular direction (approximately vertical direction).

The present invention may also be applied to sheet conveying apparatuses in printers including mimeograph printers, in which a sheet (paper) is conveyed from a sheet accommodating unit (paper feeding tray) or a sheet stacking unit (bottom plate or paper feeding table) for supply to a printing unit body.

Also, in the copier as the image forming apparatus, the document to be read is set through manual operation. Alternatively, the sheet conveying apparatus of the present invention may be applied to an ADF included in copier or printing apparatus for automatically reading a plurality of document sheets (sheets). That is, the present invention may be applied to an ADF configured to not only automatically convey a document of a single paper but also automatically convey one paper on top or bottom to a reading position and, after a read image is obtained from the document, stack the paper to a predetermined conveyance position for accommodation.

Furthermore, the image forming apparatus is not restricted to be a copier. Alternatively, the present invention may be applied to printing machines including facsimiles, printers, inkjet recording devices, mimeograph printing machines, and others; image reading apparatuses having a scanner that reads an image from a document and mainly including an image reading function; or multifunction products formed in combination of at least two of the above.

Still further, the sheet conveying apparatus applied to the image forming apparatus may be used only for conveying a paper (sheet) as explained above, or only for conveying a document in place of a paper. Alternatively, two paper conveying apparatuses may be separately provided for paper conveyance and document conveyance, respectively. Also, the sheet conveying apparatus may be applied to an image reading apparatus having a scanner that reads an image from writing paper and mainly including an image reading function for use in conveying the document similarly in place of a paper.

At any rate, the subject to be conveyed is not restricted to either one of a paper for image formation or a document for image reading. The sheet conveying apparatus can convey sheet materials of various types and configurations. Also, the sheet conveying apparatus can be made as the optimum one for a device or apparatus requiring a change of a sheet conveying direction, while achieving space saving on a sheet conveying path.

As has been discussed in the foregoing, the present invention has been explained regarding the particular embodiments, modification embodiments, example, and others. However, the technical scope disclosed by the present invention is not restricted to features exemplified in each embodiment, modification example, example, and others. Alternatively, these features may be combined as appropriate. It is evident for a person with an ordinary skill in the art that various embodiments, modification examples, or examples can be configured according to the requirement and use purpose within the scope of the present invention.

According to the present invention, new sheet conveying apparatus, image reading apparatus, and image forming apparatus capable of solving the problems mentioned above can be provided.

That is, according to the present invention, with the configuration provided with a guiding unit disposed in an outer-area direction of a paper conveying path formed between a first conveying unit and a second conveying unit, the guiding unit moving and guiding a sheet to the second conveying unit while maintaining a contact with a tip of the paper, a sheet conveying apparatus, an image reading apparatus including the sheet conveying apparatus, and an image forming apparatus including one or both of the sheet conveying apparatus and the image reading apparatus can be provided with a simple configuration at low cost and with an excellent supportability for sheet types (paper types), while achieving space saving.

Effects unique to each aspect of the present invention are listed as follows.

According to an embodiment of the present invention, a guiding unit is provided that is disposed in an outer-area direction of a paper conveying path formed between a first conveying unit and a second conveying unit, the guiding unit moving and guiding a paper to the second conveying unit while maintaining a contact with a tip of the paper. With this, a sheet with a relatively high stiffness, such as a cardboard, can be stably conveyed. Thus, a sheet conveying apparatus with an excellent supportability for sheet types (paper types) can be achieved and provided.

Furthermore, according to an embodiment of the present invention, with the configuration explained above, even in a sheet conveying apparatus having a merging path where the first sheet conveying path and the second sheet conveying path are joined on an upstream side of the second conveying unit, a sheet with a relatively high stiffness, such as a cardboard, can be stably conveyed. With this, an excellent supportability for sheet types (paper types) can be achieved. Also, such a sheet conveying apparatus as having at least equal to or more than two, that is, a plurality of, sheet conveying paths (conveying paths) can be supported. Therefore, a sheet conveying apparatus also with an excellent model supportability can be achieved and provided.

Moreover, according to an embodiment of the present invention, at least the second conveying unit from among the first conveying unit and the second conveying unit is a nip conveying unit that forms a nip portion that nips and conveys the sheet, and the guiding unit moves and guides the tip of the sheet to the nip portion of the second conveying unit. Therefore, the effects of the present invention according to the first or second aspect can be stably achieved.

Furthermore, according to an embodiment of the present invention, the guiding unit is a belt conveying unit including a belt that conveys the sheet to either one of the second conveying unit or the nip portion thereof while maintaining the contact with the tip of the sheet. Therefore, a sheet conveying apparatus with the simplest configuration at low cost as the guiding unit can be achieved and provided.

Moreover, according to an embodiment of the present invention, the belt conveying unit is disposed so that the tip of the sheet makes contact with a conveying surface of the belt except a portion of the belt held by the belt holding and rotating members. Therefore, with a moderate elastic displacement and deformation of the belt, it is possible to stably convey the sheet while maintaining a contact with the tip of the sheet.

Furthermore, according to an embodiment of the present invention, the belt conveying unit is disposed so that the tip of the sheet enters a conveying surface of the belt at an acute entering angle. With this, irrespectively of the behavior of the tip of the sheet, the tip of the sheet can be stably and reliably brought in contact with the conveying surface of the belt.

Moreover, according to an embodiment of the present invention, the width of the belt in a sheet width direction orthogonal to the sheet conveying direction of the first conveying unit is approximately equal to a sheet width of the sheet to be conveyed. Therefore, the sheet can always make contact with the belt conveying unit over the entire sheet width, thereby ensuring a contact area between the sheet and the belt at maximum. Accordingly, the largest possible driving force for advancing in the sheet conveying direction that can be supplied from the belt conveying unit to the sheet can be transmitted. Thus, the sheet conveying apparatus can more reliably and stably perform an appropriate sheet conveying operation, with a faulty conveyance or jam being prevented.

Furthermore, according to an embodiment of the present invention, the abutting member is disposed a position different from a position where the rear end of the conveyed sheet makes contact with the conveying surface of the belt. Therefore, even if the rear end of the sheet being conveyed makes contact with the conveying surface of the belt, elastic deformation the position of the belt in contact with the rear end of the sheet can be allowed. Thus, even if the rear end of the sheet makes contact with the belt as if it collides therewith, the abutting member does not hinder the deformation of the belt portion in contact with the rear end of the sheet. The impact by the collision can be absorbed and mitigated by sufficiently deforming the belt, thereby controlling an impactive sound (abrupt clicking sound).

Moreover, according to an embodiment of the present invention, at least one guide member is provided that forms either one of the sheet conveying path or a first sheet conveying path between the first conveying unit and the belt conveying unit and guides the tip of the sheet to a conveying surface of the belt. With this, irrespectively of the sheet type (paper type), the tip of the sheet can be reliably introduced and guide to the conveying surface of the belt.

Furthermore, according to an embodiment of the present invention, a guide surface of a guide member disposed in an outer-area direction of the sheet conveying path or the first sheet conveying path has a shape so as to cause the sheet conveyed on the sheet conveying path or the first sheet conveying path to advance approximately straight ahead. Therefore, the conveying load received by the tip of the sheet from the guide member during sheet conveyance from the first conveying unit to the belt conveying unit can be reduced. Thus, it is possible to suppress the occurrence of an unusual sound, such as a clicking sound, at the time of conveying a sheet with a relatively high stiffness, such as a cardboard, thereby reducing a sheet conveying sound. That is, with this configuration, on the sheet conveying path, there is no such a case where the guide member in the outer-area direction of the sheet conveying path changes the sheet advancing direction in the sheet thickness direction or deforms the sheet. Also, the resistance received by the advancing sheet from the guide member can be minimized enough for maintaining the route causing the sheet to advance approximately straight ahead. On the other hand, the guide member in the outer-area direction of the first sheet conveying path is formed in a shape that allows the sheet to advance approximately straight ahead, thereby preventing a difference in height, which may cause an unusual sound.

Moreover, according to an embodiment of the present invention, for example, the load due to sheet conveyance in the sheet separating mechanism can be further reduced. Thus, it is possible to suppress the occurrence of an unusual sound, such as a clicking sound, at the time of conveying a sheet with a relatively high stiffness, such as a cardboard, thereby more effectively reducing a sheet conveying sound. That is, among first guide members formed on the sheet conveying path from the feeding rotating member to the first conveying unit, the first guide member in the outer-area direction of the sheet conveying path has a guide surface that is formed in a shape allowing the sheet conveyed on the sheet conveying path to advance approximately straight ahead. In this case, on the sheet conveying path, there is no such a case where the first guide member in the outer-area direction of the sheet conveying path changes the sheet advancing direction in the sheet thickness direction or deforms the sheet. Also, the resistance received by the advancing sheet from the guide surface of the guide member can be minimized enough for maintaining the route causing the sheet to advance approximately straight ahead. On the other hand, the first guide member in the outer-area direction of the sheet conveying path and forming the sheet conveying path between the feeding rotating member and the first conveying unit has a guide surface that is formed in a shape allowing the sheet to advance approximately straight ahead. Thus, a difference in height, which may cause an unusual sound, can be prevented.

Furthermore, according to an embodiment of the present invention, compared with the configuration according to the eleventh aspect, for example, the load due to sheet conveyance in the sheet separating mechanism can be further reduced. Thus, it is possible to suppress the occurrence of an unusual sound, such as a clicking sound, at the time of conveying a sheet with a relatively high stiffness, such as a cardboard, thereby more effectively reducing a sheet conveying sound. That is, in addition to the configuration according to the eleventh aspect, with the movement of the sheet stacking member, the sheet surface of the sheet on top in contact with the feeding rotating member and the sheet surface of the sheet being conveyed at least until reaching the first conveying unit are set to belong an approximately same plane. Therefore, for the sheet going on the sheet conveying path from a position in contact with the feeding rotating member to the first conveying unit, there is no such a case where the guide member in the outer-area direction of the sheet conveying path changes the sheet advancing direction in the sheet thickness direction or deforms the sheet. Also, the resistance received by the sheet going on the sheet conveying path from the guide member can be minimized. Not only that, the resistance received by the latter half of the moving sheet from the sheets stacked and left on the sheet stacking member can be minimized. With this, the resistance received by the sheet in the course of sheet conveyance until reaching the first conveying unit can be minimized. On the other hand, a difference in height, which may cause an unusual sound, can be prevented from being formed on the guide member in the outer-area direction of the sheet conveying path formed between the feeding rotating member and the belt conveying unit.

Moreover, according to an embodiment of the present invention, the load due to sheet conveyance in the sheet separating mechanism can be further reduced. Thus, it is possible to suppress the occurrence of an unusual sound, such as a clicking sound, at the time of conveying a sheet with a relatively high stiffness, such as a cardboard, thereby more effectively reducing a sheet conveying sound. That is, at least one second guide member is provided that forms a sheet conveying path from the sheet separating mechanism to the belt conveying unit, and a plane defined by a contact point between the sheet feeding rotating member and the separating member and a guide surface of the second guide member disposed in the outer-area direction of the sheet conveying path among the guide members are set to have an approximately parallel relation. Therefore, for the sheet advancing from the sheet separating mechanism on the plane defined by the contact point of the sheet separating mechanism, there is no such a case where the second guide member in the outer-area direction of the sheet conveying path changes the sheet advancing direction in the sheet thickness direction or deforms the sheet. Thus, the resistance received by the sheet going on the sheet conveying path from the second guide member can be minimized enough for maintaining the route of the sheet. On the other hand, a difference in height, which may cause an unusual sound, can be prevented from being formed on the second guide member in the outer-area direction of the sheet conveying path on the sheet conveying path from the sheet separating mechanism until the sheet reaches the belt conveying unit has a guide surface.

Furthermore, according to an embodiment of the present invention, the load due to sheet conveyance in the sheet separating mechanism can be further reduced. Thus, it is possible to suppress the occurrence of an unusual sound, such as a clicking sound, at the time of conveying a sheet with a relatively high stiffness, such as a cardboard, thereby more effectively reducing a sheet conveying sound. That is, a plane defined by the feeding rotating member and the sheet feeding rotating member and a guide surface of a guide member disposed in the outer-area direction of the sheet conveying path among third guide members are set to have an approximately parallel relation. Therefore, for the sheet advancing on the sheet conveying path from a point in contact with the feeding rotating member to the first conveying unit, there is no such a case where the third guide member in the outer-area direction of the sheet conveying path changes the sheet advancing direction in the sheet thickness direction or deforms the sheet. Also, the resistance received by the sheet going on the sheet conveying path from the third guide member can be minimized enough for maintaining the route of the sheet. Not only that, the resistance received by the moving sheet from the sheets left near the feeding and rotating member can be minimized. With this, the resistance received by the sheet in the course of sheet conveyance until reaching the first conveying unit can be minimized. On the other hand, a difference in height, which may cause an unusual sound, can be prevented from being formed on the third guide member in the outer-area direction of the sheet conveying path between the feeding and rotating member and the first conveying unit.

Moreover, according to an embodiment of the present invention, the load at the time of sheet conveyance can be further reduced compared with the sheet conveying apparatus according to the tenth aspect. Therefore, it is possible to stably convey a high-stiffness sheet, such as a cardboard. That is, in addition to the configuration according to the tenth aspect, a fourth guide member disposed in an inner-area direction of the sheet conveying path is provided in a inner-area direction side from a tangent line of paired facing members disposed in the inner-area direction in the first conveying unit and the second conveying unit. Therefore, in the course of sheet conveyance, there is no such a case where the fourth guide member hinders the tip of the sheet from going on the tangent line, deforms an approximately intermediate portion on the sheet between the tip and the rear end of the sheet or, after deformation, makes contact with that portion in a sliding manner. Thus, a sheet conveying resistance by the fourth guide member due to the above can be prevented.

Furthermore, according to an embodiment of the present invention, in the sheet conveying apparatus in which at least one of a plurality of sheet conveying apparatuses has a belt conveying unit, the effects according to any one of the fourth to fifteenth aspects can be achieved.

Moreover, according to an embodiment of the present invention, an image reading apparatus has the sheet conveying apparatus according to an embodiment of the present invention. Therefore, since the sheet to be conveyed by the sheet conveying apparatus according to an embodiment of the present invention is a document, at least the operation effects according to first to sixteenth aspects of improving a sheet (document) conveying ability can be achieved. Thus, an image reading apparatus with an excellent supportability for sheet types (paper types) can be achieved and provided. That is, documents composed of various types of sheets can be reliably and excellently conveyed within a compact space while changing a sheet (document) conveying direction to a predetermined direction.

Furthermore, according to an embodiment of the present invention, an image forming apparatus has any one or both of the sheet conveying apparatus according to an embodiment of the present invention and the image reading apparatus according to the seventeenth aspect. Therefore, the effects described above and the like can be achieved. That is, it is possible to improve at least a conveying ability for either one or both of a sheet and a document as a subject to be conveyed. Thus, an image forming apparatus with an excellent supportability for sheet types (paper types) can be achieved and provided.

Moreover, according to an embodiment of the present invention, the image forming apparatus is any one of a copier, a facsimile, a printer, a printing machine, and inkjet recording devices, or a multifunction product formed in combination of at least two of the above. With this, even when the image forming apparatus is any one of a copier, a facsimile, a printer, a printing machine, and inkjet recording devices, or a multifunction product, at least the effects according to an embodiment of the present invention of improving a sheet conveying ability can be achieved, thereby attaining an excellent supportability for sheet types (paper types).

Furthermore, according to an embodiment of the present invention, at least part of the fourth guide member is provided outside of a line segment connecting a point of changing the conveying direction, a center of a nip portion of the first conveying unit, and a center of a nip portion of the second conveying unit. With this, even if the sheet flips to the inner-area direction of the sheet conveying path due to the strength of a cardboard, the sheet can be reliably guided. At this time, to the load by the fourth guide member at the time of sheet conveyance, a sheet conveying force is added, thereby stably conveying a high-stiffness sheet, such as a cardboard.

Moreover, according to an embodiment of the present invention, the load at the time of sheet conveyance can be reduced, thereby stably conveying a high-stiffness sheet, such as a cardboard. That is, the fourth guide member disposed in an inner-area of the sheet conveying path is provided in an inner-area direction side of a tangent line of paired facing members disposed in the inner-area direction in the first conveying unit and the second conveying unit. Therefore, in the course of sheet conveyance, there is no such a case where the fourth guide member hinders the tip of the sheet from going on the tangent line, deforms an approximately intermediate portion on the sheet between the tip and the rear end of the sheet or, after deformation, makes contact with that portion in a sliding manner. Thus, a sheet conveying resistance by the fourth guide member due to the above can be prevented.

Furthermore, according to an embodiment of the present invention, the belt conveying unit is disposed so that the tip of the sheet enters a conveying surface of the belt at an acute entering angle. Therefore, irrespectively of the behavior of the tip of the sheet, the tip of the sheet can be stably and reliably brought in contact with the conveying surface of the belt. With this, a high-stiffness sheet, such as a cardboard, can be stably conveyed.

Moreover, according to an embodiment of the present invention, the belt conveying unit is disposed so that the tip of the sheet enters a conveying surface of the belt at an acute entering angle. Therefore, irrespectively of the behavior of the tip of the sheet, the tip of the sheet can be stably and reliably brought in contact with the conveying surface of the belt. Furthermore, with this configuration, even for an image forming apparatus of an internal paper delivery type, it is not required to increase the width of the apparatus. Even if the width remains the same as that of the conventional apparatus or is smaller, a high-stiffness sheet, such as a cardboard, can be stably conveyed.

Furthermore, according to an embodiment of the present invention, the belt conveying unit is disposed so that the tip of the sheet makes contact with a conveying surface of the belt except a portion of the belt held by the belt holding and rotating members. Therefore, with a moderate elastic displacement and deformation of the belt, it is possible to stably hold and convey the sheet.

Moreover, according to an embodiment of the present invention, not only the sheet conveying force by the first conveying unit, a sheet conveying force by the guiding unit is added. Therefore, the sheet can be conveyed against the sheet conveying load occurring due to a contact of the surface of the sheet with at least one guide member. With this, the sheet conveying load can be reduced, thereby stably conveying even a high-stiffness sheet, such a cardboard.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying apparatus, comprising:

a first conveying unit that conveys a sheet;

a second conveying unit that conveys the sheet conveyed by the first conveying unit in a direction different from a sheet conveying direction of the first conveying unit; and a guiding unit that moves the sheet while maintaining a contact with a tip of the sheet, to guide the sheet to the second conveying unit, wherein the second conveying unit is disposed on a downstream side in the sheet conveying direction of the first conveying unit, the guiding unit is disposed in an outer area of a sheet conveying path formed between the first conveying unit and the second conveying unit, the second conveying unit is a nip conveying unit that includes a nip portion to nip and convey the sheet, and the guiding unit is a belt conveying unit including a belt that conveys the sheet to either one of the second conveying unit and the nip portion, while maintaining the contact with the tip of the sheet.

2. The sheet conveying apparatus according to claim 1, wherein the belt conveying unit further includes at least one pair of belt rotating members that holds the belt to allow the belt to rotate, and the belt conveying unit is disposed in such a manner that the tip of the sheet makes contact with a conveying surface of the belt other than a portion of the belt held by the belt rotating members.

3. The sheet conveying apparatus according to claim 1, wherein the belt conveying unit is disposed in such a manner that the tip of the sheet enters at an acute angle with respect to a conveying surface of the belt.

4. The sheet conveying apparatus according to claim 1, further comprising:

at least one guide member that forms either one of the sheet conveying path or a first sheet conveying path between the first conveying unit and the belt conveying unit, and guides the tip of the sheet to a conveying surface of the belt.

5. The sheet conveying apparatus according to claim 1, wherein the sheet has a relatively high stiffness.

6. A sheet conveying apparatus comprising:

a plurality of sheet conveying devices each of which including a first conveying unit that conveys a sheet;

a second conveying unit that conveys the sheet conveyed by the first conveying unit in a direction different from a sheet conveying direction of the first conveying unit; and a guiding unit that moves the sheet towards the second conveying unit, wherein the second conveying unit is disposed on a downstream side in the sheet conveying direction of the first conveying unit, the guiding unit is disposed in an outer area of a sheet conveying path formed between the first conveying unit and the second conveying unit, the second conveying unit is a nip conveying unit that includes a nip portion to nip and convey the sheet, and the guiding unit of at least one of the sheet conveying devices is a belt conveying unit including a belt that conveys the sheet to either one of the second conveying unit and the nip portion.

7. An image reading apparatus, comprising:

a sheet conveying device that includes a first conveying unit that conveys a sheet;

a second conveying unit that conveys the sheet conveyed by the first conveying unit in a direction different from a sheet conveying direction of the first conveying unit; and a guiding unit that moves the sheet while maintaining a contact with a tip of the sheet, to guide the sheet to the second conveying unit, wherein the second conveying unit is disposed on a downstream side in the sheet conveying direction of the first conveying unit, the guiding unit is disposed in an outer area of a sheet conveying path formed between the first conveying unit and the second conveying unit, the second conveying unit is a nip conveying unit that includes a nip portion to nip and convey the sheet, and the guiding unit is a belt conveying unit including a belt that conveys the sheet to either one of the second conveying unit and the nip portion, while maintaining the contact with the tip of the sheet.

8. An image forming apparatus comprising:

a sheet conveying device that includes a first conveying unit that conveys a sheet;

a second conveying unit that conveys the sheet conveyed by the first conveying unit in a direction different from a sheet conveying direction of the first conveying unit; and a guiding unit that moves the sheet while maintaining a contact with a tip of the sheet, to guide the sheet to the second conveying unit, wherein the second conveying unit is disposed on a downstream side in the sheet conveying direction of the first conveying unit, the guiding unit is disposed in an outer area of a sheet conveying path formed between the first conveying unit and the second conveying unit, the second conveying unit is a nip conveying unit that includes a nip portion to nip and convey the sheet, and the guiding unit is a belt conveying unit including a belt that conveys the sheet to either one of the second conveying unit and the nip portion, while maintaining the contact with the tip of the sheet.

9. A sheet conveying apparatus that conveys a sheet of at least 256 $g/m^2$ to 300 $g/m^2$, the sheet conveying apparatus comprising:

a first conveying unit that conveys a sheet;

a second conveying unit that conveys the sheet conveyed by the first conveying unit in a direction different from a sheet conveying direction of the first conveying unit; and a belt conveying unit including a belt that moves the sheet to guide the sheet to the second conveying unit, wherein the second conveying unit is disposed on a downstream side in the sheet conveying direction of the first conveying unit, the belt conveying unit is disposed in an outer area of a sheet conveying path formed between the first conveying unit and the second conveying unit, and the belt conveying unit is disposed in such a manner that a tip of the sheet enters at an acute angle with respect to a conveying surface of the belt.

10. An image forming apparatus comprising:

a paper feeding unit that feeds a sheet;

a document reading unit that reads an image of a document;

an image forming unit that forms the image read by the document reading unit on the sheet fed from the paper feeding unit;

a sheet delivering unit that delivers the sheet output from the image forming unit; and a sheet conveying unit that conveys a sheet of at least 256 $g/m^2$ to 300 $g/m^2$ from the paper feeding unit to the image forming unit, the sheet conveying unit including a first conveying unit that conveys the sheet fed from the paper feeding unit;

a second conveying unit that conveys the sheet conveyed by the first conveying unit in a direction different from a sheet conveying direction of the first conveying unit; and a belt conveying unit including a belt that moves the sheet to guide the sheet to the second conveying unit, wherein the second conveying unit is disposed on a downstream side in the sheet conveying direction of the first conveying unit, the belt conveying unit is disposed in an outer area of a sheet conveying path formed between the first conveying unit and the second conveying unit, and the belt conveying unit is disposed in such a manner that a tip of the sheet enters at an acute angle with respect to a conveying surface of the belt.

11. A sheet conveying apparatus comprising:

a first conveying unit that conveys a sheet;

a second conveying unit that conveys the sheet conveyed by the first conveying unit in a direction different from a sheet conveying direction of the first conveying unit;

a guiding unit that moves the sheet to guide the sheet to the second conveying unit; and a guide member that guides the sheet to the guiding unit, wherein the second conveying unit is disposed on a downstream side in the sheet conveying direction of the first conveying unit, the guiding unit is disposed in an outer area of a sheet conveying path formed between the first conveying unit and the second conveying unit, the guide member is disposed at the outer-area of the sheet conveying path between the first conveying unit and the second conveying unit, the guiding unit is a belt conveying unit including a belt that conveys the sheet to the second conveying unit, the belt conveying unit further includes a belt rotating member that holds the belt to allow the belt to rotate and an outer-area rotating member in the second conveying unit, and is formed by winding the belt around the belt rotating member and the outer-area rotating member, and the belt rotating member is positioned upward from an axial center of a rotating member provided in an outer area of the first conveying unit and downward from a downstream end of the guide member.

12. A sheet conveying apparatus comprising:

a first conveying unit that conveys a sheet;

a second conveying unit that conveys the sheet conveyed by the first conveying unit in a direction different from a sheet conveying direction of the first conveying unit; and a guiding unit that moves the sheet to guide the sheet to the second conveying unit, wherein the second conveying unit is disposed on a downstream side in the sheet conveying direction of the first conveying unit, the guiding unit is disposed in an outer area of a sheet conveying path formed between the first conveying unit and the second conveying unit, the guiding unit is a belt conveying unit including a belt that conveys the sheet to the second conveying unit, the belt conveying unit further includes a belt rotating member that holds the belt to allow the belt to rotate and an outer-area rotating member in the second conveying unit, and is formed by winding the belt around the belt rotating member and the outer-area rotating member, and the belt conveying unit is disposed in such a manner that a tip of the sheet makes contact with a conveying surface of the belt other than a portion of the belt held by the belt rotating members.

* * * * *